US005270148A

United States Patent [19]

Morigaki et al.

[11] Patent Number: 5,270,148

[45] Date of Patent: Dec. 14, 1993

[54] PROCESSING SOLUTION FOR SILVER HALIDE COLOR PHOTOGRAPHIC MATERIALS AND METHOD FOR PROCESSING THE MATERIALS WITH THE PROCESSING SOLUTION

[75] Inventors: Masakazu Morigaki; Shigeru Nakamura; Yoshihiro Fujita; Hiroshi Kawamoto, all of Kanagawa, Japan

[73] Assignee: Fuji Photo Film Co., Ltd., Kanagawa, Japan

[21] Appl. No.: 876,749

[22] Filed: Apr. 29, 1992

[30] Foreign Application Priority Data

Jun. 5, 1991 [JP] Japan ..... 3-159918

[51] Int. Cl.[5] ..... G03C 11/00

[52] U.S. Cl. ..... 430/372; 430/428; 430/430; 430/455; 430/461; 430/463

[58] Field of Search ..... 430/372, 428, 463, 490, 430/430, 455, 461

[56] References Cited

U.S. PATENT DOCUMENTS

| | | | |
|---|---|---|---|
| 3,247,201 | 4/1966 | De Marle et al. | 260/247.2 |
| 4,292,401 | 9/1981 | Itoh et al. | 430/393 |
| 4,599,427 | 7/1986 | Oeckl et al. | 548/262 |
| 4,786,583 | 11/1988 | Schwartz | 430/372 |
| 4,800,153 | 1/1989 | Morimoto et al. | 430/428 |
| 4,851,325 | 7/1989 | Morimoto et al. | 430/372 |
| 4,859,574 | 8/1989 | Gormel | 430/372 |
| 4,917,992 | 4/1990 | Tirel et al. | 430/465 |

FOREIGN PATENT DOCUMENTS

| | | |
|---|---|---|
| 0106243 | 4/1984 | European Pat. Off. . |
| 0204197 | 12/1986 | European Pat. Off. . |
| 0329086 | 8/1989 | European Pat. Off. . |
| 0395442 | 10/1990 | European Pat. Off. . |
| 61-75354 | 4/1986 | Japan . |
| 63-244036 | 10/1988 | Japan . |
| 2-230043 | 9/1989 | Japan . |
| 2-153350 | 6/1990 | Japan . |

*Primary Examiner*—Hoa Van Le

*Attorney, Agent, or Firm*—Sughrue, Mion, Zinn, Macpeak & Seas

[57] ABSTRACT

A processing solution for a silver halide color photographic material, wherein said solution contains at least one kind of a compound represented by formula (I) and at least one kind of a compound represented by formula (A);

(I)

wherein X represents a nonmetallic atomic group necessary for forming a nitrogen-containing heteroaromatic ring;

(A)

wherein $X_0$ represents a non-metallic atomic group necessary for forming a nitrogen-containing heteroaromatic ring; and $R_a$ and $R_b$, which may be same or different, each represents an alkyl group or an alkenyl group and $R_a$ and $R_b$ may be bonded each other to form a 4- to 8-membered ring, and a method for processing a silver halide color photographic material with the above processing solution.

29 Claims, No Drawings

PROCESSING SOLUTION FOR SILVER HALIDE COLOR PHOTOGRAPHIC MATERIALS AND METHOD FOR PROCESSING THE MATERIALS WITH THE PROCESSING SOLUTION

FIELD OF THE INVENTION

The present invention relates to a processing solution being used for processing a silver halide color photographic material, (hereinafter, also referred to as a color photographic material or a light-sensitive material) and a processing method using it, and more particularly a processing solution giving a reduced formaldehyde vapor pressure that is excellent in stabilizing dye images, and a method for processing the silver halide color photographic material with the processing solution.

BACKGROUND OF THE INVENTION

In general, the fundamental steps for processing a color photographic material are a color development step and a desilvering step. In the color development step, the exposed silver halide is reduced by a color developing agent to form silver and at the same time the oxidized color developing agent reacts with color forming agents (couplers) to form dye images. In the subsequent desilvering step, silver formed in the color development step is oxidized by an oxidizing agent called a bleaching agent; this oxidized silver is then dissolved by a complex ion forming agent of silver ions called a fixing agent. As the result of applying the desilvering step, dye images only are formed on the color photographic material.

Usually, after these steps, a wash process removes unnecessary components left on the color photographic material from the processing solutions. In the case of a color photographic paper and a reversal color photographic paper, processing is finished by the above-described steps and then the color photographic material is generally subjected to a drying step. In the case of a color negative photographic film and a color reversal photographic film, however a stabilization step is added to the foregoing steps. It is well-known that formalin (a 37% aqueous solution of formaldehyde) is used in the stabilizing bath to prevent fading of magenta dyes caused by magenta couplers remaining in the color photographic material after processing. A certain amount of the formaldehyde vapor is generated during preparation of the stabilizing bath containing formalin and during drying of color photographic materials processed in these baths.

It is known that the inhalation of formalin is harmful for the human body and the Japan Association of Industrial Health that the allowable concentration of formaldehyde in a working environment is 0.5 ppm or less. Accordingly, efforts to reduce the concentration of formalin in a stabilizing bath and replacing formaldehyde with an alternative have been made to improve the working environment.

As an alternative for formalin, hexamethylenetetramine series compounds are described in JP-A-63-244036 (the term "JP-A" as used herein means an "unexamined published Japanese patent application"). By using these compounds, the concentration of formaldehyde, that is, the vapor pressure of formaldehyde can be reduced but the ability to prevent fading of magenta dye is also reduced. Thus, the essential purpose of using these compounds is diminished for when the color images formed are allowed to stand, the magenta color fades within few weeks, even at room temperature.

Also, U.S. Pat. Nos. 4,786,583 and 4,859,574 describe urea and N-methylol compounds such as guanidine, melamine, etc.

Further, JP-A-61-75354, JP-A-61-42660, JP-A-62-255948, JP-A-1-295258, and JP-A-2-54261 describe 1-(dihydroxyaminomethyl)benztriazoles, JP-A-1-230043, etc., describes N-(morpholinomethyl)heterocyclic thiones and N-(piperidinomethyl)heterocyclic thiones, and JP-A-2- 153350 describes bis(alkylamino)methane and bis(anilino)methane.

However, although some these compounds reduce vapor pressure of formaldehyde (as compared with that formed when using formalin alone), the image storage stability is poor. The rest of these compounds that do have improved image storage stability produce a vapor pressure of formaldehyde similar to that produced when using formalin. Thus, the foregoing compounds do not simultaneously improve the image storage stability and reduce of the vapor pressure of formaldehyde.

It has also been found that when these compounds are used in a larger amount than that of formaldehyde for obtaining the improved image storage stability similar to that obtained by formalin, the side reaction is easily generated. Examples of the side reaction include formation of stains, deterioration of the storage stability of other dyes contained in the color photographic material processed as well as yellow dyes and cyan dyes, and attachment to the color photographic material which stains the color images formed.

Thus, there has been strong demand for an innovative process to prevent magenta dye fading and lower the vapor pressure of formaldehyde.

SUMMARY OF THE INVENTION

One object of the present invention is to provide a photographic processing solution which does not substantially release compounds in amounts harmful to the human body.

A second object of the present invention is to provide a photographic processing method which is safe and can give color images having excellent image storage stability after processing.

A third object of the present invention is to provide an excellent photographic process which gives color images having an excellent image storage stability and causes no problems of staining color photographic materials, etc.

A fourth object of the present invention is to provide a photographic processing method which is a low cost and can give color images having an excellent image storage stability.

As the result of various investigations, the above objects can be achieved by (1) a photographic processing solution containing at least one kind of a compound represented by formula (I) and at least one kind of a compound represented by formula (A);

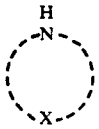

(I)

wherein X represents a non-metallic atomic group necessary for forming a nitrogen-containing heteroaromatic ring;

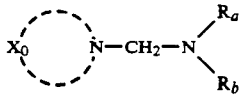

(A)

wherein $X_0$ represents a non-metallic atomic group necessary for forming a nitrogen-containing heteroaromatic ring; and $R_a$ and $R_b$, which may be the same or different, each represents an alkyl group or an alkenyl group and $R_a$ and $R_b$ may be bonded each other to form 4- to 8-membered ring, and (2) a method for processing an imagewise exposed silver halide color photographic material with the above processing solution.

The effect of the present invention by the use of the compound represented by formula (I) and the compound represented by formula (A) together is very excellent as compared to the case of the compound represented by formula (A).

The processing solution of the present invention can provide a working circumstance giving the greatly reduced vapor pressure of formaldehyde.

DETAILED DESCRIPTION OF THE INVENTION

The present invention is described in detail.

In formula (I) described above, X represents a non-metallic aromatic group necessary for forming a nitrogen-containing heteroaromatic ring. Examples of the nitrogen-containing heteroaromatic ring include a pyrrole ring, a pyrazole ring, an imidazole ring, a triazole ring, a tetrazole ring, rings formed by condensing benzene to the foregoing rings (e.g., an indazole ring, an indole ring, an isoindole ring, a benzimidazole ring, and a benztriazole ring), rings formed by condensing a heterocyclic ring to the foregoing rings (e.g., a purine ring), and rings formed by condensing an alicyclic ring to the foregoing rings (e.g., a 4,5,6,7-tereahydroindazole ring).

These nitrogen-containing heteroaromatic rings each may have a substituent and examples of the substituent include an alkyl group (e.g., methyl, ethyl, n-propyl, butyl, cyclopropyl, hydroxymethyl, and methoxymethyl), an alkenyl group (e.g., allyl), an aryl group (e.g., phenyl and 4-tert-butylphenyl), a halogen atom (e.g., chlorine, bromine, and fluorine), a heterocyclic group (e.g., 5-pyrazolyl and 4-pyrazolyl), a nitro group, a cyano group, a sulfo group, a carboxy group, a phospho group, an acyl group (e.g., acetyl, benzoyl, and propanoyl), a sulfonyl group (e.g., methanesulfonyl, octanesulfonyl, benzenesulfonyl, and toluenesulfonyl), a sulfinyl group (e.g., dodecanesulfinyl), an acyloxy group (e.g., acetoxy), an alkoxycarbonyl group (e.g., methoxycarbonyl and butoxycarbonyl), a carbamoyl group (e.g., carbamoyl and N-ethylcarbamoyl), a sulfamoyl group (e.g., sulfamoyl and N-ethylsulfamoyl), an amino group, an alkylamino group (e.g., methylamino and dimethylamino), an acylamino group (e.g., acetylamido and benzoylamido), a sulfonamido group (e.g., methanesulfonamido), an imido group (e.g., succinimido), a ureido group (e.g., methylureido), a sulfamoylamino group (e.g., N-methylsulfamoylamino), a urethane group (e.g., methoxycarbonylamino), an alkoxy group (e.g., methoxy and ethoxy), an alkylthio group (e.g., methylthio and octylthio, hydroxyethylthio), an aryloxy group (e.g., phenoxy), an arylthio group (e.g., phenylthio), a heterocyclic thio group (e.g., benzothiazolylthio), and a heterocyclic oxy group (e.g., 1-phenyltetrazol-5-oxy).

In the compounds represented by formula (I), the sum total of carbon atoms thereof is preferably 20 or less, more preferably 15 or less, and most preferably 10 or less.

Also, the nitrogen-containing heteroaromatic ring formed by X is preferably a non-condensed single ring and more preferably a pyrazole ring and a triazole ring. In the case of a triazole ring, a 1,2,4-triazole ring is preferred.

These rings are preferably unsubstituted rings or rings substituted by an alkyl group, an alkenyl group, an alkoxy group, an alkylthio group, a halogen atom, or an amido group, and are particularly preferably unsubstituted rings.

Then, specific examples of the compound represented by formula (I) are illustrated below but the invention is not limited to them.

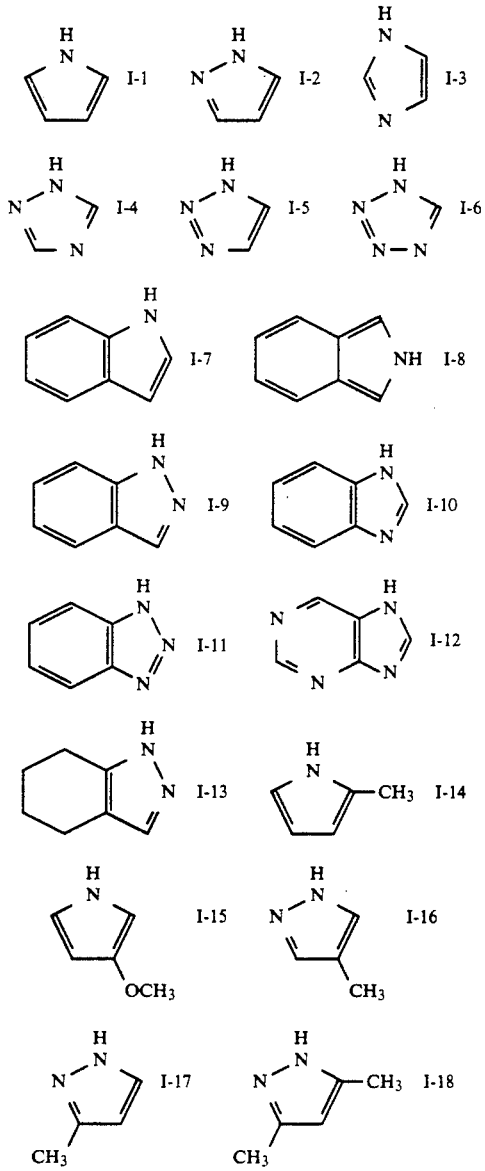

-continued
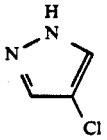
I-19
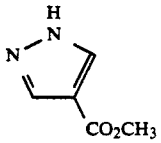
I-20
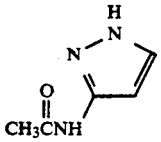
I-21
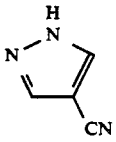
I-22
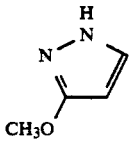
I-23
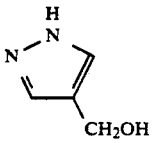
I-24
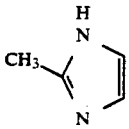
I-25
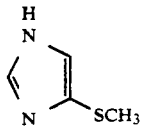
I-26
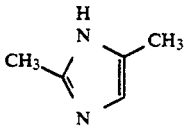
I-27
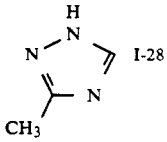
I-28
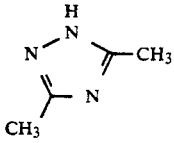
I-29
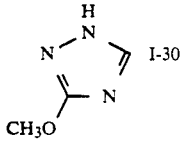
I-30
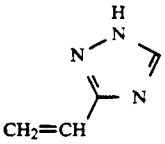
I-31
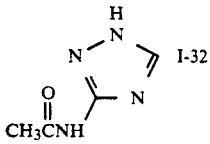
I-32
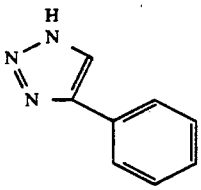
I-33
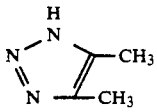
I-34
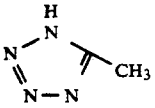
I-35
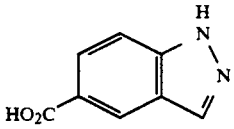
I-36
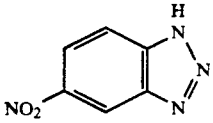
I-37
-continued
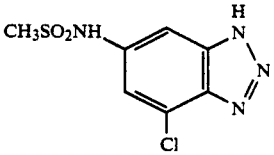
I-38
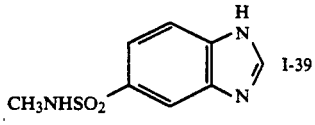
I-39
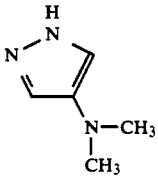
I-40
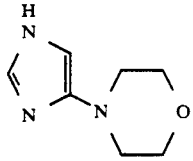
I-41
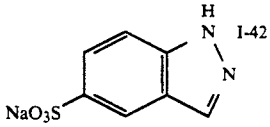
I-42
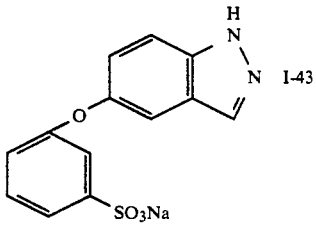
I-43
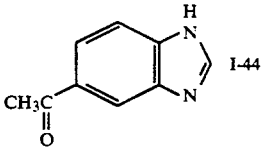
I-44
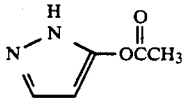
I-45
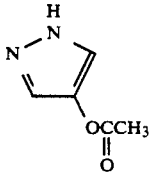
I-46
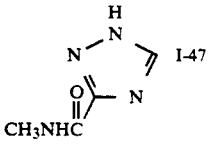
I-47

-continued

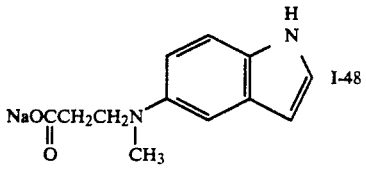

I-48

These compounds are easily commercially available. Among these, Compounds I-2 and I-4 are preferred.

In formula (A) described above, $X_0$ represents a non-metallic atomic group necessary for forming a nitrogen-containing heteroaromatic ring. Examples of the nitrogen-containing heteroaromatic ring formed by $X_0$ include those illustrated above as the examples of the nitrogen-containing heteroaromatic ring formed by X in formula (I).

These nitrogen-containing heteroaromatic rings each may have a substituent. Examples of the substituent include also those illustrated above as the examples of the substituent of the nitrogen-containing heteroaromatic ring formed by X.

In formula (A), $R_a$ and $R_b$, which may be the same or different, each represents an alkyl group (e.g., methyl, ethyl, n-propyl, butyl, cyclopropyl, hydroxyethyl, and methoxyethyl) or an alkenyl group (e.g., allyl). These groups may be substituted. Examples of the substituent include the substituents illustrated above as the substituent which may be substituted to the ring formed by X and further a hydroxy group and a trialkylsilyl group.

Also, $R_a$ and $R_b$ may be bonded each other to form a 4- to 8-membered ring. In the case of forming a 4- to 8-membered ring by bonding $R_a$ and $R_b$, the alkyl group(s) and/or the alkenyl group(s) of $R_a$ and $R_b$ may be directly bonded or may be bonded through an oxygen atom, a nitrogen atom, a sulfur atom, etc. Typical examples of such a ring include a pyrrolidine ring, a piperidine ring, a morpholine ring, a piperazine ring, a pyrroline ring, a pyrrole ring, an imidazole ring, an imidazoline ring, an imidazolidine ring, a 1,4-oxazine ring, a 1,4-thiazine ring, and an azetidine ring. These rings may be substituted by the substituent as illustrated above as the substituent of the group represented by $R_a$ and $R_b$.

In the compounds represented by formula (A), the nitrogen-containing heteroaromatic ring formed by $X_0$ is preferably a uncondensed single ring, and more preferably a pyrazole ring and a triazole ring. In the case of a triazole ring, a 1,2,4-triazole ring is preferred.

These nitrogen-containing heteroaromatic rings are preferably unsubstituted rings or the rings substituted by an alkyl group, an alkenyl group, an alkoxy group, an alkylthio group, a halogen atom, or an amido group, and particularly preferably unsubstituted rings.

On the other hand, $R_a$ and $R_b$ are preferably $R_a$ and $R_b$ of the secondary amine having an acid dissociation constant pKa of 8 or more [the value in water at room temperature (about 25° C.)] in the secondary amines represented by formula (II) corresponding to

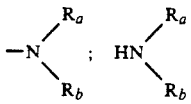

(II)

Then, specific examples of the compound represented by formula (II) and the pKa values thereof are illustrated below but the present invention is not limited to these compounds.

| | | pKa |
|---|---|---|
| II-1 | 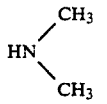 | 10.9 |
| II-2 | 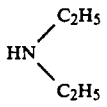 | 11.1 |
| II-3 | 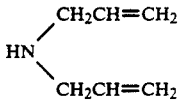 | 9.3 |
| II-4 | 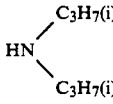 | 11.2 |
| 11-5 | 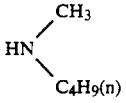 | 10.9 |
| II-6 | 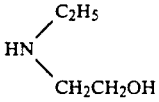 | 10.1 |
| II-7 | 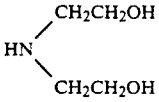 | 8.9 |
| II-8 | 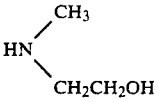 | 9.8 |
| II-9 | 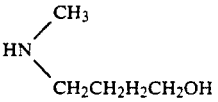 | 9.6 |
| II-10 | 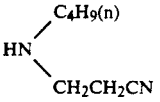 | 8.3 |
| II-11 | 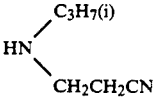 | 8.0 |
| II-12 | 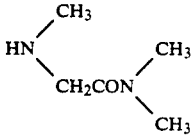 | 8.8 |
| II-13 | 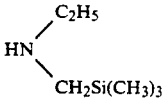 | 11.1 |

-continued

| | | pKa |
|---|---|---|
| II-14 | 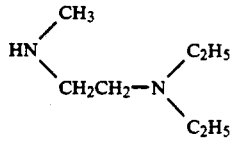 | 9.9 |
| II-15 | 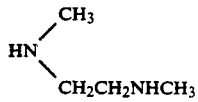 | 9.9 |
| II-16 | 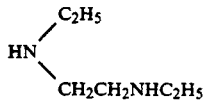 | 10.2 |
| II-17 | 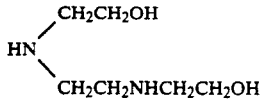 | 9.2 |
| II-18 | 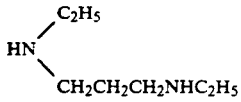 | 10.6 |
| II-19 | 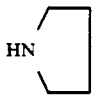 | 11.3 |
| II-20 | 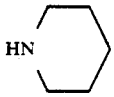 | 11.2 |
| II-21 | 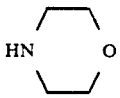 | 8.5 |
| II-22 | 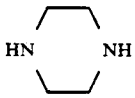 | 9.7 |
| II-23 | 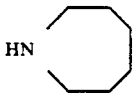 | 10.9 |

-continued

| | | pKa |
|---|---|---|
| II-24 | 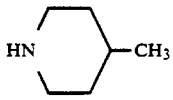 | 10.8 |
| II-25 | 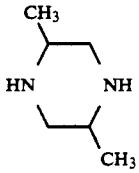 | 9.7 |
| II-26 | 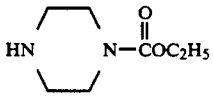 | 8.3 |
| II-27 | 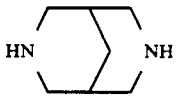 | 11.3 |

Among these, Compound II-22 is preferred.

In $R_a$ and $R_b$ in formula (A), a preferred case is that $R_a$ and $R_b$ are bonded each other to form a 5- or 6-membered ring and a more preferred case is that $R_a$ and $R_b$ are bonded each other to form a 5- or 6-membered saturated ring. In this case, it is particularly preferred that the ring formed is pyrrolidone, piperidine, morpholine, or piperazine and it is most preferred that the ring formed is piperazine.

In the compounds represented by formula (A) described above, the compounds which are excellent in the point of the effects of the present invention can be represented by formula (A-I);

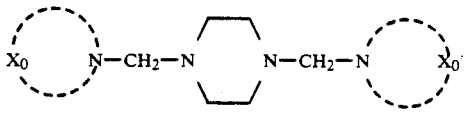

(A-I)

wherein $X_0$ and $X_0'$ have the same meaning as $X_0$ in formula (A), provided that $X_0$ and $X_0'$ may be the same or different.

The compound represented by formula (A) is preferably water soluble and the sum total of carbon atoms of the compound is preferably 30 or less, more preferably 20 or less, and particularly preferably 16 or less.

Then, specific examples of the compound shown by formula (A) are illustrated below but the invention is not limited to these compounds.

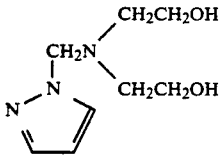

A-1

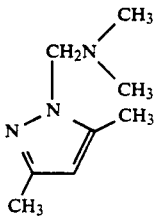

A-2

-continued
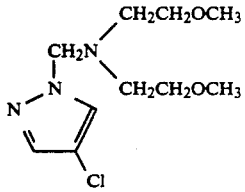
A-3
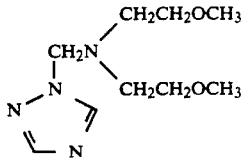
A-4
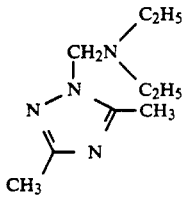
A-5
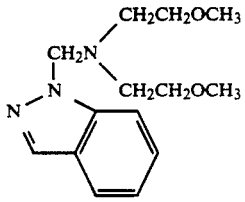
A-6
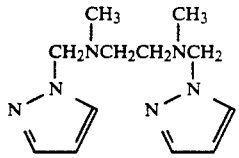
A-7
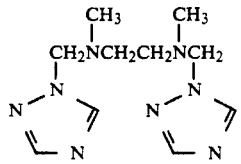
A-8
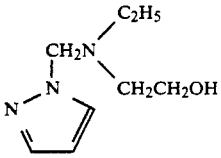
A-9
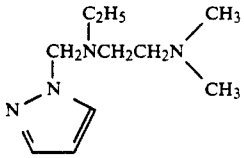
A-10
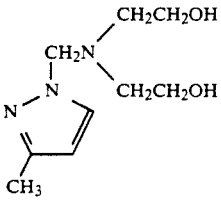
A-11
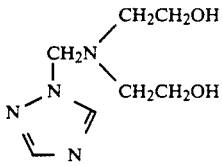
A-12
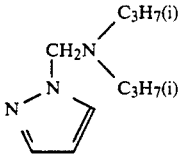
A-13
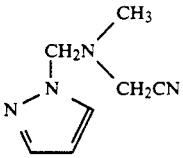
A-14
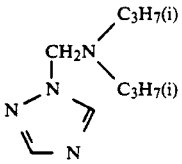
A-15
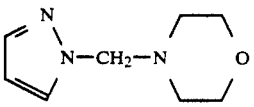
A-16
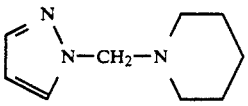
A-17
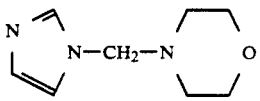
A-18
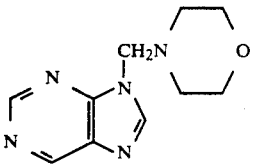
A-19
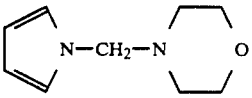
A-20

-continued
A-21
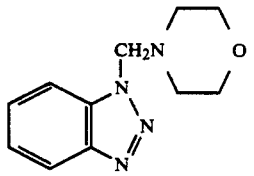
A-22
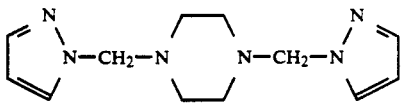
A-23
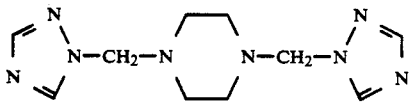
A-24
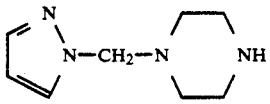
A-25
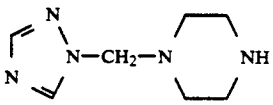
A-26
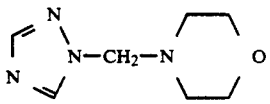
A-27
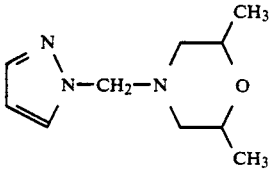
A-28
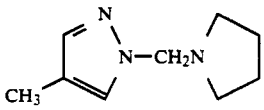
A-29
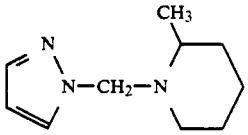
A-30
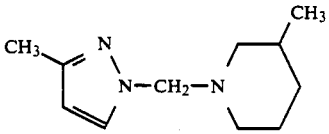
A-31
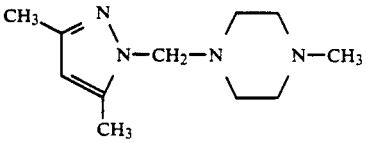
A-32
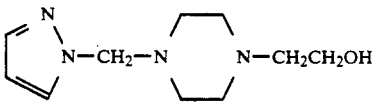
A-33
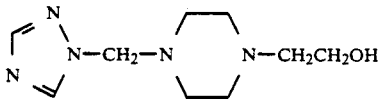
A-34
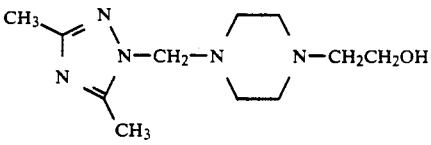
A-35
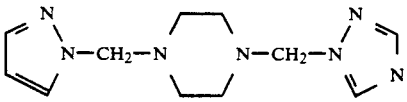
A-36
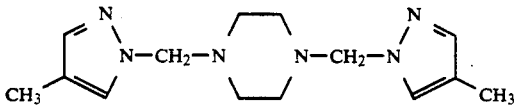
A-37
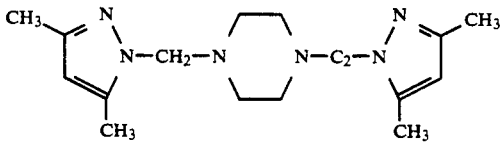
A-38
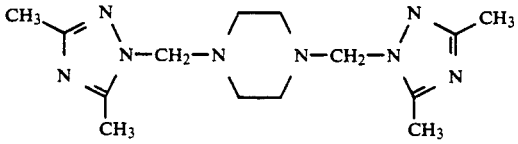

-continued
A-39
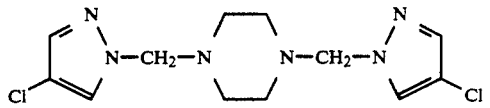
A-40
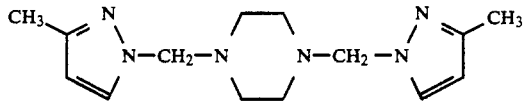
A-41
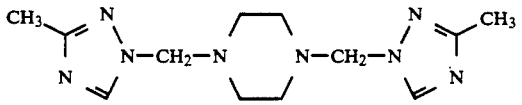
A-42
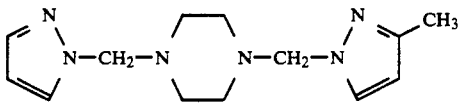
A-43
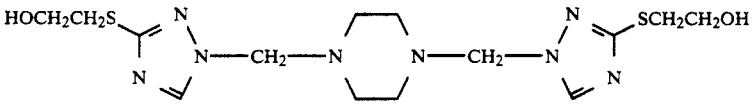
A-44
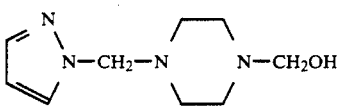
A-45
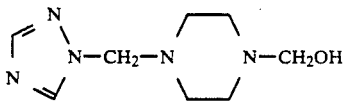
A-46
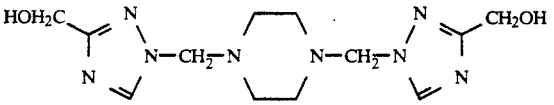
A-47
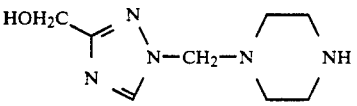
A-48
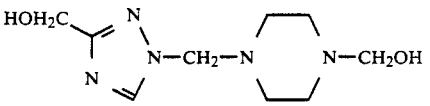
A-49
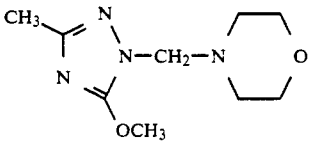
A-50
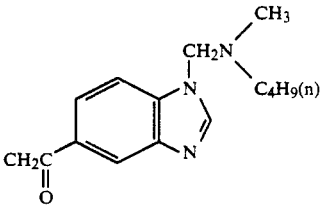
A-51
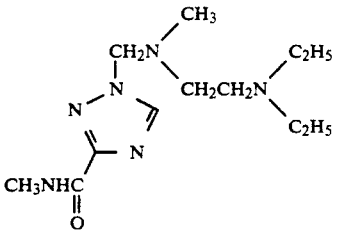
A-52
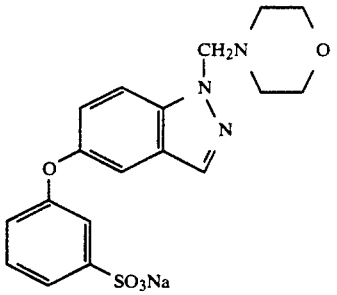
A-53
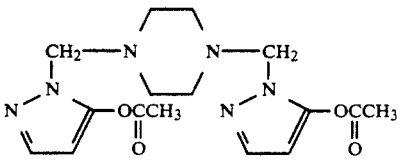
A-54
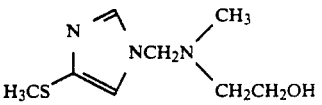

-continued
A-55
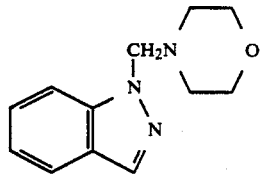
A-56
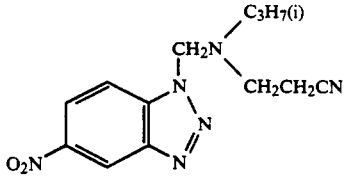
A-57
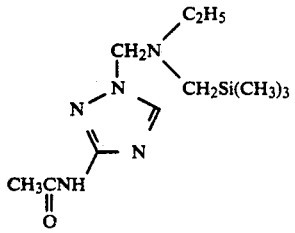
A-58
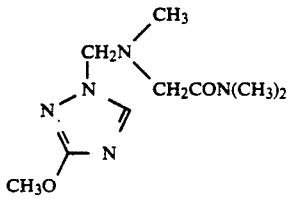
A-59
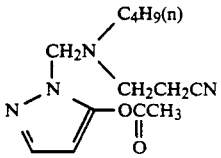
A-60
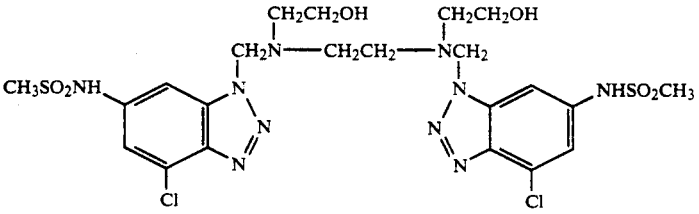
A-61
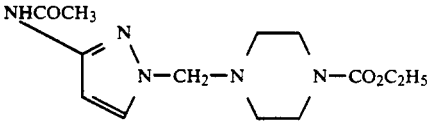
A-62
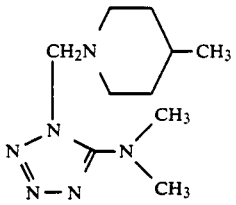
A-63
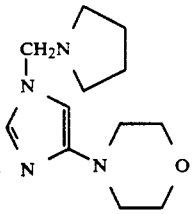
A-64
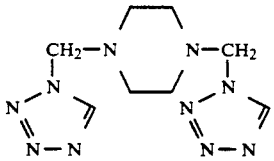
A-65
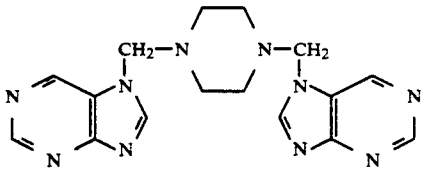
A-66
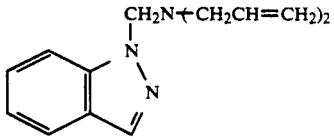
A-67
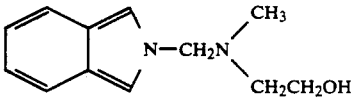
A-68
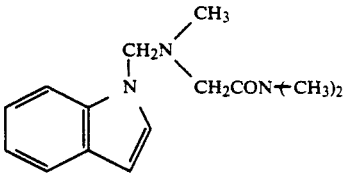

-continued

A-69

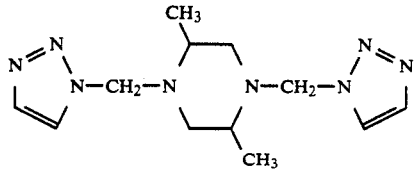

A-70

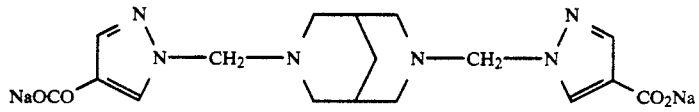

A-71

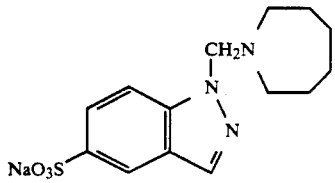

A-72

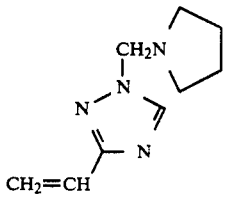

A-73

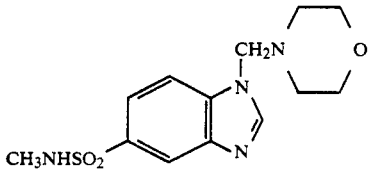

A-74

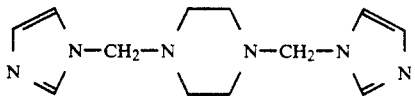

A-75

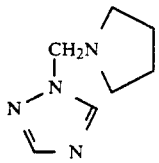

A-76

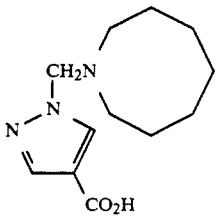

Among these, Compounds A-22 and A-23 are preferred.

The compounds represented by formula (A) which can be used in the present invention can be synthesized by the methods described in *Journal of the Organic Chemistry*, Vol. 35, page 883 (1970) and *Chem. Ber.*, Vol. 85, page 820 (1952) or methods similar to these methods.

Then, typical synthesis examples of the compounds represented by formula (A) are shown below:

SYNTHESIS EXAMPLE 1 (COMPOUND A-22)

In a 500 ml three-neck flask equipped with a stirrer, a thermometer, and a condenser were placed 68 g of pyrazole and 80 ml of methanol. The mixture was heated to 50° C. while stirring. To this mixture was added, dropwise, a mixture of 31.6 g of 95% paraformaldehyde, 0.67 g of methanol containing 28% $NaOCH_3$, and 70 ml of methanol. The resultant mixture was stirred for one hour at 50° C., and then cooled with water. The mixture was stirred for one hour after adding 97.1 g of piperazine hexahydrate to the mixture little by little. The reaction mixture formed was filtrated, the filtrate was concentrated under reduced pressure. The concentrate thus obtained was crystallized with a mixed solvent of 300 ml of acetic acid ethyl ester and 50 ml of n-hexane to provide 100 g of compound (A-22) as colorless crystals having a melting point of from about 109° C. to 112° C. Elemental analysis and various spectra confirmed the chemical structure of the compound.

SYNTHESIS EXAMPLE 2 (COMPOUND A-23)

In a 500 ml three-neck flask equipped with a stirrer, a thermometer, and a condenser were placed 69.1 g of 1,2,4 triazole and 170 ml of methanol. The mixture was heated to 50° C. while stirring. To this mixture was added, dropwise, a mixture of 31.6 g of 95% paraformaldehyde, 0.67 g of methanol containing 28% $NaOCH_3$, and 67 ml of methanol. The resultant mixture was heated to 50° C. for one hour and then cooled with water. The mixture was stirred for about one hour after adding thereto 97.1 g of piperazine hexahydrate little by little. Crystals formed during the reaction. After the reaction was over, the reaction mixture was cooled with water. Resulting crystals were collected by filtration and washed with cooled methanol to provide 103 g of compound (A-23) as colorless crystals having a melting point of from about 205° C. to 209° C. Elemental analysis and various spectra confirmed the chemical structure of the compound.

Other compounds shown by formula (A) can be also synthesized by the similar manners to above.

As the result of the present inventor's investigation, it has been found that the compound represented by formula (A) is reacted with a coupler before the compound represented by formula (A) is reacted with formaldehyde. This is based on a partial structure

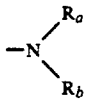

of the compound represented by formula (A).

In case of almost well-known N-methylol compounds, formaldehyde released from the N-methylol compounds is reacted with a coupler. On the other hand, it is considered that the compound represented by formula (A) of the present invention is reacted with a coupler in the reaction scheme shown below. That is, it is assumed that the active site of reaction which reacts with the coupler is not formaldehyde, but is an iminium ion.

Reaction of Compound (A) and Coupler

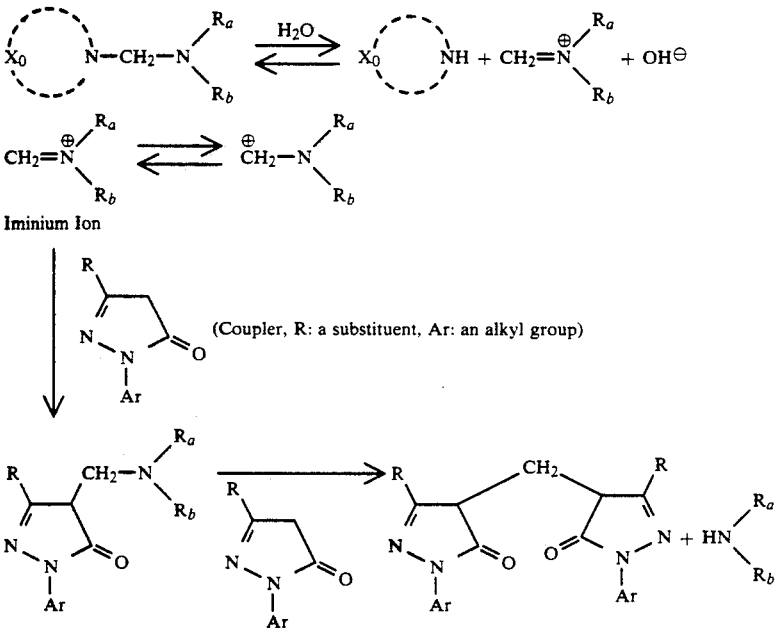

Also, the compound represented by formula (I) of the present invention has a function preventing the formation of formaldehyde released from the iminium ion. Accordingly, it is possible to extremely reduce an amount of formaldehyde gas released into a gas phase which is generated by the combination use of the compounds represented by formulae (A) and (I).

The content of the compound represented by formula (A) in the processing solution of the present invention is preferably from $1.0\times10^{-4}$ to 0.5 mol, more preferably from 0.001 to 0.1 mol, and most preferably from 0.001 to 0.03 mol per liter of the processing solution.

The content of the compound represented by formula (I) is preferably from 0.01 to 100 mols, more preferably from 0.1 to 20 mols, and most preferably from 1 to 10 mols per mol of the compound represented by formula (A).

The compound represented by formula (A) which can be used in the present invention is, sometimes, partially hydrolyzed in an aqueous solution. The processing solution of the present invention may contain the hydrolyzate of the compound represented by formula (A) and further the condensate thereof. Examples of such compounds include:

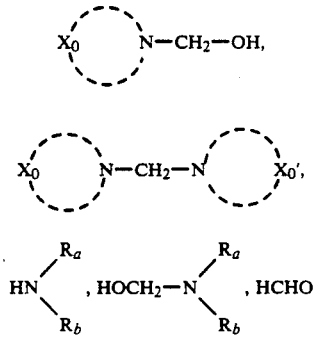

In the above formulae, $X_0$, $R_a$, and $R_b$ have the same meaning as defined above in formula (A) and $X_0'$ is same as $X_0$.

In the present invention, preferred compounds represented by formula (A-I) are as follows:

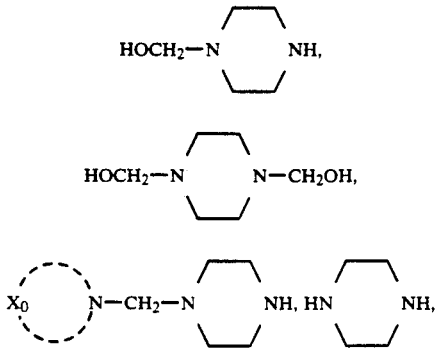

-continued

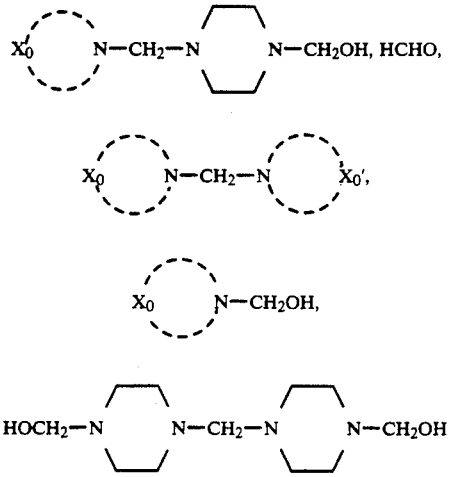

In the above formula, $X_0$ and $X_0'$ have the same meaning as defined in formula (A-I).

Incorporation of the compound represented by formula (I) and the compound represented by formula (A) into the processing solution of the present invention can be achieved by adding the compound represented by formula (I) and the compound represented by formula (A) into the processing solution, and further can be also achieved by the following manners.

(1) The compound of formula (A) and the compound of formula (I) are incorporated in the processing solution by adding a formaldehyde, formalin, or a formaldehyde derivative such as para-formaldehyde, etc., the compound of formula (I), and the compound of formula to the processing solution to form the compound of formula (A) in the processing solution and by adding an excessive amount of compound of formula (I) to the processing solution.

(2) An N-methylol compound represented by formula (I), the compound of formula (II), and the compound of formula (I) are added to the processing solution, whereby the compound of formula (A) and the compound of formula (I) exist in the processing solution. In this case, the N-methylol compound of the compound represented by formula (I) reacts with the compound represented by formula (II) to form the compound of formula (A).

(3) An N-methylol compound of the compound represented by formula (II) and the compound represented by formula (I) in an amount of more than the equimolar amount of the N-methylol compound are added to the processing solution, whereby the compound of formula (A) and the compound of formula (I) exist in the processing solution.

(4) The compound of formula (A) and the compound of formula (I) once obtained in the state of the aqueous solution thereof by the above method (1) to (3) are added to the processing solution.

In the present invention, any method described above may be employed.

In these methods, the method (1) is useful and preferable since the method (1) is most simple and the production cost thereof is low.

In the above reaction, when the amount of the compound represented by formula (II) is one equivalent amount as a secondary amine (having one secondary amine in one molecule), each mol of formaldehyde, the compound represented by formula (I) and the compound represented by formula (II) are reacted each other to form the compound represented by formula (A).

For example, in the above method (1), when compound II-21 is used as the compound represented by formula (II) and compound I-4 is used as the compound represented by formula (I), 1 mol of formaldehyde, 1 mol of compound II-2, and 1 mol of compound I-4 are reacted each other to form 1 mol of compound A-26.

In this case, for obtaining the embodiment of the present invention, the compound represented by formula (I) may be added in an excessive amount (1.01 mol times to 100 mol times) to the amount of at least formaldehyde. Also, it is preferred that the compound represented by formula (II) is added in an excessive amount to the amount of formaldehyde and hence, it is preferred that the compound represented by formula (I) is added in an excessive amount to the amount of the compound represented by formula (II).

The case that formaldehyde previously reacts with the compound of formula (I) or the compound of formula (II) to form N-methylol compound is the above methods (2) and (3) and in this case, it is also necessary to added the compound of formula (I) in an excessive amount.

Also, when the compound of formula (II) has two secondary amines in one molecule, that is when the compound of formula (II) is two-equivalent, the mol number of the compound of formula (II) may be a half of the case that the compound of formula (II) is one-equivalent. For example, when Compound II-22 is used, by the reaction of 2 mols of formaldehyde, 1 mol of Compound II-22, and 2 mols of Compound I-4, 1 mol of Compound A-35 is formed. Therefore, for obtaining the embodiment of the present invention, the amount of the compound of formula (I) may be added in excessive (1.01 mol times to 100 mol times) to at least formaldehyde. Also, it is preferred that the compound represented by formula (II) is added in an amount of at least ½ mol to formaldehyde and therefore the compound represented by formula (I) may be added in an amount of from 2.02 mol times to 200 mol times to the compound represented by formula (II).

The compound for use in this invention may be used for any step in the processing steps of color photographic materials.

The processing solution of the present invention is a processing solution (including the replenisher for the processing solution) having the effect for stabilizing the dye images formed by color development (in particular, the effect of preventing a magenta dye from fading with the passage of time), by containing the compound of the present invention. That is, the processing solution of the present invention is an aqueous photographic processing solution. Accordingly, the processing solution of the present invention is a processing solution for use after color development: namely, a bleaching solution, a bleach-fixing solution (blixing solution), a fixing solution, a stopping solution, a conditioning solution, a washing solution, a rinsing solution, or a stabilizing solution, preferably a stabilizing solution, a stopping solution, a conditioning solution, or a bleaching solution, more preferably a stabilizing solution, a conditioning solution or a bleaching solution and most preferably a stabilizing solution.

The compounds for use in this invention may be added to the replenisher for each processing solution that is a preferred embodiment of this invention. Thus, the processing solution of the present invention includes a replenisher. The replenisher in the present invention is a solution for replenishing a fresh processing solution used for keeping the original composition of a processing solution at continuous photographic processing.

Each replenisher of this invention is prepared to sustain the performance of each processing solution by maintaining a constant concentration of active compounds through replenishment of these compounds consumed during processing of color photographic materials and degraded in an automatic processor with the passage of time, while controlling the concentration of compounds dissolved out from color photographic materials by processing. Accordingly, the concentration of these compounds which are consumed is kept higher in the replenisher than the corresponding processing solution. Conversely, the concentration of compounds eluted from the photographic materials is kept lower in the replenisher than in the processing solution. About the same concentration as in the ordinary processing solution is used in the corresponding replenisher for those compounds which do not tend to change concentration by processing or with the passage of time.

The processing solutions to which the discovered compound can be added as well as other processing solutions used in conjunction are described next. Since the processing solution containing the discovered compound alone does not have a stabilization effect of color images, it is technically improper to call such this processing solution a stabilizing solution. But for convenience, such a processing solution will also be called a stabilizing solution.

First, a stabilizing solution and a conditioning solution are the preferred processing solution for containing the compound of the present invention.

The stabilizing solution in the present invention is a stabilizing solution used for the final processing step of a color negative photographic film and a color reversal photographic film or a stabilizing solution used in place of water-washing solution in a washing step as the final processing step. When the final processing step is a washing step or a rinsing step, a stabilizing solution used for the stabilizing step as the pre-bath for the step or the rinsing step is also another in the processing solution of the present invention. The stabilizing solution containing the compound for use in this invention is preferably used during the final step.

It is preferable that the stabilizing solution contains various surface active agents for preventing water spots during the drying of color photographic materials. Appropriate surface active agents include: polyethylene glycol type nonionic surface active agents, polyglycerol type nonionic surface active agents, polyhydric alcohol type nonionic surface active agents, alkylbenzenesulfonate type anionic surface active agents, higher alcohol sulfate type anionic surface active agents, alkylnaphthalenesulfonate type anionic surface active agents, quaternary ammonium salt type cationic surface active agents, amine salt type cationic surface active agents, amino salt type amphoteric surface active agents, and betaine type amphoteric surface active agents. Nonionic surface active agents are preferred, and alkylphenol ethylene oxide addition products are particularly preferred. The desired alkylphenol includes: octylphenol, nonylphenol, dodecylphenol, and dinonylphenol. The addition mol number of ethylene oxide is particularly preferably from 8 to 14. Furthermore, silicone series surface active agents having a high defoaming effect is preferred.

The most preferable surface active agents are shown below.

W'-1

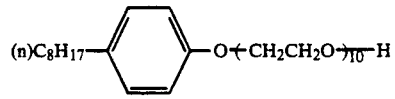

W'-2

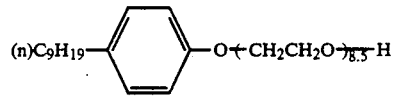

W'-3

W'-4

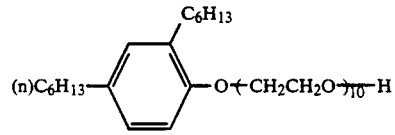

W'-5

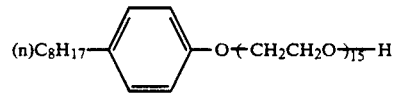

W'-6

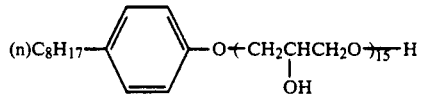

W'-7

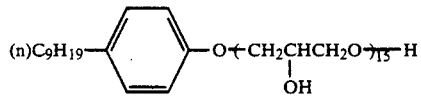

W'-8

W'-9

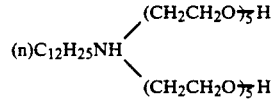

W'-10

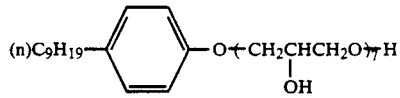

The amount of the surface active agents used is preferably from 0.005 to 3.0 g and more preferably from 0.02 to 0.5 g, per liter of the stabilizing solution or replenisher for the stabilizing solution.

Further, in order to prevent formation of foam in preparation of a concentrated processing solution kit or in preparation of a stabilizing solution or a replenisher thereof, a lower alcohol such as methanol or ethanol can be preferably added. The lower alcohol has preferably from 1 to 3 carbon atoms. The amount of the lower alcohol used is preferably from 0.001 to 5.0 ml and more preferably from 0.01 to 1.0 ml, per liter of the stabilizing solution or replenisher for the stabilizing solution.

The concentrated replenisher for the stabilizing solution can be used in order to provide the replenisher for the stabilizing solution of the present invention. The concentrated stabilizing solution used in the present invention can be used in a concentration of 10 to 300 times that of the replenisher for the stabilizing solution. Also, plurality of the concentrated stabilizing solution which has previously divided may be mixed to obtain the concentrated composition and then the concentrated composition may be diluted to use as the replenisher for the stabilizing solution. The concentration of the concentrated stabilizing solution is preferably from 15 to 200 times and more preferably from 20 to 100 times that of the stabilizing solution.

Also, it is preferred that the stabilizing solution contains various antibacterial agents or antifungal agents to prevent the formation of fur and fungi in the color photographic materials. Examples of these antibacterial agents and antifungal agents include the thiazolylbenzimidazole series compounds as described in JP-A-57-157244 and JP-A-58-105145, the isothiazolone series compounds described in JP-A-57-8542, chlorophenol series compounds such as trichlorophenol, etc., bromophenol series compounds, organotin compounds, organozinc compounds, acid amide series compounds, diazine and triazine series compounds, thiourea compounds, benzotriazole series compounds, alkylguanidine series compounds (e.g., 1-1-iminodi(octamethylene)diguanidiumtriacetate, polyhexamethylenebiguanidinehydrochloric acid salt), quaternary ammonium salts such as benzalkonium chloride, etc., antibiotics such as penicillin, etc., and the antifungal agents described in *Journal of Antibacterial and Antifungal Agents,* Vol. 1, No. 5, 207–223 (1983).

These compounds may be used singly or in combination. Also, the various bactericides described in JP-A-48-83820 can be used.

Also, it is preferred that the stabilizing solution contains various chelating agents. As preferred chelating agents, aminopolycarboxylic acids such as ethylenediaminetetraacetic acid, diethylenetriaminepentaacetic acid, etc; organic phosphonic acids such as 1-hydroxyethylidene-1,1-diphosphonic acid, diethylenetriamine-N,N,N',N'-tetramethylenephosphonic acid, etc.; and the hydrolized products of maleic anhydride polymers described in European Patent 345,172A1.

Also, for the stabilizing solution, other compounds for stabilizing dye images than the compounds for use in this invention such as, for example, hexamethylenetetramine and the derivatives thereof, hexahydrotriazine and the derivatives thereof, dimethylolurea, organic acids, and pH buffers may be used single or in combination. Furthermore, it is preferred that the stabilizing solution of this invention contains, if desired; an ammonium compound such as ammonium chloride, ammonium sulfite, etc.; a metal compound such as a Bi compound, an Al compound, etc.; an brightening agent, a hardener, and a preservative which can be used for a fixing solution or a blixing solution described below.

In these compounds, the sulfinic acid compounds (e.g., benzenesulfinic acid, toluenesulfinic acid, and the salts thereof of sodium, potassium, etc.) described in JP-A-1-231051 are preferred. The amount of the above compound added is preferably from $1\times10^{-5}$ to $1\times10^{3}$ mol, and more preferably from $3\times10^{-5}$ to $5\times10^{-4}$ mol per liter of the stabilizing solution. Also, it is preferred that the alkanolamine described in U.S. Pat. No. 4,786,583 (e.g., triethanolamine) is added in an amount of from 0.001 to 0.05 mol/l and particularly from 0.005 to 0.02 mol/l in view of prevention of sulfurization.

The stabilizing solution of the present invention is used in the range of usually from 4 to 10, preferably from 6 to 9, more preferably from 6.8 to 8.0 and most preferably from 7.0 to 7.8. The replenishment amount (rate) for the stabilizing solution is preferably from 200 to 1500 ml, and more preferably from 300 to 600 ml. The processing temperature of the stabilizing solution is preferably form 30° C. to 45° C. Also, the effect of the present invention becomes remarkable when the processing time is short, that is, the processing time is preferably from 10 seconds to 2 minutes, more preferably from 10 seconds to 60 seconds and most preferably from 10 seconds to 25 seconds. Furthermore, when the processing time is from 10 seconds to 25 seconds, the effect of the present invention becomes most remarkable and in the present invention, short-time processing can be carried out without deteriorating the image storage stability.

The conditioning solution is a processing solution which is sometimes called a bleach accelerating solution.

The conditioning solution of this invention can further contain an aminopolycarboxylic acid chelating agent such as ethylenediaminetetraacetic acid, diethylenetriaminepentaacetic acid, 1,3-diaminopropanetetraacetic acid, cyclohexanediaminetetraacetic acid, etc.; a sulfite such as sodium sulfite, ammonium sulfite, etc,; and a bleaching accelerator such as thioglycol, aminoethanethiol, sulfoethanethiol, etc. (These additives will be explained during discussion of the bleaching solution.) It is preferred that the conditioning solution contains the sorbitan esters of fatty acid substituted by ethylene oxide described in U.S. Pat. No. 4,839,262 and the polyoxyethylene compounds described in U.S. Pat. No. 4,059,446 and *Research Disclosure,* Vol. 191, 19104 (1980). These compounds can be used in the range of from 0.1 g to 20 g, and preferably from 1 g to 5 g per liter of the conditioning solution.

The pH of the conditioning solution is usually in the range of from 3 to 11, preferably from 4 to 9, and more preferably from 4.5 to 7.

The processing time of the conditioning solution is generally from 20 seconds to 5 minutes, preferably from 20 seconds to 3 minutes, more preferably from 20 seconds to 100 seconds and most preferably from 20 seconds to 60 seconds.

Also, the replenishment amount for the conditioning solution is preferably from 30 ml to 3000 ml, and more preferably from 50 ml to 1500 ml per square meter of a color photographic material being processed.

The processing temperature of the conditioning solution is preferably from 20° C. to 50° C., and more preferably from 30° C. to 40° C.

A silver halide color photographic material, a negative type color photographic material and a direct positive type color photographic material are usually subjected to a color development after imagewise exposure. A reversal positive type color photographic material is usually subjected to a color development after being subjected to a black and white development, reversal processing, etc.

The color developer to be used in this invention is a alkaline aqueous solution containing an aromatic primary amine color developing agent as its main component.

A preferred color developing agent is a p-phenylenediamine derivative and typical examples are shown below, but the invention is not limited to them.

D-1 N,N-Diethyl-p-phenylenediamine

D-2 2-Methyl-N,N-diethyl-p-phenylenediamine

D-3 4-[N-Ethyl-N-(β-hydroxyethyl)amino]aniline

D-4 2-Methyl-4-[N-ethyl-N-(β-hydroxyethyl-)amino]aniline

D-5 4-Amino-3-methyl-N-ethyl-N-[β-(methanesulfonamido)ethyl]aniline

D-6 4-Amino-3-methyl-N-ethyl-N-methoxyethylaniline

D-7 4-Amino-3-methyl-N-ethyl-N-(4-hydroxybutyl-)aniline

Of the above p-phenylenediamine derivatives, D-4 and D-5 are particularly preferred.

These p-phenylenediamine derivatives may be in the form of the salts, such as: the sulfates, hydrochlorides, sulfites, p-toluenesulfonates, etc.

The amount of the aromatic primary amine color developing agent is preferably from 0.001 to 0.1 mol, and more preferably from 0.01 to 0.06 mol per liter of the color developer.

Also, the color developer can contain a sulfite, if desired, a sulfite such as sodium sulfite, potassium sulfite, sodium hydrogensulfite, potassium hydrogensulfite, sodium metasulfite, potassium metasulfite, etc., or a carbonylsulfite addition product. The preferred addition amount of the preservative is from 0.5 to 10 g, and particularly from 1 to 5 g per liter of the color developer.

As compound can be added preserve the previously discussed aromatic primary amine color developing agent. Examples include: various hydroxylamines (preferably, the compounds having a sulfo group or carboxy group) described in JP-A-63-5341 and JP-A-63-106655; the hydroxamic acids described in JP-A-63-43138; the hydrazines and hydrazides described in JP-A 63-146041; the phenols described in JP-A-63-44657 and JP-A-63-58443; the α-hydroxyketones and α-aminoketones described in JP-A-63-44656; and various kinds of the sucrose described in JP-A-63-36244.

Additionally, these preservative compounds can be used in combination with: the monoamines described in JP-A-63-4235, JP-A-63-24254, JP-A-63-21647, JP-A-63-146040, JP-A-63-27841, and JP-A-63-25654; the diamines described in JP-A-63-30845, JP A-63-14640, and JP-A-63-43139; the polyamines described in JP-A-63-21647, JP-A-63-26655, and JP-A-63-44655: the nitroxy radicals described in JP-A-63-53551; the alcohols described in JP-A-63-43140 and JP-A-63-53549; the oximes described, in JP-A-63-56654, and the tertiary amines described in JP-A-63-239447.

The color developer may also contain other preservatives. Examples include: the various metals described in JP-A-57-44-44148 and JP-A-57-53749; the salicylic acids described in JP-A-59-180588; the alkanolamines described in JP-A-54-3582; the polyethyleneimines described in JP-A-56-94349; the aromatic polyhydroxy compounds described in U.S. Pat. No. 3,746,544, etc. Of these compounds, the aromatic polyhydroxy compounds are particularly preferred.

The pH of the color developer being used in this invention is preferably from 9 to 12, and more preferably from 9 to 11.0. To maintain the pH within these parameters, it is preferable to use various buffers.

Practical examples of buffers include: sodium carbonate, potassium carbonate, sodium hydrogencarbonate, potassium hydrogencarbonate, sodium tertiary phosphate, potassium tertiary phosphate, sodium secondary phosphate, potassium secondary phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate).

The addition amount of the buffer is preferably not less than 0.1 mol, and particularly preferably from 0.1 to 0.4 mol per liter of the color developer.

It is preferred that the color developer contains various kinds of chelating agents to inhibit a precipitation of calcium and magnesium or to further improve the stability of the color developer. As the chelating agent, organic acid compounds are preferable examples include aminopolycarboxylic acids, organic sulfonic acids, and phosphonocarboxylic acids.

Typical examples of these organic acid compounds include diethylenetriaminepentaacetic acid, ethylenediaminetetraacetic acid, N,N,N-trimethylenephosphonic acid, ethylenediamine-N,N,N',N'-tetramethylenephosphonic acid, transcyclohexanediaminetetraacetic acid, 1,2-diaminopropanetetraacetic acid, hydroxyethyliminodiacetic acid, glycol ether diaminetetraacetic acid, ethylenediamine o-hydroxyphenylacetic acid, 2-phosphonobutane-1,2,4-tricarboxylic acid, 1-hydroxyethylidene-1,1-diphosphonic acid, and N,N'-bis(2-hydroxybenzyl)ethylenediamine-N,N'-diacetic acid.

Chelating agents may be used single or in combination. A typical amount of the chelating agent required to block metal ions in the color developer and is about 0.1 g to 10 g per liter of the color developer.

If desired, an optional developing accelerator can be added to the color developer. It is preferred, however, that the color developer in this invention contains substantially no benzyl alcohol. Benzyl alcohol pollutes the environment, worsens the preparing property of the solution, and promotes color stains. In this case, the term "contains substantially no benzyl alcohol" means that the color developer contains not more than 2 ml of benzyl alcohol per liter of the color developer and preferably contains no benzyl alcohol.

Examples of the developing accelerator which can be added, if desired, to the color developer include the thioether compounds described in JP-B-37-16088, JP-B-37-5987, JP-B-38-7826, JP-B-44-12380, JP-B-45-9019 (the term "JP-B" as used herein means an "examined Japanese patent publication"), and U.S. Pat. No. 3,818,247; the p-phenylenediamine series compounds described in JP-A-52-49829 and JP-A-50-15554; the quaternary ammonium salts described in JP-A-50-137726, JP-B-44-30074, JP-A-56- 156826, and JP-A-52-43429; the amine series compounds described in U.S. Pat. Nos. 2,494,903, 3,128,182, 4,230,796, and 3,253,919, JP-B-41-11431, U.S. Pat. Nos. 2,484,546, 2,596,926, and 3,582,346; the polyalkylene oxides described in JP-B-37-16088, JP-B-42-25201, U.S. Pat. No. 3,128,183, JP-B-41-11431, JP-B-42-23883, and U.S. Pat. No. 3,532,510; as well as 1-phenyl-3-pyrazolideones, and imidazoles.

The addition amount of the development accelerator is from about 0.01 g to 5 g per liter of the color developer.

In this invention, the color developer can contain, if desired, an optional antifoggant.

Examples of the antifoggants include alkali metal halides, such as sodium chloride, potassium bromide, potassium iodide, etc. and organic antifoggants. Examples of the organic antifoggant include nitrogen-containing heterocyclic compounds such as benzotriazole, 6-nitrobenzimidazole, 5-nitroisoindazole, 5-methylbenzotriazole, 5-nitrobenzimidazole, 5-chlorobenzotriazole, 2-thiazolyl-benzimidazole, 2-thiazolylmethylbenzimidazole, indazole, hydroxyazaindolizine, and adenine.

The addition amount of the antifoggant is from about 0.001 g to 1 g per liter of the color developer.

The color developer of this invention may further contain an optical brightening agent. The preferred optical brightening agents are 4,4'-diamino-2,2'-disulfostilbene series compounds. The addition amount of the optical brightening agent to be added is preferably from 0 to 5 g, and more preferably from 0.1 g to 4 g per liter of the color developer.

If necessary, the color developer may also contain various surface active agents including: alkylsulfonic acids, arylsulfonic acids, aliphatic carboxylic acids, aromatic carboxylic acids, etc.

The replenisher for the color developer contains these compounds found in the color developer. One function of the replenisher for the color developer is to replenish the compounds which are consumed during processing of color photographic materials or by the deterioration in an automatic processor with the passage of time. Another function is to maintain a constant rate of development by controlling the concentration of the compounds released from the color photographic materials during processing. Accordingly, the concentrations of consumed compounds are higher in the replenisher than in the tank solution of the color developer. Conversely the concentration of released compounds is lower in the replenisher than in the tank solution.

The consumed compounds include a color developing agent and a preservative. The replenisher contains them in a ratio of from 1.1 to 2 times those in the tank solution. Also, the released compound is a development inhibitor such as a halide (e.g., potassium bromide); the replenisher contains it in a ratio of from 0 to 0.6 times that in the tank solution. The concentration of a halide in the replenisher for the color developer is usually not more than 0.006 mol/liter, if containing any at all.

Some, compounds virtually maintain their concentration despite processing and/or the passage of time the replenisher has almost same concentrations of these condition as those in the tank solution of the color developer. Examples of such compounds are chelating agents and buffers.

Furthermore, the pH of the replenisher for the color developer is higher by about 0.05 to 0.5 than that of the tank solution to maintain the pH in the tank solution during processing. The degree increased in pH of the replenisher is required to increase with the reduction of the replenishment amount. The replenishing amount for the color developer is preferably not more than 3000 ml, more preferably from 100 ml to 1500 ml, most preferably from 100 ml to 600 ml, per square meter of a color photographic material being processed.

The proper processing temperature of the color developer is generally from 20° to 50° C., and preferably form 30° to 45° C. The processing time is properly from 20 seconds to 5 minutes, preferably from 30 seconds to 3 minutes and 20 seconds, and more preferably from 1 minute to 2 minutes and 30 seconds.

Also, if desired, the color development can be carried out using two or more baths. Its replenisher may be added during the first bath or the later baths. This shortens the developing time and further decreases the replenishing amount.

The processing method of the present invention is preferably used for color reversal photographic processing. In the color reversal process, a color development is carried out after black and white development and, if desired, applying reversal processing. The black and white developer, is usually called the black and white 1st developer, is used for the reversal process of a color photographic light-sensitive material and can contain various kinds of additives which are used for a black and white developer for processing a black and white silver halide photographic materials.

Typical additives include: a developing agent such as 1-phenyl-3-pyrazolidone, Metol, hydroquinone, etc.; a preservative such as a sulfite, etc.; an accelerator such as sodium hydroxide, sodium carbonate, potassium carbonate, etc.; an inorganic or organic inhibitor such as potassium bromide, 2-methylbenzimidazole, methylbenzothiazole, etc.; a water softener such as a polyphosphate, etc.; and a development inhibitor such as a slight amount of iodide, a mercapto compound etc.

An automatic processor using either black and white developer or color developer should have a small opening area. In other words, the contact area (opening area) of the developer (the black and white developer or color developer) exposed to air should be as small as possible. The opening ratio defined the opening area ($cm^2$) divided by the volume ($cm^3$) of the developer is preferably 0.01 $cm^{-1}$ or less, and more preferably 0.005 $cm^{-1}$ or less.

The developer can be regenerated for reuse. Regeneration of the used developer occurs through treatment with an anion exchange resin, electrodialysis, or addition of processing chemicals called regenerating agents. The old developer is activated and used again as fresh developer.

In this case, the generating ratio (the ratio of the overflow solution to the replenisher) is preferably 50% or more, and particularly preferably 70% or more.

In the regeneration of a developer, the overflow solution of the developer is, after regeneration, used as a replenisher for the developer.

As a method for the regeneration, it is preferred to us an anion exchange resin. Particularly preferred compositions of anion exchange resins and regenerating method for the anion exchange resins are described in *Diaion Manual (I)*, (14th edition, 1986), published by Mitsubishi Chemical Industry Co., Ltd. Also, in anion exchange resins, the resins having the compositions described in JP-A-2-952 and JP-A-1-281152.

In the present invention, the color developed photographic material is subjected to a desilvering process. The desilvering process is consists of a bleaching process and a fixing process carried out simultaneously as bleach-fixing process (blixing proces) or a combination of them.

Typical desilvering processing steps are as follows:

(1) Bleaching-fixing
(2) Bleaching-blixing
(3) Bleaching-washing-fixing
(4) Bleaching-blixing-fixing
(5) Blixing
(6) Fixing-blixing In the foregoing steps, steps (1), (2), (4), and (5) are preferred. Step (2) is disclosed, e.g., in JP-A-61-75352 and step (4) is disclosed, e.g., in JP-A-61-143755 and EP 0427204Al corresponding to Japanese Pa Application No. 2-216389.

Also, the processing baths such as bleaching bath, fixing bath, etc., being applied to the foregoing steps each may comprise one bath or two or more baths (e.g., 2 to 4 baths, in this case, counter-current replenishing system is preferably employed).

The desilvering step may be carried out via a rinsing bath, a washing bath, a stopping bath, etc., after color development. When processing a negative type color photographic material, however the desilvering step is preferably carried out immediately after color development. During reversal process, the desilvering step is preferably carried out in a conditioning bath after color development.

The bleaching solution can contain the compound for use in the present invention. Examples of main component of bleaching agents include: inorganic compounds, such as potassium ferricyanide, ferric chloride, bichromates, persulfates, bromates, etc.; and partial-organic compounds such as an aminopolycarboxylic acid ferric complex salt, an aminopolyphosphoric acid ferric complex salt, etc.

In this invention, the use of an aminopolyphosphonic acid ferric complex salt is preferred form the view points of environmental preservation, safety to handle, and anti-corrosive property to metals.

Then, practical examples of the aminopolycarboxylic acid ferric complex salt in this invention are illustrated below together with their oxidation reduction potentials, but the bleaching agents for use in this invention are not limited to these compounds.

| Compound No. | | Oxidation Reduction Potential* |
|---|---|---|
| 1. | N-(2-Acetamido)iminodiacetic Acid Ferric Complex Salt | 180 |
| 2. | Methyliminodiacetic Acid Ferric Complex Salt | 200 |
| 3. | Iminodiacetic Acid Ferric Complex Salt | 210 |
| 4. | 1,4-Butylenediaminetetraacetic Acid Ferric Salt | 230 |
| 5. | Diethylene Thioether Diaminetetraacetic Acid Ferric Complex Salt | 230 |
| 6. | Glycol Ether Diaminetetraacetic Acid Ferric Complex Salt | 240 |
| 7. | 1,3-Propylenediaminetetraacetic Acid Ferric Complex Salt | 250 |
| 8. | Ethylenediaminetetraacetic Acid Ferric Complex Salt | 110 |
| 9. | Diethylenetriaminepentaacetic Acid Ferric Complex Salt | 80 |
| 10. | Trans-1,2-cyclohexanediaminetetraacetic Acid Ferric Complex Salt | 80 |

*(mV vs. NHE, pH = 6)

The oxidation reduction potential of the bleaching agent is defined as the oxidation reduction potential obtained by the method described in *Transactions of the Faraday Society,* Vol. 55, (1959), pages 1312–1313.

In the present invention, from the viewpoints of rapid processing and effectively obtaining the effects of this invention, the oxidation reduction potential of the bleaching agent is preferably not lower than 150 mV more preferably not lower than 180 mV, and most preferably not lower than 200 mV. If the oxidation reduction potential of the bleaching agent is too high, bleaching fog occurs. Hence, the upper limit is 700 mV, and preferably 500 mV.

In the above-described aminopolycarboxylic acid ferric complex salts, compound No. 7, 1,3-propylenediaminetetraacetic ferric complex salt is particularly preferred.

The aminopolycarboxylic acid ferric complex salt is used as the salt of sodium, potassium, ammonium, etc., but the ammonium salt is preferred in the point of showing fastest bleaching.

The amount of the bleaching agent for the bleaching solution is preferably from 0.01 to 0.7 mol per liter of the bleaching solution and is also preferably from 0.15 to 0.7 mol in the points of rapid processing and reducing the occurrence of stains with the passage of time. The amount thereof is particularly preferably from 0.30 to 0.6 mol. Also, the amount of the bleaching agent for the blixing solution is preferably from 0.01 to 0.5 mol, and more preferably from 0.02 to 0.2 mol per liter of the blixing solution.

In the present invention, the bleaching agents may be used singly or in combination. When using two or more in combination, the total concentration may be adjusted such that it is within the range described above.

The aminopolycarboxylic acid ferric complex salt for the bleaching solution can be used in the form of the complex salt itself or as an aminopolycarboxylic acid (complex-forming compound) and ferric salt (e.g., ferric sulfate, ferric chloride, ferric nitrate, ammonium ferric sulfate, and ferric phosphate) may coexist in the bleaching solution to form the complex salt in the bleaching solution.

When the complex salt is formed in the bleaching solution as described above, the amount of the aminopolycarboxylic acid may be slightly excessive to the amount necessary for forming the complex salt with a ferric ion and in this case, it is preferably used excessively in the range of from 0.01 to 10%.

The bleaching solution is generally used at pH of from 2 to 7.0. For rapid processing, the pH of the bleaching solution is preferably from 2.5 to 5.0, more preferably from 3.0 to 4.8, and most preferably from 3.5 to 4.5. It is preferred that the replenisher for the bleaching solution has a pH of from 2.0 to 4.2.

In this invention, for adjusting the pH in the above-described range, conventional acids can be used. The acids used have preferably pKa of from 2 to 5.5, wherein pKa is defined a the logarithmic value of the reciprocal of an acid dissociation constant and is obtained under the condition of an ionic strength of 0.1 mol/dm (at 25° C.).

It is preferred that the bleaching solution contains at least 0.5 mol/liter of an acid having pKa in the range of from 2.0 to 5.5 for preventing the occurrence of bleaching fog and the precipitation in the replenisher at low temperature with the passage of time.

The acid having pKa of from 2.0 to 5.5, include: inorganic acids such as phosphoric acid, etc., and organic acids such as acetic acid, malonic acid, citric acid, etc. The acid having pKa from 2.0 to 5.5 effectively showing the aforesaid effect is preferably the organic acid. Also, in the organic acids, the organic acid having a carboxy group is particularly preferred.

The organic acid having pKa of from 2.0 to 5.5 may be a monobasic acid or a polybasic acid. In the case of the polybasic acid, the acid can be used in the form of a metal salt (e.g., a sodium salt and a potassium salt) or an ammonium salt if the pKa thereof is within the range of from 2.0 to 5.5. Also, the organic acids having pKa from 2.0 to 5.0 can be used as a mixture of two or more kinds thereof. With proviso that aminopolycarboxylic acids, the salts thereof, and the Fe complex salts thereof are excluded from the acids described above.

Preferred practical examples of the organic acid having pKa of from 2.0 to 5.5, which can be used in this invention, include aliphatic monobasic acids such as acetic acid, monochloroacetic acid, monobromic acid, glycolic acid, propionic acid, monochloropropionic acid, lactic acid, pyruvic acid, acrylic acid, butyric acid, isobutyric acid, pivaric acid, aminobutyric acid, valeric acid, isovaleric acid, etc.; amino acid series compounds such as asparagine, alanine, arginine, ethionine, glycine, glutamine, cysteine, serine, methionine, leucine, etc.; aromatic monobasic acids such as benzoic acid, monosubstituted benzoic acids (e.g., chlorobenzoic acid and hydroxybenzoic acid), nicotinic acid, etc.; aliphatic dibasic acids such as oxalic acid, malonic acid, succinic acid, tartaric acid, malic acid, maleic acid, fumaric acid, oxaloacetic acid, glutaric acid, adipic acid, etc.; amino acid series dibasic acids such as asparagic acid, glutamic acid, cystine, etc.; aromatic dibasic acids such as phthalic acid, terephthalic acid, etc.; and polybasic acids such as citric acid, etc.

Of these acids, the monobasic acids having a hydroxy group or a carboxy group are preferred, and glycolic acid and lactic acid are particularly preferred.

The amount of the glycolic acid or lactic acid is preferably from 0.2 to 2 mols, and more preferably from 0.5 to 1.5 mols per liter of the bleaching solution. These acids are preferred since they remarkably exhibit the full effects of this invention, emit no odors, and restrain the occurrence of bleaching fog.

Also, the combination use of acetic acid and glycolic acid or lactic acid is preferred since the simultaneously solve the precipitation and bleaching fog. The ratio of acetic acid to glycolic acid or lactic acid is preferably from 1/2 to 2/1.

The total amounts of these acids are properly at least 0.2 mol, preferably at least 0.5 mol, more preferably from 1.2 to 2.5 mols, and most preferably from 1.5 to 2.0 mols per liter of the bleaching solution.

In the case of controlling the pH of the bleaching solution in the foregoing range, an alkali agent (e.g., aqueous ammonia, potassium hydroxide, sodium hydroxide, imidazole, monoethanolamine, and diethanolamine) may be used together with the acid(s). Among these alkali agents, aqueous ammonia is preferred.

Also, the preferred alkali agent which is used as a bleaching starer when preparing a starting solution of a bleaching solution from a replenisher, include: potassium carbonate, aqueous ammonia, imidazole, monoethanolamine or diethanolamine. Also, the diluted replenisher may be used alone without the bleaching starter.

In the present invention, various bleaching accelerators can be added to the bleaching solutions or the prebaths thereof. Examples of the bleaching accelerator include the compounds having a mercapto group or a disulfido group described in U.S. Pat. No. 3,893,858, German Patent 1,290,821, British Patent 1,138,842, JP-A-53-95630, and *Research Disclosure,* No. 17129 (July, 1978); the thiazolidine derivatives described in JP-A-50-140129; the thiourea derivatives described in U.S. Pat. No. 3,706,561; the iodides described in JP-A-58-16235; the polyethylene oxides described in German Patent 2,748,430; and the polyamine compounds described in JP-B-45-8836. The mercapt compounds described in British Patent 1,138,842 and JP-A-2-190856 are particularly preferred.

The bleaching solution for use in the present invention can further contain a rehalogenating agent such as bromides (e.g., potassium bromide, sodium bromide, and ammonium bromide) and chlorides (e.g., potassium chloride, sodium chloride, and ammonium chloride). The concentration of the rehalogenating agent is preferably from 0.1 to 5.0 mols, and more preferably from 0.5 to 3.0 mols per liter of the bleaching solution.

Also, the bleaching solution may further contain a metal corrosion inhibitor such as, preferably, ammonium nitrate. The addition amount of ammonium nitrate is from 0.1 to 1 mol, and preferably from 0.2 to 0.5 mol per liter of the bleaching solution.

In the present invention, a replenishing system is preferably used and the replenishing amount for the bleach solution is preferably not more than 600 ml, and more preferably from 100 to 500 ml per square of the color photographic material being processed.

The bleaching processing time is preferably 120 seconds or less, more preferably 50 seconds or less, and most preferably 40 seconds or less.

In addition, at processing, it is preferred that the bleaching solution containing an aminopolycarboxylic acid ferric complex salt is subjected to aeration to oxidize the aminopolycarboxylic acid ferrous complex salt formed, whereby the oxidizing agent (bleaching agent) is regenerated and the photographic performance is very stably kept.

In processing with the bleaching solution in this invention, it is preferred to apply a so-called evaporation correction, that is, to supply water corresponding to the evaporated amount of water of the bleaching solution. This is particularly preferred in the bleaching solution containing a color developer and a bleaching agent having a high electric potential.

There is no particular restriction on the practical method of supplying such water, but the evaporation correction method of using a monitoring bath separately from the bleaching bath, determining the evaporation amount of water in the monitoring bath, calculating the evaporation amount of water in the bleach bath from the evaporation amount of water thus determined, and supplying water to the bleaching bathing in proportion to the evaporation amount in the bleaching bath described in JP-A-1-254959 and JP-A-1-254960 and the evaporation correction method using a liquid level sensor or an overflow sensor described in Japanese Patent Application Nos. 2-46743, 2-47777, 2-47778, 2-47779, and 2-117972 are preferred.

In the present invention, the color photographic material after processed by the bleaching solution is processed by a processing solution having a fixing ability. The processing solution having a fixing ability is practically a fixing solution or a blixing solution. When processing step having a bleaching ability is carried out using a blixing solution, the step may also include a fixing ability as step (5) described before. In steps (2) and (4), wherein a color photographic material is processed with a blixing solution after bleaching with a bleaching solution, the bleaching agent in the bleaching solution may differ from the bleaching agent in the blixing solution. Also, in the case of employing a washing step between the bleaching step and the blixing step as step (3) described above, the compound for use in this invention may be incorporated in the washing solution.

The processing solution having a fixing ability contains a fixing agent. Examples of the fixing agents include thiosulfates such as sodium thiosulfate, ammonium thiosulfate, sodium ammonium thiosulfate, potassium thiosulfate, etc.; thiocyanates (rhodanates) such as sodium thiocyanate, ammonium thiocyanate, potassium thiocyanate, etc.; thiourea; thioethers, etc. In these compounds, ammonium thiosulfate is preferably used. The amount of the fixing agent is preferably from 0.3 to 3 mols, and more preferably from 0.5 to 2 mols per liter of the processing solution having the fixing ability.

Also, from the view point of fixing acceleration, it is preferred to use ammonium thiocyanate (ammonium rhodanate), thiourea, or a thioether (e.g., 3,6-dithia-1,8-octanediol) together with the thiosulfate. Of these, a combination of the thiosulfate and the thiocyanate is most preferred. The combination of ammonium thiosulfate and ammonium thiocyanate is particularly preferred. The amount of the compound which is used together with the thiosulfate is preferably from 0.01 to 1 mol, and more preferably from 0.1 to 0.5 mol per liter of the processing solution having a fixing ability but, as the case may be, by using the compound in an amount of from 1 to 3 mols, the fixing accelerating effect can be greatly increased.

The processing solution having a fixing ability can contain a sulfite (e.g., sodium sulfite, potassium sulfite, and ammonium sulfite), hydroxylamines, hydrazines, hydrogensulfite addition products of aldehyde compounds (e.g. acetaldehyde sodium hydrogensulfite, and particular preferably the compounds described in JP-A-3-158848 and EP 432499), or the sulfinic acid compounds described in JP-A-1-231051 as a preservative. Furthermore, the processing solution can contain various optical brightening agents, defoaming agents, surface active agents, polyvinylpyrrolidone, and organic solvents such as methanol, etc.

Furthermore, it is preferred that the processing solution having a fixing ability contains a chelating agent such as various aminopolycarboxylic acids, organic phosphonic acids, etc., for stabilizing the processing solution. Examples of preferred chelating agents include 1-hydroxyethylidene-1,1-diphosphonic acid, ethylenediamine-N,N,N',N'-tetramethylenephosphonic acid, nitrilotrimethylenephosphonic acid, ethylenediaminetetraacetic acid, diethylenetriaminepentaacetic acid, cyclohexanediaminetetraacetic acid, 1,2-propylenediaminetetraacetic acid, etc. Of these compounds, 1-hydroxyethylidene-1,1-diphosphonic acid and ethylenediaminetetraacetic acid are particularly preferred.

The amount of the chelating agent is preferably from 0.01 to 0.3 mol, and more preferably from 0.1 to 0.2 mol per liter of the processing solution.

The pH of the fix solution is preferably from 5 to 9, and more preferably from 7 to 8. Also, the pH of the blixing solution is preferably from 4.0 to 7.0, and more preferably from 5.0 to 6.5. Furthermore, the pH of the blixing solution after processing with a bleaching solution or a first blixing solution is preferably from 6 to 8.5, and more preferably from 6.5 to 8.0.

For controlling the processing solution having a fixing ability to the pH range, a compound having pKa of from 6.0 to 9.0 is preferably used as a buffer. Imidazoles such as imidazole, 2-methylimidazole, etc., are preferred as the buffer. The amount of such a buffer is preferably from 0.1 to 10 mols, and more preferably from 0.2 to 3 mols per liter of the processing solution.

The blixing solution can further contain the above compounds which can be used for the bleaching solution.

In the present invention, the blixing solution (starting solution) at the initiation of processing is prepared by dissolving the above-described compounds for blixing solution in water or by mixing a bleaching solution and a fixing solution.

The replenishing amount for the fixing solution or the blixing solution in the case of employing a replenishing system is preferably from 100 to 3000 ml, and more preferably from 300 to 1800 ml per square meter of the color photographic material. The replenisher for the blixing solution may be replenished as a replenisher for blixing solution or may be replenished by using the overflow solutions of the bleaching solution and the fixing solution as described in JP-A-61-143755 and EP 0427204Al corresponding to Japanese Patent Application No. 2-216389.

Also, in bleaching process described above, it is preferred that the blixing process is carried out while supplying water corresponding to evaporated water and replenishing the replenisher for the blixing solution.

Furthermore, in the present invention, the total processing time of the processing step having a fixing ability is preferably from 0.5 to 4 minutes, more preferably from 0.5 to 2 minutes, and most preferably from 0.5 to 1 minute.

In the present invention, the sum of the total processing times of the desilvering steps composed of a combination of bleaching, blixing, and fixing is preferably from 45 seconds to 4 minutes, and more preferably from 1 minute to 2 minutes. Also, the processing temperature is preferably from 25° C. to 50° C., and more preferably from 35° C. to 45° C.

From the processing solution having a fixing ability in this invention, silver can be recovered and then the regenerated solution after silver recovery can be reused. The effective silver recovering methods are an electrolysis method (described in French Patent 2,299,667), a precipitation method (described in JP-A-52-73037 and German Patent 2,331,220), an ion exchange method (described in JP-A-51-17114 and German Patent 2,548,237), and a metal substitution method (described in British Patent 1,353,805). These silver recovering methods are preferably carried out for the tank solutions in an in-line system since the rapid processing aptitude can be further improved.

After the processing step having a fixing ability, a washing step is usually carried out. However, a simple processing method wherein after processing with the processing solution having a fixing ability, stabilization process using the stabilizing solution containing the compound for use in this invention is carried out without applying substantial washing can be used.

Washing water used in the washing step can contain the surface active agent which can be contained in the stabilizing solution described above, an antibacterial agent, an antifungal agent, a germicide, a chelating agent, and the above preservative which can be contained in the processing solution having a fixing ability.

The washing step and the stabilization step are preferably carried out by a multistage counter-current system and in this system, the stage number is preferably from 2 or 4. The replenishing amount for the washing step or the stabilization step is preferably from 1 to 50 times, more preferably from 2 to 30 times, and most preferably from 2 to 15 times the carried amount of a processing solution from the pre-bath per unit area of the color photographic material being processed.

As water used for the washing step, city water can be used, but water deionized with ion exchange resins, etc., to reduce the concentrations of Ca ions and Mg ions to 5 mg/liter or less and water sterilized by a halogen, a ultraviolet sterilizing lamp, etc., are preferably used.

Also, as water for supplying evaporated water of each processing solution, city water may be used, but water deionized and water sterilized, which can be preferably used for the washing step, are preferably used.

Also, by a method of introducing the overflow solution from the washing step or the stabilization step into the bath having a fixing ability, which is the prebath thereof, the amount of the waste solution can be preferably reduced.

In the processing steps, it is preferred to supply a suitable amount of water, a correction water, or a processing replenisher to not only the bleaching solution, the blixing solution, and the fixing solution but also to other processing solutions (e.g., the color developer, washing water, and stabilizing solution) for correcting the concentration by evaporation.

In the present invention, when the total time from bleaching process to drying step is generally from 1 minute to 12 minutes, preferably from 1 minute to 3 minutes, and more preferably from 1 minute and 20 seconds to 2 minutes, the effect of the present invention of particularly effectively obtained.

In the present invention, the drying temperature is preferably from 50° C. to 65° C., and more preferably from 50° C. to 60° C. and the drying time is preferably from 30 seconds to 2 minutes, and more preferably from 40 seconds to 80 seconds.

The color photographic material processed by the processing of the present invention can have at least one of a blue-sensitive silver halide emulsion layer, a green-sensitive silver halide emulsion layer, and a red-sensitive silver halide emulsion layer on a support and there is no particular restriction on the layer number and the layer disposition order of the silver halide emulsion layers and light-insensitive layers.

A typical example thereof is a silver halide color photographic material having on a support at least a light-sensitive layer composed of plural silver halide emulsion layers each having a substantially same color sensitivity but having a different light sensitivity, the light-sensitive layer is a unit light-sensitive layer having a color sensitivity to blue light, green light or red light, and in a multilayer silver halide color photographic material, the unit light-sensitive layers are disposed on a support in the order of a red-sensitive layer, a green-sensitive layer, and a blue-sensitive layer from the support side. However, according to the purpose, other disposition order of the color-sensitive layers may be employed and also a layer structure that light-sensitive layers having a same color sensitivity have a light-sensitive layer having a different color sensitivity between the layers may be employed.

Furthermore, light-insensitive layers such as the uppermost layer, the lowermost layer, interlayers, etc., may be formed in addition to the silver halide light-sensitive emulsion layers.

The interlayers may contain the couplers, etc., described in JP-A-61-43748, JP-A-59-113438, JP-A-59-13440, JP-A-61-20037, and JP-A-61-20038 and also may contain color mixing inhibitors, ultraviolet absorbers, stain inhibitors (anti-stain agents), etc.

As plural silver halide emulsion layers constituting each unit light-sensitive layer, the two-layer structure of a high-speed emulsion layer and a low-speed emulsion layer as described in West German Patent 1,121,470 and British Patent 923,045 can be preferably used. Usually, it is preferred that these light-sensitive layers are disposed such that the light-sensitivity becomes successively lower towards the support and in this case, a light-insensitive layer may be formed between the light-sensitive emulsion layers. Also, a low-speed emulsion layer may be placed farther from the support and a high-speed emulsion layer may be placed near the support as described in JP-A-57-112751, JP-A-62-200350, JP-A-62-206541, and JP-A-62-206543.

In practical examples, the silver halide emulsion layers can be placed on a support from the farthest side of the support in the order of a low-speed blue-sensitive emulsion layer (BL)/a high-speed blue-sensitive emulsion layer (BH)/a high-speed green-sensitive emulsion layer (GH)/a low-speed green-sensitive emulsion layer (GL)/a high-speed red-sensitive emulsion layer (RH)/a low-speed red-sensitive emulsion layer (RL), in the order of BH/BL/GL/GH/RH/RL, or in the order of BH/BL/GH/GL/RL/RH.

Also, they can be also placed from the farthest side of a support, in the order of a blue-sensitive emulsion layer/GH/RH/GL/RL as described in JP-B-55-34932. Furthermore, they can be also placed from the farthest side of a support, in the order of a blue-sensitive emulsion layer/GL/RL/GH/RH as described in JP-A-56-25738 and JP-A-62-63936. Moreover, a three-layer structure composed of the highest light-sensitive emulsion layer as the upper layer, a light-sensitive emulsion layer having a lower light-sensitivity than the upper layer as in inter layer, and a silver halide emulsion layer having a far lower light sensitivity than the inter layer as the lower layer as described in JP-B-49-15495 can be used. Even in the case composed of three layers each having a different light sensitivity, the layers may be disposed in the order of the medium-speed light-sensitive emulsion layer/the high-speed light-sensitive emulsion layer/the low-speed light-sensitive emulsion layer from the side apart from a support in a same color-sensitive layer as described in JP-A-59-202464.

As described above, various layer structures and layer dispositions can be selected according to the purpose of the color photographic light-sensitive material.

The dry layer thickness of the whole constituting layers of the color photographic material excluding the support, the subbing layer on the support and the back layer is preferably from 12.0 μm to 20.0 μm, and more preferably from 12.0 μm to 18.0 μm from the view points of preventing the formation of bleaching fog and preventing the occurrence of stains with the passage of time.

The layer thickness of a color photographic material is measured as follows. That is, the color photographic material being measured is stored for 7 days under the conditions of 25° C., 50% RH after the preparation thereof, the whole thickness of the color photographic material is first measured, and then, after removing the coated layers on the support, the thickness thereof is measured again, and the difference of the thicknesses is defined as the layer thickness of the whole coated layers of the color photographic material excluding the support. The thickness can be measured using, for example, a film measuring device by a contact type piezoelectric conversion element (K-403B Stand., trade name, manufactured by Anritsu Electric Co., Ltd.). In addition, the coated layers on the support can be removed using an aqueous sodium hypochlorite solution. Also, by photographing the cross section of the color photographic material using a scanning type electron microscope (magnification is preferably 3,000 or more), the thickness of the whole layers on the support can be determined.

In the present invention, the swelling ratio of the color photographic material is preferably from 50 to 200%, and more preferably from 70 to 150%. The swelling ratio is defined by the following formula:

$$Swelling\ ratio = (A-B)/B \times 100(\%)$$

A: Equilibrium swollen layer thickness in water at 25° C.

B: Whole dry layer thickness at 25° C., 55% RH.

If the swelling ratio falls outside the preferred ranges, residue from a color developing agent increases and photographic performance, image qualities, such as desilvering property, etc., and film properties, such as the film strength, are adversely affected.

The swelling speed of a color photographic material in the present invention, represented by $T\frac{1}{2}$ is preferably 15 seconds or less, and more preferably 9 seconds or less, wherein $T\frac{1}{2}$ is defined as the time for the swelling to decrease to one half of a saturated swollen layer thickness. This saturated swollen layer thickness is defined as 90% of the maximum swollen layer thickness attained when the color photographic material is processed in a color developer at 38° C. for 3 minutes and 15 seconds.

The silver halide contained in the photographic emulsion layers of the color photographic material being processed by the process of the present invention may be silver bromide, silver iodochlorobromide, silver chlorobromide, silver bromide or silver chloride. The preferred silver halide is silver iodobromide, silver iodochloride, or silver iodochlorobromide containing about 0.1 to 30 mol% of silver iodide. Silver iodobromide containing from 2 to 25 mol% of silver iodide is particularly preferred.

The silver halide grains in the photographic silver halide emulsions may have a regular crystal form, such as cubic, octahedral, tetradecahedral, etc.; an irregular crystal form, such as spherical, tabular, etc.; or a crystal defect such as twin planes, etc.; or a composite form of them.

The grain sizes of the silver halide grains may be fine as about 0.2 micron or less or as large as up to about 10 microns in projected area diameters. Also, the silver halide emulsion may be polydispersed emulsion or monodispersed.

The silver halide photographic emulsions for use in this invention can be prepared by using the methods described, e.g., in *Research Disclosure (RD)*, No. 17643 (December), pages 22-23, "I. Emulsion Preparation and Types", ibid., No. 18716 (November, 1979), page 648, P. Glafkides, *Chimie et Physique Photographique*, published by Paul Montel, 1967, G. F. Duffin, *Photographic Emulsion Chemistry*, published by Focal Press, 1966, and V. L. Zelikman et al, *Making and Coating Photographic Emulsion*, published by Focal Press, 1964.

The monodisperse silver halide emulsion described in U.S. Pat. Nos. 3,574,628 and 3,655,394 and British Patent 1,413,748 is preferably used. Furthermore, tabular silver halide grains having an aspect ratio of at least about 5 can be used in this invention. The tabular silver halide grains can be prepared as described in Gutoff, *Photographic Science and Engineering*, Vol. 14, 248-257 (1970, U.S. Pat. Nos. 4,434,226, 4,414,310, 4,430,048, and 4,439,520, and British Patent 2,112,157.

The crystal structure of the silver halide grains may have a uniform halogen composition throughout the whole grain, may have a different halogen composition between the inside and the surface portion thereof, or may have a multilayer structure. Also, a silver halide having a different halogen composition may be junctioned to the silver halide grains by an epitaxial junction. Also the silver halide grains may be junctioned to a compound other than silver halide, such as silver rhodanate, lead oxide, etc.

Also, a mixture of silver halide grains having various crystal forms can be used in the present invention.

Silver halide emulsions are usually subjected to physical ripening, chemical ripening, and a spectral sensitization before use. Additives used in these steps are described in *Research Disclosure (RD)*, No. 17643 (December,1978), ibid., No. 18716 (November, 1979), and ibid., No. 307105 (November, 1989) and the corresponding portions are summarized in the following table.

Also, photographic additives which can be used in the present invention are described in the three publications (RD) and the related portions are shown in the same table.

| Kind of Additive | RD 17643 | RD 18716 | RD 307105 |
|---|---|---|---|
| 1. Chemical Sensitizer | p. 23 | p. 648, right column (RC) | p. 866 |
| 2. Sensitivity Increasing Agent | — | do. | — |
| 3. Spectral Sensitizer, Super sensitizer | pp. 23-24 | p. 648, RC to p. 649, RC | pp. 866-868 |
| 4. Brightening Agent | p. 24 | p. 647, RC | p. 868 |
| 5. Anti-foggant, Stabilizer | pp. 24-25 | p. 649, RC | pp. 868-870 |
| 6. Light Absorber, Filter Dye, UV Absorber | pp. 25-26 | p. 649, RC to P. 650, left column (LC) | p. 873 |
| 7. Anti-staining Agent | p. 25, RC | P. 650, LC to RC | p. 872 |
| 8. Dye Image Stabilizer | p. 25 | p. 650, LC | do. |
| 9. Hardener | p. 26 | p. 651, LC | pp. 874-875 |
| 10. Binder | p. 26 | do. | pp. 873-874 |
| 11. Plasticizer, Lubricant | p. 27 | P. 650, RC | p. 876 |
| 12. Coating Aid, Surfactant | pp. 26-27 | p. 650, RC | pp. 875-876 |
| 13. Anti-static Agent | p. 27 | do. | pp. 876-877 |
| 14. Matting Agent | — | — | pp. 878-879 |

Various color couplers can be used in the color photographic materials. Practical examples of typical couplers are described in patents cited in *Research Disclosure*, No. 17643, VII—C to G and ibid., No. 307105, VII—C to G.

Examples of preferred yellow coupler are described in U.S. Pat. Nos. 3,933,501, 4,022,620, 4,326,024 4,401,752, 4,248,961, 3,973,968, 4,314,023, and 4,511,649, JP-B-58-10739, British Patent 1,425,020 and 1,476,760, and European Patent 249,473A.

Also, 1-alkylcyclopropylcarbonyl based or indolinyl carbonyl based yellow couplers such as those described in European Patent Application (Laid-Open) 447969A, Japanese Patent Application Nos. 2-314522, 2-232857, 2-26341 and 2-296401 are particularly preferred.

Preferred magenta couplers are 2-equivalent and 4-equivalent 5-pyrazolne series and pyrazoloazole series compounds. The more preferred magenta couplers are described in U.S. Pat. Nos. 4,310,619, 4,351,897, 3,061,432, 3,725,064, 4,500,630, 4,540,654, and 4,556,630, European Patent 73,636, *Research Disclosure*, No. 24220 (June 1984), ibid., No. 24230 (June, 1984), JP-A-60-33552, JP-A-60-43659, JP-A-61-72238, JP-A-60-35730, JP-A-55-118034, and JP-A-60-185951, and WO(PCT) 88/04795.

In the present invention, the effect of this invention becomes more remarkable when at least one kind of a 4-equivalent magenta coupler is used.

Preferred 4-equivalent magenta couplers are the 4-equivalent 5-pyrazolone series magenta couplers represented by formula (M) and the 4-equivalent pyrazoloazole series magenta couplers represented by formula (m).

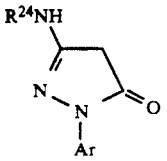
(M)

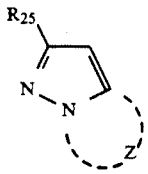
(m)

In formula (M), $R_{24}$ represents an alkyl group, an aryl group, an acyl group, or a carbamoyl group. Ar represents a substituted or unsubstituted phenyl group. Either $R_{24}$ or Ar may be a divalent or higher valent group forming a polymer, such as a dimer or a polymer coupler, which links the coupling mother nucleus to the main chain of a polymer.

In formula (m), $R_{25}$ represents a hydrogen atom or a substituent and Z represents a non-matellic atomic group necessary for forming a 5-membered azole ring containing 2 to 4 nitrogen atoms. This azole ring may have a substituent or a condensed ring. In addition, either $R_{25}$ or the group substituting the azole ring may become a divalent or higher valent group to form a polymer such as a dimer or a polymer coupler, or form a polymer coupler by bonding a high molecular chain with a coupling mother nucleus.

In formula (M), the alkyl group represented by $R_{24}$ represents a straight or branched alkyl group having from 1 to 42 carbon atoms, an aralkyl group, an alkenyl group, an alkynyl group, a cycloalkyl group, or a cycloalkenyl group; the aryl group represented by $R_{24}$ represents an aryl group having from 6 to 46 carbon atoms; the acyl group represented by $R_{24}$ is an aliphatic acyl group having from 2 to 32 carbon atoms or an aromatic acyl group having from 7 to 46 carbon atoms; and the carbamoyl group represented by $R_{24}$ is an aliphatic carbamoyl group having from 2 to 32 carbon atoms or an aromatic carbamoyl group having from 7 to 46 carbon atoms.

These groups each may have a substituent and the substituent is an organic substituent or a halogen atom bonding with a carbon atom, an oxygen atom, a nitrogen atom or a sulfur atom. Examples of the substituent are an alkyl group, an aryl group, a heterocyclic group, a cyano group, a hydroxy group, a nitro group, a carboxy group, an amino group, an acyl group, an aryloxycarbonyl group, an alkoxycarbonyl group, a carbamoyl group, an alkoxy group, an aryloxy group, a heterocyclic oxy group, an acyloxy group, a carbamoyloxy group, a silyloxy group, an aryloxycarbonylamino group, an acylamino group, an alkylamino group, an anilino group, a ureido group, a sulfamoylamino group, an alkoxycarbonylaimo group, a sulfonamido group, an aryloxycarbonylamino group, an imido group, an alkylthio group, an arylthio group, a heterocyclic thio group, a sulfamoyl group, a sulfonyl group, a sulfinyl group, an azo group, a phosphonyl group, an azolyl group, a fluorine atom, a chlorine atom, and a bromine atom.

$R_{24}$ represents, in more detail, an alkyl group (e.g., methyl, ethyl, butyl, propyl, octadecyl, isopropyl, t-butyl, cyclopentyl, cyclohexyl, methoxyethyl, ethoxyethyl, t-butoxyethyl, phenoxyethyl, methanesulfonylethyl, and 2-(2,4-di-tert-amylphenoxy)ethyl), an aryl group (e.g., phenyl, 2-chlorophenyl, 2-methoxyphenyl, 2-chloro-5-tetradecanamidophenyl, 2-chloro-5-(3-octadecenyl1-succinimido)phenyl, 2-chloro-5-octadecylsulfonamidophenyl, and 2-chloro-5-[2-(4-hydroxy-3-tertbutylphenoxy)tetradecanamidophenyl]), an acyl group (e.g., acetyl, pivaloyl, tetradecanoyl, 2-(2-,4-di-tertpentylphenoxy)acetyl, 2-(2,4-di-tert-pentylphenoxy)butanoyl, benzoyl, and 3-(2,4-di-tret-amylphenoxyacetamido)benzoyl), or a carbamoyl group (e.g., N-methylcarbamoyl, N,N-dimethylcarbamoyl, N-hexadecylcarbamoyl, N-methyl-N-phenylcarbamoyl, and N-[3-{2,4-ditert-pentylphenoxy)butylamido}]-phenylcarbamoyl).

$R_{24}$ is preferably an aryl group or an acyl group.

In formula (M), Ar represents a substituted or unsubstituted phenyl group. The preferred substitute for the phenyl group include a halogen atom, an alkyl group, a cyano group, an alkoxy group, an alkoxycarbonyl group, or an acylamino group. In more detail, Ar is, for example, phenyl, 2,4,6-trichlorophenyl, 2,5-dichlorophenyl, 2,4-dimethyl-6-methoxyphenyl, 2,6-dichloro-4-methoxyphenyl, 2,6-dichloro-4-ethoxycarbonylphenyl, 2,6-dichloro-4-cyanophenyl, or 4-[2-(2,4-ditert-amylphenoxy)butylamido]phenyl.

Ar is preferably a substituted phenyl group, more preferably a phenyl group substituted with at least one halogen atom (in particular, chlorine), and most preferably 2,4,6-trichlorophenyl or 2,5-dichlorophenyl.

Of the pyrazoloazole series magenta couplers represented by formula (m), the preferred couplers include 1H-imidazo[1,2-b]pyrazole 1H-pyrazolo[1,5-b]-1,2,4]-triazole, 1H-pyrazolo[5,1-c][1,2,4]triazole, and 1H-pyrazolol[1,5-d]tetrazole skeletons and they are represented by formulae (m-1), (m-2), (m-3) and (m-4).

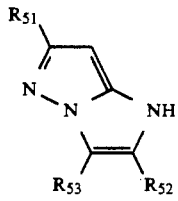
(m-1)

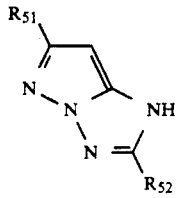
(m-2)

-continued

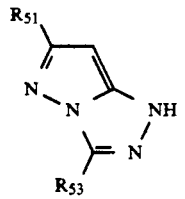

(m-3)

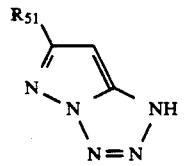

(m-4)

Then, $R_{25}$, $R_{51}$, $R_{52}$, and $R_{53}$ in formula the above formulae (m-1), (m-2), (m-3) and (m-4) are explained.

$R_{25}$ and $R_{51}$ each represents a hydrogen atom or a substituent and Examples of the substituent, include a halogen atom, an alkyl group, an aryl group, a heterocyclic group, a cyano group, a hydroxy group, a sulfo group, a nitro group, a carboxy group, an amino group, an alkoxy group, an aryloxy group, an acylamino group, an alkylamino group, an anilino group, a ureido group, a sulfamoylamino group, an alkylthio group, an aryl thio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, an acyl group, and an azolyl group.

These groups may be substituted by the same group of substituents for $R_{24}$. Also, $R_{25}$ and $R_{51}$ each may be a divalent group or higher valent group to form a polymer such as a dimer or a polymer coupler, or for a polymer coupler by bonding a high molecular chain with a coupling mother nucleus.

In more detail, $R_{25}$ and $R_{51}$ each represents a hydrogen atom, a halogen atom (e.g., chlorine and bromine), or an alkyl group (which may be a straight chain, branched, or cyclic). The alkyl group includes an aralkyl group, an alkinyl group, and a cycloalkyl group.

$R_{25}$ and $R_{51}$ each represents preferably an alkyl group having from 1 to 32 carbon atoms (e.g., methyl, ethyl, propyl, isopropyl, t-butyl, tridecyl, 2-methanesulfonylethyl, 3-(3-pentadecylphenoxy)propyl, 3-{4-{2-[4-(4-hydroxyphenylsulfonyl)phenoxy]dodecanamido}-phenyl}propyl, 2-ethoxytridecyl, trifluoromethyl, cyclopentyl, 3-(2,4-di-t-amylphenoxy)propyl), an alkenyl group (e.g., allyl), an aryl group (e.g., phenyl, 4-t-butylphenyl, 2,4-di-t-amylphenyl, and 4-tetradecanamidophenyl), a heterocyclic group (e.g., 2-furyl, 2-thienyl, 2-pyrimidinyl, and 2-benzothiazolyl), a cyano group, a hydroxy group, a sulfo group, a nitro group, a carboxy group, an amino group, an alkoxy group (e.g., methoxy, ethoxy, 2-methoxyethoxy, 2-dodecyloxyethoxy, and 2-methanesulfonylethoxy), an aryloxy group (e.g., phenoxy, 2-methylphenoxy, 4-t-butylphenoxy, 3-nitrophenoxy, 3-t-butyloxycarbamoylphenoxy, and 3-methoxycarbamouylphenoxy), an acylamino group (e.g., acetamido, benzamide, tetradecanamide, 2-(2,4-di-t-amylpheoxy)butanamide, 4-(3-t-butyl-4-hydroxyphenoxy)butanamide, and 2-{4-(4-hydroxyphenylsulfonyl)phenoxy}decanamide), an alkylamino group (e.g., methylamino, butylamino, dodecylamino, diethylamino, and methylbutylamino), an anilino group (e.g., phenylamino, 2-chloroanilino, 2-chloro-5-tetradecanaminoanilino, 2-chloro-5-dodecyloxycarbonylanilino, N-acetylanilino, and 2-chloro-5-{α-(3-t-butyl-4-hydroxyphenoxy)dodecanamido}anilino), a ureido group (e.g., phenylureido, methylureido, and N,N-dibutylureido), a sulfamoylamino group (e.g., N,N-dipropylsulfamoylamino and N-methyl-N-decylsulfamoylamino), an alkylthio group (e.g., methylthio, octylthio, tetradecylthio, 2-phenoxyethylthio, 3-phenoxypropylthio, and 3-(4-t-butylphenoxy)propylthio), an arylthio group (e.g., phenylthio, 2-butoxy-5-t-octylphenylthio 3-pentadecylphenylthio, 2-carboxyphenylthio, and 4-tetradecanamidophenylthio), an alkoxycarbonylamino group (e.g., methoxycarbonylamino and tetradecyloxycarbonylamino), a sulfonamide group (e.g., methanesulfonamide, hexadecanesulfonamide, benzenesulfonamide, p-toluenesulfonamide, octadecanesulfonamide, and 2-methoxy-5-butylbenzenesulfoneamide), a carbamoyl group (e.g., N-ethylcarbamoyl, N,N-dibutylcarbamoyl, N-(2-dodecyloxyethyl)carbamoyl, N-methyl-N-dodecylcarbamoyl, and N-{3-(2,4-t-amylphenoxy)propyl}carbamoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, and N,N-diethylsulfamoyl), a sulfonyl group (e.g., methanesulfonyl, octanesulfonyl, benzenesulfonyl, and toluenesulfonyl), an alkoxycarbonyl group (e.g., methoxycarbonyl, butyloxycarbonyl, dodecyloxycarbonyl, and octadecyloxycarbonyl), a heterocyclic oxy group (e.g., 1-phenyltetrazol-5-oxy and 2-tetrahydropyranyloxy), an azo group (e.g., phenylazo, 4-methoxyphenylazo, 4-pivaloylaminophenylazo, and 2-hydroxy-4-propanoylphenylazo), an acyloxy group (e.g., acetoxy), a carbamoyloxy group (e.g., N-methylcarbamoyloxy and N-phenylcarbamoyloxy), a silyloxy group (e.g., trimethylsilyloxy and dibutylmethylsilyloxy), an aryloxycarbonylamino group (e.g., phenoxycarbonylamino), an imido group (e.g., N-succinimido, N-phthalimido, and 3-octadecenylsuccinimido), a heterocyclic thio group (e.g., 2-benzothiazolylthio, 2,4-di-phenoxy-1,3,5-triazole-6-thio, and 2-pyridylthio), a sulfinyl group (e.g., dodecansulfonyl, 3-pentadecylphenylsulfinyl, and 3-phenoxypropylsulfinyl), a phosphonyl group (e.g., phenoxysulfonyl, octyloxysulfonyl, and phenylsulfonyl), an aryloxycarbonyl group (e.g., phenoxycarbonyl), an acyl group (e.g., acetyl, 3-phenylpropanoyl, benzoyl, and 4-dodecyloxybenzoyl), or an azolyl group (e.g., imidazolyl, pyrazolyl, 3-chloro-pyrazol-1-yl, and triazolyl).

$R_{25}$ and $R_{51}$ are preferably an alkyl group, an aryl group, an alkoxy group, an aryloxy group, an alkylthio group, an ureido group, a urethane group, or an acylamino group.

$R_{52}$ has the same meaning as $R_{51}$ and is preferably a hydrogen atom, an alkyl group, an aryl group, a heterocyclic group, an alkoxycarbonyl group, a carbamoyl group, a sulfamoyl group, a sulfinyl group, an acyl group, or a cyano group.

Also, $R_{53}$ has the same meaning as $R_{51}$ and is preferably a hydrogen atom, an alkyl group, an aryl group, a heterocyclic group, an alkoxy group, an aryloxy group, an alkylthio group, an arylthio group, an alkoxycarbonyl group, a carbamoyl group, or an acyl group, and more preferably an alkyl group, an aryl group, a heterocyclic group, an alkylthio group, or an arylthio The effect of this invention becomes particularly remarkable when the 4-equivalent pyrazolone series magenta couplers represented by formula (M) are used.
Specific non-exclusive examples of the preferred 4-equivalent magenta couplers are illustrated below.
(M-1)
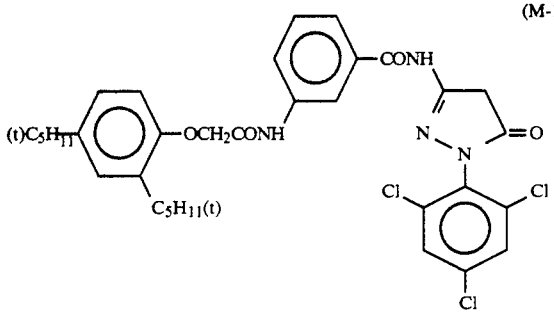
(M-2)
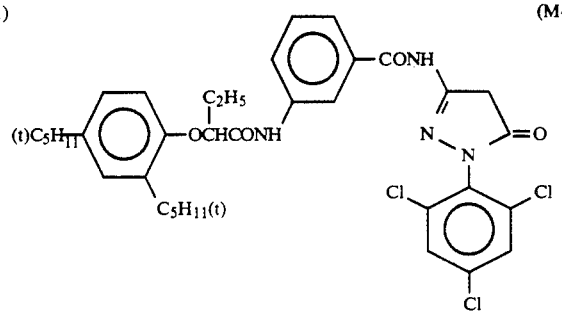
(M-3)
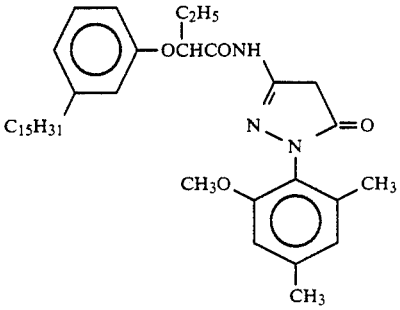
(M-4)
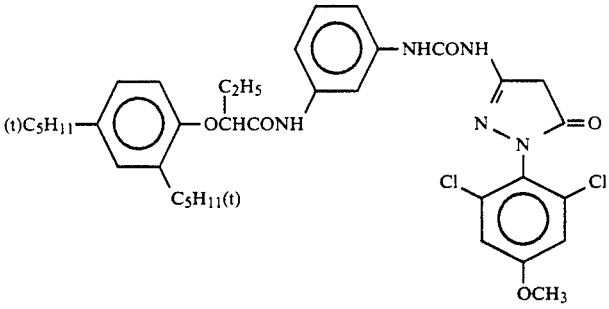
(M-5)
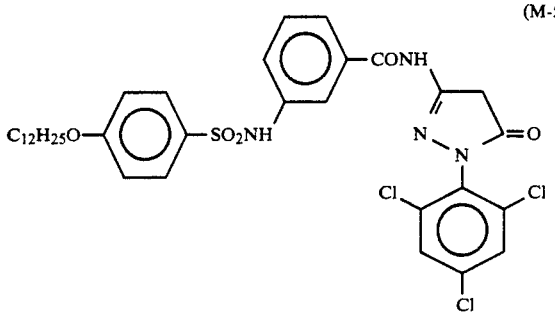
(M-6)
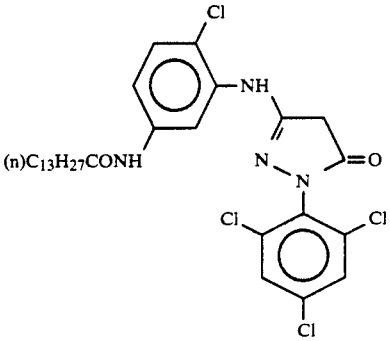

-continued
(M-7)
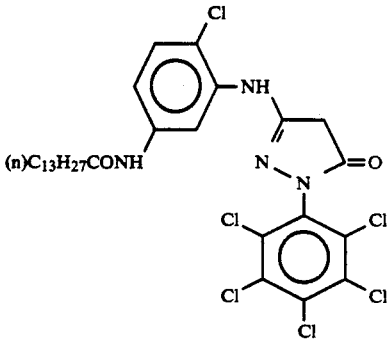
(M-8)
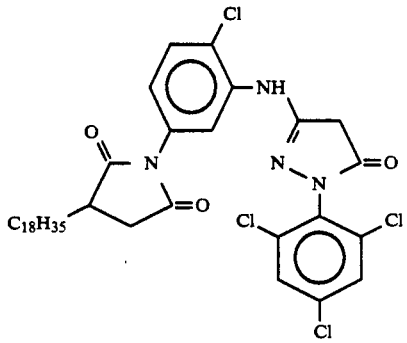
(M-9)
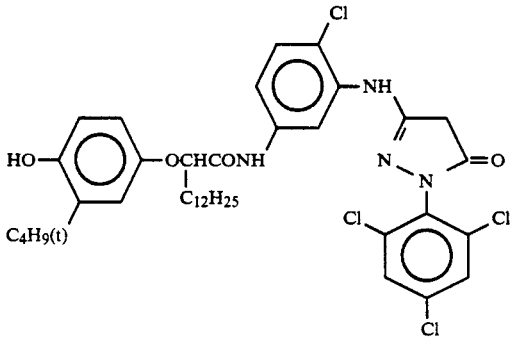
(M-10)
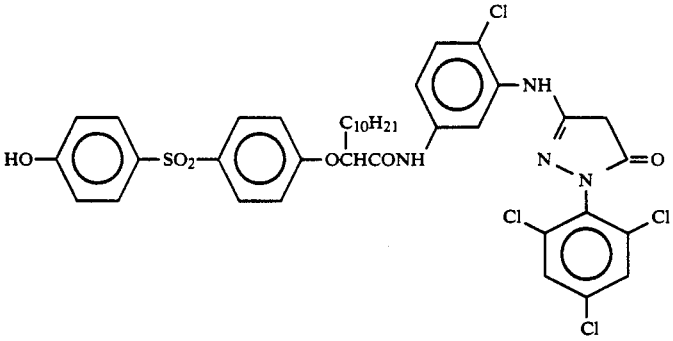
(M-11)
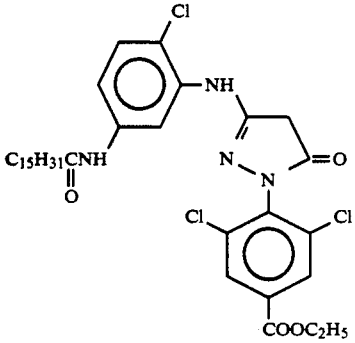
(M-12)
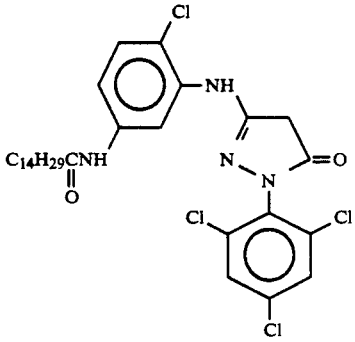

-continued
(M-13)
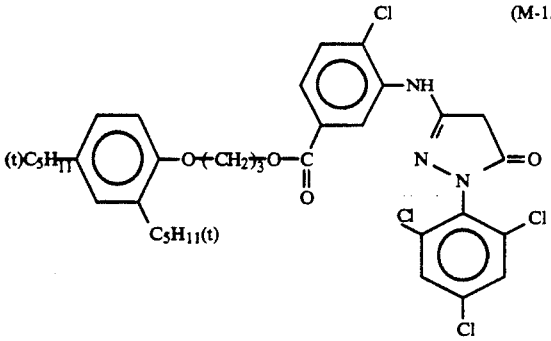
(M-14)
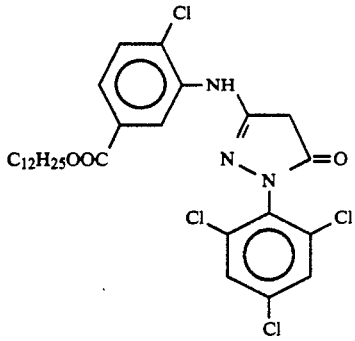
(M-15)
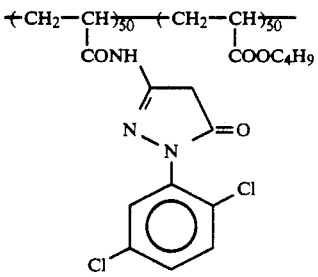
The number is weight %
Mean Molecular Weight: about 25,000
(M-16)
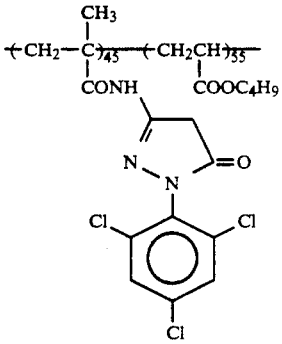
The number is weight %
Mean Molecular Weight: about 30,000
(M-17)
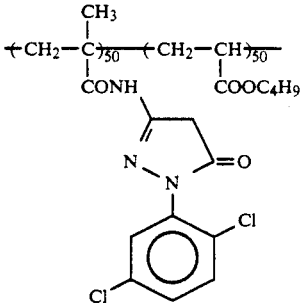
The number is weight %
Mean Molecular Weight: about 30,000
(M-18)
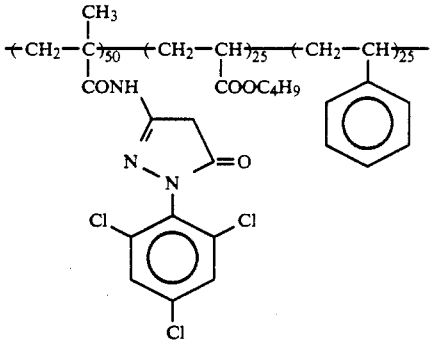
The number is weight %
Mean Molecular Weight: about 20,000
(M-19)
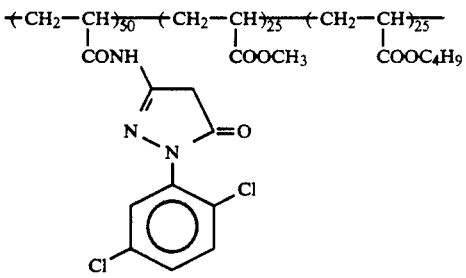
The number is weight %
Mean Molecular Weight: about 40,000
(M-20)
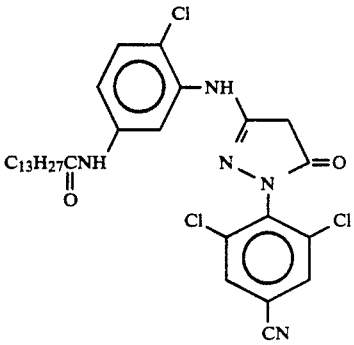

-continued
(M-21)
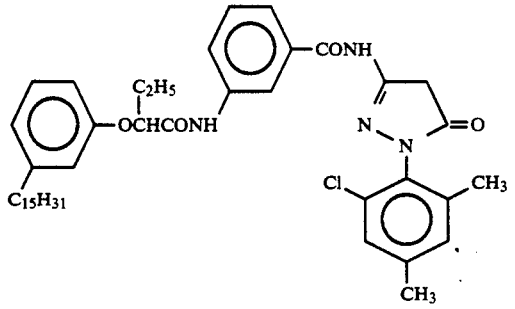
(M-22)
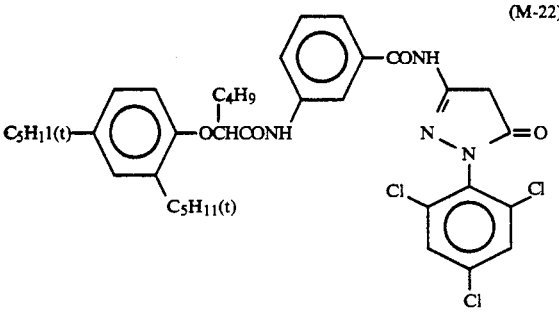
(M-23)
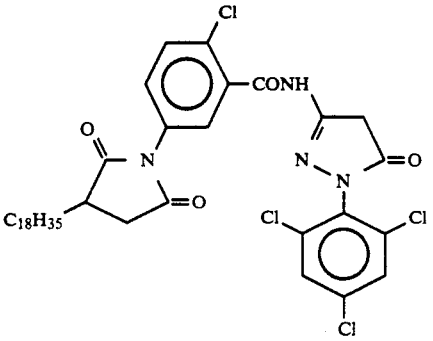
(M-24)
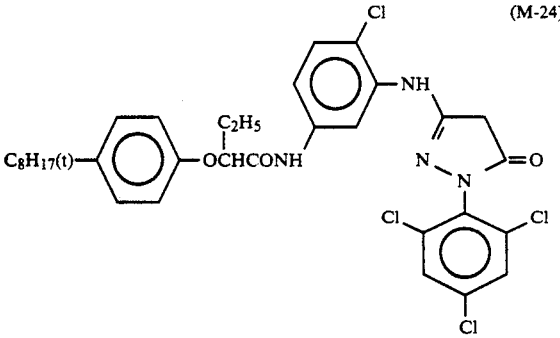
(M-25)
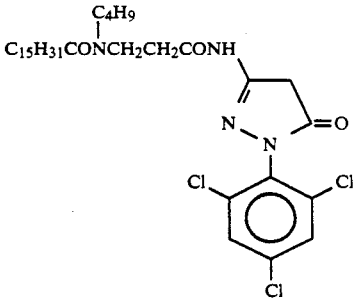
(M-26)
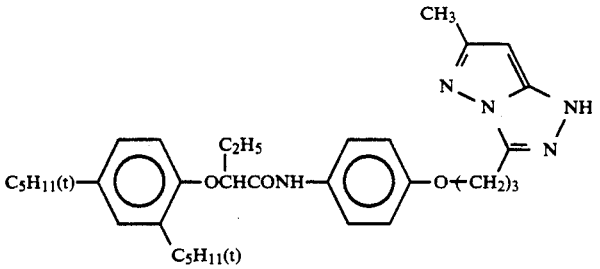
(M-27)
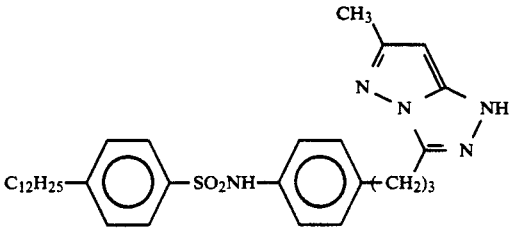

-continued
(M-28)
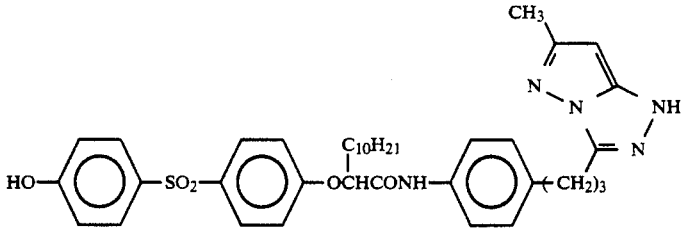
(M-29)
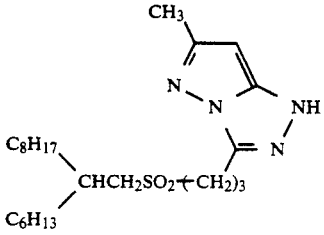
(M-30)
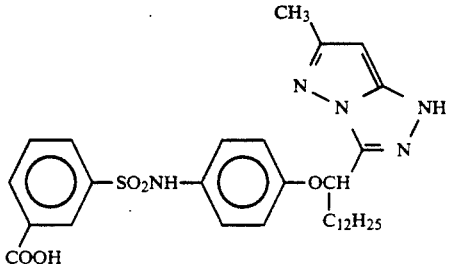
(M-31)
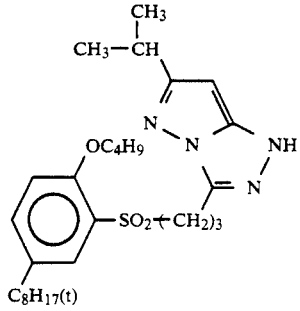
(M-32)
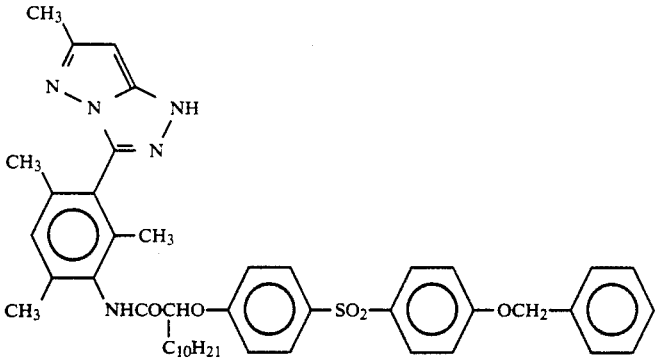
(M-33)
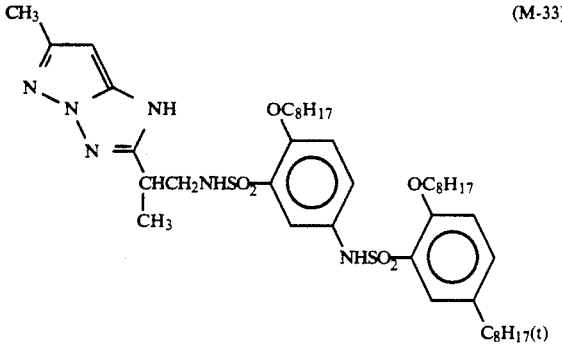
(M-34)
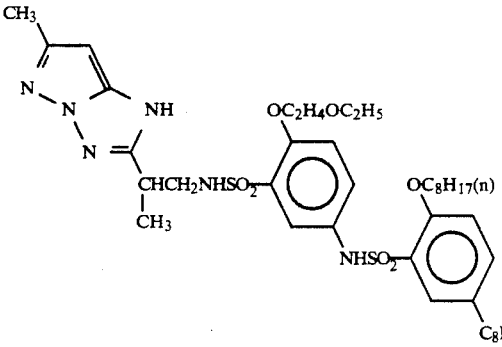

-continued (M-35)

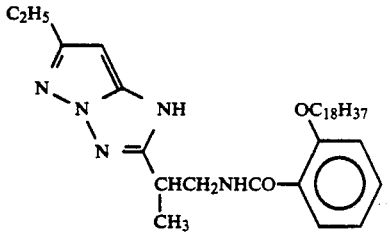

(M-36)

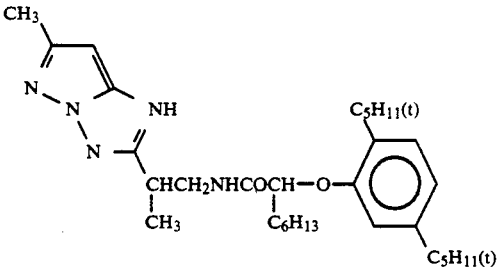

(M-37)

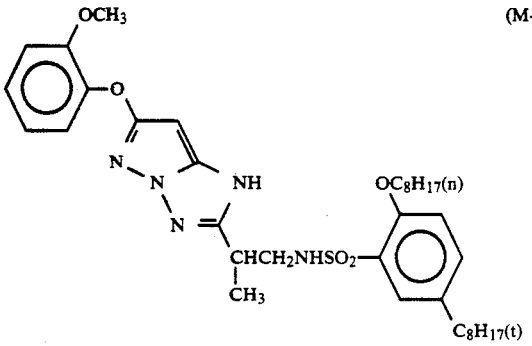

(M-38)

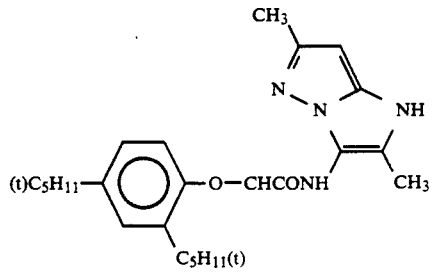

(M-39)

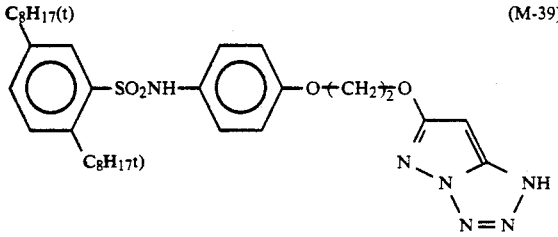

(M-40)

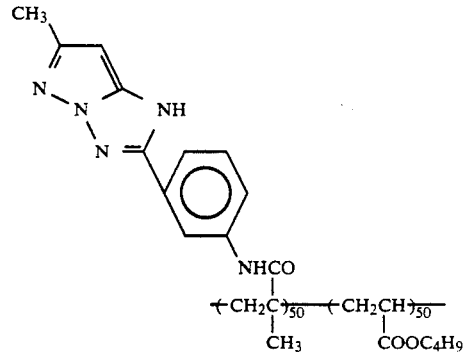

The number is weight %
Mean Molecular Weight: about 30,000

(M-41)

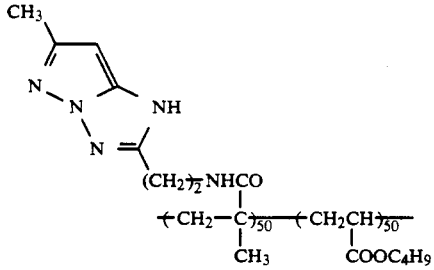

The number is weight %
Mean Molecular Weight: about 20,000

In the present invention, the coating amount of the 4-equivalent magenta coupler is preferably from $0.4\times10^{-3}$ to $3.5\times10^{-3}$ mol per square mater of the color photographic material. Additionally, the 4-equivalent magenta coupler may be used together with a 2-equivalent magenta.

A cyan coupler can be used in the color photographic material, such as phenolic couplers and naphtholic couplers and those cyan couplers described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent Publication (OLS) 3,329,729, European Patents 121,365A and 249,453A, U.S. Pat. Nos. 3,446,622, 4,333,999, 4,753,871, 4,451,559, 4,427,767, 4,690,889, 4,254,212, 4,296,199, JP-A-3-196037 and JP-A-61-42658.

Also, pyrrolotriazole, pyrroloimidazole, imidazopyrazole, imidazole, pyrazolotriazole and cyclic active methine based cyan couplers such as those described in Japanese Patent Application Nos. 2-302078, 2-322051, 3-226325 and 3-236894, JP-A-64-32260 and JP-A-141745 are particularly preferably.

Particularly, pyrrolotriazole, pyrroloimidazole, imidazopyrazole, imidazole, pyrazolotriazole, a cyclic active methine coupler (e.g., those described in JP-A-2-302078, JP-A-2-322051, JP-A-3-226325, JP-A-3-236894, JP-A-64-32250, and JP-A-2-141745) are preferred.

A colored coupler for correcting unnecessary absorption of colored dye can be used in the present invention. Preferred colored couplers are described in *Research Disclosure,* No. 17643, VII-G, U.S. Pat. Nos. 4,163,670, 4,004,929, and 4,138,258, JP-B-57-39413, British Patent 1,146,368, and Japanese Patent Application No. 2-50137. Also preferred are couplers for correcting unnecessary absorption of a colored dye by a fluorescent dye released therefrom at coupling as described in U.S. Pat. No. 4,774,181. Couplers having a dye precursor capable of forming a dye by reacting with a color developing agent as a releasing group described in U.S. Pat. No. 4,777,120 is preferably used in this invention.

In the present invention, a coupler giving a colored dye having a proper diffusibility can be also used in this invention. Preferred couplers are described in U.S. Pat. No. 4,366,237, British Patent 2,125,570, European Patent 96,570 and West German Patent Publication (OLS) 3,234,533.

Also, in the present invention, polymerized dye-forming couplers can be used. Typical examples of the polymerized coupler are described in U.S. Pat. Nos. 3,451,820, 4,080,211, 4,367,282, 4,409,320, and 4,576,910, and British Patent 2,102,173.

Furthermore, preferred couplers release a photographically useful residue upon coupling. Preferably, the couplers imagewise releasing a nucleating agent or a developing accelerator are described in British Patents 2,097,140 and 2,131,188, JP-A-59-157638 and JP-A-5970840.

Other couplers in the color photographic materials processed by this invention are competing couplers described in U.S. Pat. No. 4,130,427, couplers releasing a dye which is color-restored described in European Patent 173,302A, bleaching accelerator-releasing couplers described in *Research Disclosure,* No. 11449, ibid., No. 24241, and JP-A-61-201247, ligand-releasing couplers described in U.S. Pat. No. 4,553,477, couplers releasing a leuco dye described in JP A-63-75747, and couplers releasing a fluorescent dye described in U.S. Pat. No. 4,774,181.

The couplers for use in this invention can be introduced into color photographic light-sensitive materials by various dispersion methods.

An oil drop-in-water dispersion method of a high-boiling point organic solvent are described in U.S. Pat. No. 2,322,027, etc. Practical examples of a high-boiling point organic solvent (boiling point of 175° C. or more at normal pressure) used for the oil drop-in-water dispersion method include phthalic acid esters [e.g., dibutyl phthalate, dicyclohexyl phthalate, di-2-ethylhexyl phthalate, decylphthalate, bis(2,4-di-amylphenyl)phthalate, bis(2,4-di-t-amylhenyl)isophthalate, and bis(1,1-diethylpropyl)phthalate], phosphoric acid esters and phosphonic acid eaters (e.g., triphenyl phosphate, tricresyl phosphate, 2-ethyl-hexyldiphenyl phosphate, trichlorohexyl phosphate, tri-2-ethylhexyl phosphate, tridecyl phosphate, tributoxyethyl phosphate, trichloropropyl phosphate, and di-2-ethylhexylphenyl phosphonate), benzoic acid esters (e.g., 2-ethylhexyl benzoate, dodecyl benzoate, and 2-ethylhexyl-p-hydroxy benzoate), amides (e.g., N,N-diethyldodecanamido, N,N-diethyllaurylamide, and N-tetradecylpyrrolidone), alcohols and phenols (e.g., isostearyl alcohol and 2,4-di-tert-amylphenol), aliphatic carboxylic acid esters [e.g., bis(2-ethylhexyl)sebacate, dioctyl azelate, glycerol tributyrate, isostearyl lactate, and trioctyl citrate], aniline derivatives (e.g., N,N-dibutyl-2-butoxy-5-tert-octylaniline), and hydrocarbons (e.g., paraffin, dodecylbenzene, and diisopropylnaphthalene).

Also, an organic solvent (boiling point of about 30° C. or more, and preferably from about 50° C. to 160° C.) can be used as an auxiliary solvent in dispersion methods. Typical examples are ethyl acetate, butyl acetate, ethyl propionate, methyl ethyl ketone, cyclohexanone, 2-ethoxyethyl acetate, and dimethylformamide.

Further, it is preferred that a compound represented by formula (A), (B) or (C) described in JP-A-4-70653 are used as a high-boiling point organic solvent.

A latex dispersion method can also be used. Practical examples of the steps and effects of the latex dispersion method as well as the latexes for impregnation are described in U.S. Pat. No. 4,199,363, West German Patent Publications (OLS) 2,541,274 and 2,541,230.

Also, the couplers can be dispersed by emulsification in an aqueous hydrophilic colloid solution impregnated with a loadable latex polymer and couplers, in the presence or absence of the described high-boiling organic solvent (as described in U.S. Pat. No. 4,203,716), or after dissolving the couplers in a polymer which is insoluble in water but soluble in an organic solvent. Preferred such polymers are the homopolymers or copolymers described in WO(PCT) 88/00723, pages 12 to 30. Acrylamide series polymers are particularly preferred to stabilize dye images.

Supports suitable used for the color photographic materials of the present invention are described in *Research Disclosure,* No. 17643, page 28 and ibid., No. 18716, from page 647, right column to page 648, left column.

Also, it is preferred that the antistatic layer described in JP-A-4-73736 is provided on the surface of the support opposite to the side in which the light-sensitive layer is coated.

The present invention can be applied to various kinds of color photographic materials. Preferably, the invention can be used for processing general or cine color negative photographic films and reversal photographic films for slides or television.

Then, the following examples are intended to illustrate the present invention practically but not to limit it in any way.

EXAMPLE 1

A multilayer color photographic light-sensitive material (sample 101) shown below was prepared and processed by the following processing steps.

The dry thickness of sample 101 excluding the support was 22 μm and the swelling ratio (i.e., the swelling speed) $T\frac{1}{2}$ thereof was 9 seconds.

After applying a stage-wise exposure to sample 101, the sample was processed as follows using an automatic processor.

Processing was continued while replenishing replenishers and when the replenishment amount of the stabilization bath reached thrice the tank volume, the image storage stability of sample 101 processed for each stabilizing time shown in Table A was determined. In addition, the time for the stabilization step was changed by changing the length of the processing rack.

The processing steps and the compositions of the processing solutions used are shown below.

| Step | Processing Time | Processing Temp. (°C.) | Replenishment Amount* (ml) | Tank Volume (liter) |
|---|---|---|---|---|
| Color development | 3 min. & 5 sec. | 38.0 | 600 | 17 |
| Bleaching | 50 sec. | 38.0 | 140 | 5 |
| Blixing | 50 sec. | 38.0 | — | 5 |
| Fixing | 50 sec. | 38.0 | 420 | 5 |
| Washing (1) | 20 sec. | 38.0 | 980 | 3 |
| Washing (2) | 20 sec. | 38.9 | — | 3 |
| Stabilization | shown in Table A | 38.0 | 560 | 3 |
| Drying | 1 min. | 60 | — | — |

*The amount per square meter of the color photographic material.

The wash step was a counter-current system from (2) to (1) and the overflow solution of washing water was all introduced into the fixing bath. In replenishing for the blixing bath, a cut was formed at the upper portion of the bleaching tank and the upper portion of the fixing tank of the automatic processor, whereby all of the overflow solutions from the bleaching tank and the fixing tank occurring by the supply of each replenisher were introduced into the blixing bath.

In addition, the carried amount of the color developer into the bleaching step, the carried amount of the bleaching solution into the blixing step, the carried amount of the blixing solution into the fixing step, and the carried amount of the fixing solution into the washing step were 65 ml, 50 ml, 50 ml, and 50 ml, respectively, per square meter of the color photographic material processed. Also, each cross-over time was 3 seconds and the time was included in the processing time of each pre-step.

Then, the composition of each processing solution is shown below.

| | Starting Solution | Replenisher |
|---|---|---|
| Color developer | | |
| Diethylenetriaminepentaacetic Acid | 2.0 g | 2.0 g |
| 1-Hydroxyethylidene-1,1-diphosphonic Acid | 3.3 g | 3.3 g |
| Sodium Sulfite | 3.9 g | 5.1 g |
| Potassium Carbonate | 37.5 g | 39.0 g |
| Potassium Bromide | 1.4 g | 0.4 g |
| Potassium Iodide | 1.3 mg | — |
| Hydroxylamine Sulfate | 2.4 g | 3.3 g |
| 2-Methyl-4-[N-ethyl-N-(β-hydroxyethyl)amino]aniline Sulfate | 4.5 g | 6.0 g |
| Water to make | 1 liter | 1 liter |
| pH | 10.05 | 10.15 |
| Bleaching Solution | | |
| 1,3-Diaminopropanetetraacetic Acid Ferric Ammonium Monohydrate | 130 g | 195 g |
| Ammonium Bromide | 80 g | 120 g |
| Ammonium Nitrate | 15 g | 25 g |
| Hydroxyacetic Acid | 50 g | 75 g |
| Acetic Acid | 40 g | 60 g |
| Water to make | 1 liter | 1 liter |
| pH (adjusted with aqueous ammonia) | 4.3 | 4.0 |

Blixing Solution

A mixture of the above bleach starting solution and the fix starting solution shown below at 15/85 by volume ratio (pH 7.0).

| Fixing Replenisher | |
|---|---|
| Ammonium Sulfite | 55 g |
| Aqueous Solution of Ammonium Thiosulfate (700 g/liter) | 840 ml |
| Imidazole | 50 g |
| Ethylenediaminetetraacetic Acid | 40 g |
| Water to make | 1 liter |
| pH (adjusted with aqueous ammonia and acetic acid) | 7.45 |

Fixing Starting Solution

Solution formed by diluting the fixing replenisher thrice with city water (i.e., tap water) (pH 7.4).

Washing Water

City water was passed through a mixed bed column packed with a H-type strong acidic cation exchange resin (Amberlite IR-120B, trade name, made by Rohm and Haas Co., Ltd.) and an OH-type strong basic anion exchange resin (Amberlite IRA-400, trade name, made by the aforesaid company) to reduce the concentrations of calcium and magnesium below 3 mg/liter and then 29 mg/liter of sodium dichloroisocyanurate and 150 mg/liter of sodium sulfate were added to water thus treated. The pH of the solution was in the range of from 6.5 to 7.5.

| Stabilizing Solution | Starting Solution = Relenisher |
|---|---|
| Sodium p-Toluenesulfinic Acid | 0.1 g |
| Polyoxyethylene-p-monononyl Phenyl Ether (average polymerization degree: 10) | 0.2 g |
| Ethylenediaminetetraacetic Acid Di-Sodium Salt | 0.05 g |
| Image Stabilizer (shown in Table A) | Shown in Table A |
| Water to make | 1 liter |
| pH | 7.2 |

Evaluation of Image Storage Stability

The magenta density of each processed sample was measured using a photographic densitometer FSD 103 (trade name, manufactured by Fuji Photo Film Co., Ltd.). Thereafter, the sample was allowed to stand for 2 weeks under the conditions of 60° C. 20% RH and then the magenta density was measured again. Thus, magenta fading was evaluated by the reduced magenta density in the density stage that the magenta density after processing was 1.5. (M fading)

Measurement of Formaldehyde Vapor Pressure

Each stabilizing solution having the foregoing composition was prepared, placed in a small-sized automatic processor placed in a small room of 20 $m^3$, and after 2 hours of processing, the formaldehyde vapor in the small room was collected in a formaldehyde correction tube (made by Sperco Co.) and determined by a gas chromatography. (HCHO concentration)

The kind and amount of each compound and results of each evaluation are shown in Table A.

TABLE A

| No. | Image Stabilizer | Amount (mmol/l) | HCHO Concentration (ppm) | M Fading Stabilization Time 10 sec. | 20 sec. | 60 sec. | |
|---|---|---|---|---|---|---|---|
| 1 | Formaldehyde | 27 | 1.81 | 0.03 | 0.00 | 0.00 | Comparison |
| 2 | do | 5 | 0.35 | 0.20 | 0.15 | 0.08 | " |
| 3 | Hexamethylenetetramine | 27 | 0.07 | 0.28 | 0.27 | 0.28 | " |
| 4 | do | 5 | less than 0.03 | 0.30 | 0.31 | 0.30 | " |
| 5 | Formaldehyde | 5 | 0.04 | 0.20 | 0.12 | 0.09 | " |
| | Compound I-2 | 15 | | | | | |
| 6 | Formaldehyde | 5 | 0.08 | 0.21 | 0.16 | 0.12 | " |
| | Compound I-4 | 20 | | | | | |
| 7 | Compound A-11 | 5 | 0.20 | 0.10 | 0.05 | 0.00 | " |
| 8 | Compound A-16 | 5 | 0.16 | 0.02 | 0.00 | 0.00 | " |
| 9 | Compound A-17 | 5 | 0.18 | 0.02 | 0.01 | 0.00 | " |
| 10 | Compound A-22 | 5 | 0.09 | 0.01 | 0.00 | 0.00 | " |
| 11 | Compound A-23 | 5 | 0.10 | 0.00 | 0.00 | 0.00 | " |
| 12 | Compound A-26 | 5 | 0.13 | 0.03 | 0.01 | 0.01 | " |
| 13 | Compound A-45 | 5 | 0.18 | 0.04 | 0.01 | 0.01 | " |
| 14 | Compound A-11 | 5 | 0.02 | 0.03 | 0.00 | 0.00 | Invention |
| | Compound I-17 | 10 | | | | | |
| 15 | Compound A-16 | 5 | less than 0.01 | 0.02 | 0.00 | 0.00 | " |
| | Compound I-2 | 10 | | | | | |
| 16 | Compound A-17 | 5 | less than 0.01 | 0.02 | 0.00 | 0.00 | " |
| | Compound I-2 | 10 | | | | | |
| 17 | Compound A-22 | 5 | less than 0.01 | 0.01 | 0.00 | 0.00 | " |
| | Compound I-2 | 10 | | | | | |
| 18 | Compound A-23 | 5 | less than 0.01 | 0.01 | 0.00 | 0.00 | " |
| | Compound I-4 | 10 | | | | | |
| 19 | Compound A-26 | 5 | less than 0.01 | 0.01 | 0.00 | 0.00 | " |
| | Compound I-4 | 10 | | | | | |
| 20 | Compound A-45 | 5 | 0.01 | 0.02 | 0.01 | 0.00 | " |
| | Compound I-4 | 10 | | | | | |

As is apparent from the results shown in Table A, the conventional stabilizing solutions containing formaldehyde generate a formaldehyde gas. If the formaldehyde concentration in the solution is reduced, the concentration of the formaldehyde gas is lowered but even in this case, the concentration of the gas is insufficient from the working environment allowable concentration of formaldehyde gas as well as in this case, the fading inhibition effect is reduced. Also, in the case of using hexamethylenetetramine which is the known substitute for formaldehyde, the fading inhibition effect is insufficient even when a large amount of the compound is used. Furthermore, in the case of using only the compound represented by formula (A) for use in the present invention or in the case of using the compound represented by formula (I) together with formaldehyde which is a known image stabilizer, the fading inhibition effect is yet insufficient. In the former case, the reduction of a formaldehyde gas is insufficient and in the latter case, the reduction of a formaldehyde gas may be attained but the image stabilization in the short-time processing is insufficient.

On the other hand, in the case of using the compound of formula (A) and the compound of formula (I) together according to the present invention, formaldehyde gas is scarcely generated and in short-time processing, an excellent image stabilization effect is obtained as compared with the case of using formalin.

Sample 101 was prepared as follows.

Also, when each of samples 102 to 105 shown below was processed by the same manner as above, almost the same effect as above was obtained.

In addition, the marks showing the additives have the following meanings. However, when the additive has plural functions, one of them is shown as the representation.

UV: Ultraviolet absorber; Solv: High-boiling point organic solvent; ExF: Dye; ExS: Sensitizing dye; ExC: Cyan coupler; ExM: Magenta coupler; ExY: Yellow coupler; Cpd: additive.

Also, the coating amount was represented by a g/m$^2$ unit of silver on the silver halide emulsion and colloidal silver, by a g/m$^2$ unit on the couplers, dyes, the additives and gelatin, and by mol number per mol of the silver halide in a same emulsion layer on the sensitizing dye.

Preparation of Sample 101

A multilayer color photographic material (sample 101) having each layer of the following composition on a cellulose triacetate film support having a subbing layer was prepared.

| | |
|---|---|
| Layer 1 (Antihalation Layer) | |
| Black Colloidal Silver | 0.24 as Ag |
| Gelatin | 2.02 |
| UV-3 | $4.4 \times 10^{-2}$ |
| UV-4 | $8.8 \times 10^{-2}$ |
| UV-5 | $10.0 \times 10^{-2}$ |
| Solv-2 | 0.30 |
| Layer 2 (Interlayer) | |
| Gelatin | 1.51 |
| Layer 3 (Low-Speed Red-Sensitive Emulsion Layer) | |
| Silver Iodobromide Emulsion (AgI: 10 mol %, inside high AgI type, core/shell ratio: 1:2, sphere-corresponding diameter: 0.93 μm, variation coeff. of sphere-corresponding diameters: 43%, tabular grains, aspect ratio: 2.0) | 1.80 as Ag |
| Silver Iodobromide Emulsion (AgI: 4.0 mol%, inside high AgI type, core/shell ratio: 1:2, sphere-corresponding diameter: 0.45 μm, variation coeff. of sphere-corresponding diameters: 5%, tetradecahedral grains) | 0.75 as Ag |
| Silver Iodobromide Emulsion | 0.52 as Ag |

-continued

| | |
|---|---|
| (AgI: 6 mol %, inside high AgI type, core/shell ratio: 1:2, sphere-corresponding diameter: 0.62 μm, variation coeff. of sphere-corresponding diameters: 12%, tabular grains, aspect ratio: 2.0) | |
| Gelatin | 5.20 |
| ExS-12 | $5.16 \times 10^{-3}$ |
| ExS-1 | $2.84 \times 10^{-3}$ |
| ExS-3 | $3.80 \times 10^{-4}$ |
| ExS-13 | $4.6 \times 10^{-4}$ |
| ExC-10 | 0.84 |
| ExC-3 | $3.6 \times 10^{-2}$ |
| ExC-4 | $5.0 \times 10^{-2}$ |
| ExY-4 | $4.2 \times 10^{-2}$ |
| Solv 1 | 0.38 |
| Solv-2 | 0.76 |
| Layer 4 (High-Speed Red-Sensitive Emulsion Layer) | |
| Silver Iodobromide Emulsion (AgI: 10.0 mol %, inside high AgI type, core/shell ratio: 1:2, sphere-corresponding diameter: 0.98 μm, variation coeff. of sphere-corresponding diameters: 43%, tabular grains, aspect ratio: 3.0) | 0.88 as Ag |
| Gelatin | 0.86 |
| ExS-12 | $0.13 \times 10^{-3}$ |
| ExS-1 | $0.70 \times 10^{-3}$ |
| ExS-3 | $0.92 \times 10^{-4}$ |
| ExS-13 | $0.12 \times 10^{-4}$ |
| ExC-10 | $2.90 \times 10^{-2}$ |
| ExC-4 | $6.20 \times 10^{-2}$ |
| ExC-5 | $6.60 \times 10^{-2}$ |
| Solv-1 | 0.18 |
| Layer 5 (Interlayer) | |
| Gelatin | 0.94 |
| Cpd-5 | $3.20 \times 10^{-2}$ |
| Polyethyl Acrylate Latex | 0.24 |
| Solv-1 | $5.0 \times 10^{-2}$ |
| Solv-2 | $2.1 \times 10^{-2}$ |
| Layer 6 (Low-Speed Green Sensitive Emulsion Layer) | |
| Silver Iodobromide Emulsion (AgI: 6.0 mol %, inside high AgI type, core/shell ratio: 1:2, sphere-corresponding diameter: 0.60 μm, variation coeff. of sphere-corresponding diameters: 15%, tabular grains, aspect ratio: 2.0) | 0.68 as Ag |
| Silver Iodobromide Emulsion (AgI: 4.0 mol %, inside high AgI type, core/shell ratio: 1:2, sphere-corresponding diameter: 0.45 μm, variation coeff. of sphere-corresponding diameters: 10%, tetradecahedral grains) | 0.32 as Ag |
| Silver Iodobromide Emulsion (AgI: 4.0 mol %, inside high AgI type, core/shell ratio: 1:2, sphere-corresponding diameter: 0.52 μm, variation coeff. of sphere-corresponding diameters: 23%, tabular grains, aspect ratio: 2.0) | 0.23 as Ag |
| Gelatin | 1.77 |
| ExS-14 | $2.21 \times 10^{-3}$ |
| ExS-4 | $2.19 \times 10^{-3}$ |
| ExS-15 | $2.32 \times 10^{-3}$ |
| ExM-18 | 0.48 |
| ExM-2 | $3.1 \times 10^{-2}$ |
| ExM-6 | 0.15 |
| ExM-9 | $2.0 \times 10^{-2}$ |
| ExY-4 | $3.1 \times 10^{-2}$ |
| Solv-1 | 0.40 |
| Layer 7 (High-Speed Green-Sensitive Emulsion Layer) | |
| Silver Iodobromide Emulsion (AgI: 10 mol %, inside high AgI type, core/shell ratio: 1:2, sphere-corresponding diameter: 0.93 μm, variation coeff. of sphere-corresponding diameters: 43%, tabular grains, aspect ratio: 3.0) | 0.57 as Ag |
| Silver Iodobromide Emulsion (AgI: 10 mol %, inside high AgI type, core/shell ratio: 1:2, sphere-corresponding diameter: 0.75 μm, variation coeff. of sphere-corresponding diameters: 33%, tabular grains, aspect ratio: 3.5) | 0.38 as Ag |
| Gelatin | 1.21 |
| ExS-14 | $1.06 \times 10^{-3}$ |
| ExS-4 | $1.05 \times 10^{-3}$ |
| ExS-15 | $1.11 \times 10^{-3}$ |
| ExM-10 | $5.1 \times 10^{-2}$ |
| ExM-11 | $0.9 \times 10^{-2}$ |
| ExM-12 | $1.7 \times 10^{-2}$ |
| ExM-6 | $2.4 \times 10^{-2}$ |
| Cpd-5 | $1.4 \times 10^{-2}$ |
| Solv-1 | 0.21 |
| Solv-2 | $3.0 \times 10^{-2}$ |
| Layer 8 (Yellow Filter Layer) | |
| Yellow Colloidal Silver | 0.12 as Ag |
| Gelatin | 1.58 |
| Cpd-5 | 0.13 |
| Solv-1 | 0.21 |
| Solv-2 | $8.6 \times 10^{-2}$ |
| Polyethylene Acrylate Latex | 0.31 |
| Layer 9 (Low-Speed Blue-Sensitive Emulsion Layer) | |
| Silver Iodobromide Emulsion (AgI: 10 mol %, inside high AgI type, core/shell ratio: 1:2, sphere-corresponding diameter: 0.98 μm, variation coeff. of sphere corresponding diameters: 43%, tabular grains, aspect ratio: 3.0) | 0.25 as Ag |
| Silver Iodobromide Emulsion (AgI: 4 mol %, inside high AgI type, core/shell ratio: 1:2, sphere-corresponding diameter: 0.35 μm, variation coeff. of sphere-corresponding diameters: 13%, tetradecahedral grains) | 0.11 as Ag |
| Silver Iodobromide Emulsion (AgI: 8 mol %, inside high AgI type, core/shell ratio: 1:2, sphere-corresponding diameter: 0.55 μm, variation coeff. of sphere-corresponding diameters: 8%, octahedral grains) | 0.14 as Ag |
| Gelatin | 1.77 |
| ExY-1 | 0.97 |
| ExY-2 | $6.9 \times 10^{-2}$ |
| Cpd-5 | $1.2 \times 10^{-2}$ |
| Solv-1 | 0.32 |
| Layer 10 (Interlayer) | |
| Gelatin | 0.56 |
| ExY-2 | 0.12 |
| Solv-1 | 0.26 |
| Layer 11 (High Speed Blue-Sensitive Emulsion Layer) | |
| Silver Iodobromide Emulsion (AgI: 10 mol %, inside high AgI type, core/shell ratio: 1:2, sphere-corresponding diameter: 1.45 μm, variation coeff. of sphere-corresponding diameters: 23%, tabular grains, aspect ratio: 3.0) | 0.87 as Ag |
| Silver Iodobromide Emulsion (AgI: 10 mol %, inside high AgI type, core/shell ratio: 1:2, sphere-corresponding diameter: 0.75 μm, variation coeff. of sphere-corresponding diameters: 23%, tabular grains, aspect ratio: 2.5) | 0.42 as Ag |
| Gelatin | 2.05 |
| ExY-1 | 0.23 |
| Cpd-5 | $2.7 \times 10^{-3}$ |
| Solv-1 | $7.7 \times 10^{-2}$ |
| Polyethyl Acrylate Latex | 0.48 |
| Layer 12 (Interlayer) | |
| Fine-Grain Silver Iodobromide Emulsion (AgI: 1.0 mol %, uniform AgI type, sphere-corresponding | 0.26 as Ag |

-continued

| | |
|---|---|
| diameter: 0.07 μm) | |
| Gelatin | 0.74 |
| UV-1 | 0.11 |
| UV-2 | 0.17 |
| Solv-4 | $1.9 \times 10^{-2}$ |
| Polyethyl Acrylate Latex | $8.7 \times 10^{-2}$ |
| Layer 13 (Protective Layer) | |
| Gelatin | 0.47 |
| B-1 (diameter: 1.5 μm) | $3.0 \times 10^{-2}$ |
| B-2 (diameter: 1.5 μm) | $3.6 \times 10^{-2}$ |
| B-3 | $1.8 \times 10^{-2}$ |
| W-5 | $1.8 \times 10^{-2}$ |
| H-1 | 0.24 |

The sample thus-prepared further contained 1,2-benzisothiazolin-3-one in an average amount of 200 ppm based on gelatin, n-butyl-p-hydroxybenzoate in an average amount of about 1,000 ppm based on gelatin and 2-phenoxyethanol in an average amount of about 10,000 ppm based on gelatin in addition to the foregoing components. Furthermore, the sample contained B-4, B-5, F-1, F-2, F-3, F-4, F-5, F-6, F-7, F-8, F-9, F-10, F-11, F-12, F-13, an iron salt, a lead salt, a gold salt, a platinum salt, an iridium salt, and a rhodium salt.

Also, each layer further contained surface active agents W-2, W-5, and W-4 as a coating aid and an emulsification dispersing agent.

Preparation of Sample 102

A multilayer color photographic material (sample 102) having each layer of the following composition on a cellulose triacetate film support having a subbing layer was prepared.

| | |
|---|---|
| Layer 1 (Antihalation Layer) | |
| Black Colloidal Silver | 0.20 as Ag |
| Gelatin | 2.20 |
| UV-1 | 0.11 |
| UV-2 | 0.20 |
| Cpd-1 | $4.0 \times 10^{-2}$ |
| Cpd-2 | $1.9 \times 10^{-2}$ |
| Solv-1 | 0.30 |
| Solv-2 | $1.2 \times 10^{-2}$ |
| Layer 2 (Interlayer) | |
| Fine-Grain Silver Iodobromide (AgI: 1.0 mol %, sphere-corresponding diameter: 0.07 μm) | 0.15 as Ag |
| Gelatin | 1.00 |
| ExC-4 | $6.0 \times 10^{-2}$ |
| Cpd-3 | $2.0 \times 10^{-2}$ |
| Layer 3 (1st Red-Sensitive Emulsion Layer) | |
| Silver Iodobromide Emulsion (AgI: 5.0 mol %, surface high AgI type, sphere-corresponding diameter: 0.9 μm, variation coeff. of sphere-corresponding diameters: 21%, tabular grains, aspect ratio: 7.5) | 0.42 as Ag |
| Silver Iodobromide Emulsion (AgI: 4.0 mol %, inside high AgI type, sphere-corresponding diameter: 0.4 μm, variation coeff. of sphere-corresponding diameters: 18%, tetradecahedral grains) | 0.40 as Ag |
| Gelatin | 1.90 |
| ExS-1 | $4.5 \times 10^{-4}$ mol |
| ExS-2 | $1.5 \times 10^{-4}$ mol |
| ExS-3 | $4.0 \times 10^{-5}$ mol |
| ExC-1 | 0.65 |
| ExC-3 | $1.0 \times 10^{-2}$ |
| ExC-4 | $2.3 \times 10^{-2}$ |
| Solv-1 | 0.32 |
| Layer 4 (2nd Red-Sensitive Emulsion Layer) | |
| Silver Iodobromide Emulsion (AgI: 8.5 mol %, inside high AgI type, sphere-corresponding diameter: 1.0 μm, variation coeff. of sphere-corresponding diameters: 25%, tabular grains, aspect ratio: 3.0) | 0.85 as Ag |
| Gelatin | 0.91 |
| ExS-1 | $3.0 \times 10^{-4}$ mol |
| ExS-2 | $1.0 \times 10^{-4}$ mol |
| ExS-3 | $3.0 \times 10^{-5}$ mol |
| ExC-1 | 0.13 |
| ExC-2 | $6.2 \times 10^{-2}$ |
| ExC-4 | $4.0 \times 10^{-2}$ |
| Solv-1 | 0.10 |
| Layer 5 (3rd Red-Sensitive Emulsion Layer) | |
| Silver Iodobromide Emulsion (AgI: 11.3 mol %, inside high AgI type, sphere-corresponding diameter: 1.4 μm, variation coeff. of sphere-corresponding diameters: 28%, tabular grains, aspect ratio: 6.0) | 1.50 as Ag |
| Gelatin | 1.20 |
| ExS-1 | $2.0 \times 10^{-4}$ mol |
| ExS-2 | $6.0 \times 10^{-5}$ mol |
| ExS-3 | $2.0 \times 10^{-5}$ mol |
| ExC-2 | $8.5 \times 10^{-2}$ |
| ExC-5 | $7.3 \times 10^{-2}$ |
| ExC-6 | $1.0 \times 10^{-2}$ |
| Solv-1 | 0.12 |
| Solv-2 | 0.12 |
| Layer 6 (Interlayer) | |
| Gelatin | 1.00 |
| Cpd-4 | $8.0 \times 10^{-2}$ |
| Solv- 1 | $8.0 \times 10^{-2}$ |
| Layer 7 (lst Green-Sensitive Emulsion Layer) | |
| Silver Iodobromide Emulsion (AgI: 5.0 mol %, surface high AgI type, sphere-corresponding diameter: 0.9 μm, variation coeff. of sphere-corresponding diameters: 21%, tabular grains, aspect ratio: 7.0) | 0.28 as Ag |
| Silver Iodobromide Emulsion (AgI: 4.0 mol %, inside high AgI type, sphere-corresponding diameter: 0.4 μm, variation coeff. of sphere-corresponding diameters: 18%, tetradecahedral grains) | 0.16 as Ag |
| Gelatin | 1.20 |
| ExS-4 | $5.0 \times 10^{-4}$ mol |
| ExS-5 | $2.0 \times 10^{-4}$ mol |
| ExS-6 | $1.0 \times 10^{-4}$ mol |
| ExM-1 | 0.50 |
| ExM-2 | 0.10 |
| ExM-5 | $3.5 \times 10^{-2}$ |
| Solv-1 | 0.20 |
| Cpd-16 | $3.0 \times 10^{-2}$ |
| Layer 8 (2nd Green-Sensitive Emulsion Layer) | |
| Silver Iodobromide Emulsion (AgI: 8.5 mol %, inside high AgI type, sphere-corresponding diameter: 1.0 μm, variation coeff. of sphere-corresponding diameters: 25%, tabular grains, aspect ratio: 3.0) | 0.57 as Ag |
| Gelatin | 0.45 |
| ExS-4 | $3.5 \times 10^{-4}$ mol |
| ExS-5 | $1.4 \times 10^{-4}$ mol |
| ExS-6 | $7.0 \times 10^{-5}$ mol |
| ExM-1 | 0.12 |
| ExM-2 | $7.1 \times 10^{-3}$ |
| ExM-3 | $3.5 \times 10^{-2}$ |
| Solv-1 | 0.15 |
| Cpd-16 | $1.0 \times 10^{-2}$ |
| Layer 9 (Interlayer) | |
| Gelatin | 0.5 |
| Solv-1 | $2.0 \times 10^{-2}$ |
| Layer 10 (3rd Green-Sensitive Emulsion Layer) | |
| Silver Iodobromide Emulsion (AgI: 11.3 mol %, inside high AgI type, sphere-corresponding diameter: 1.4 μm, variation coeff. of sphere-corresponding diameters, tabular grains, aspect ratio: 6.0) | 1.30 as Ag |
| Gelatin | 1.20 |
| ExS-4 | $2.0 \times 10^{-4}$ mol |
| ExS-5 | $8.0 \times 10^{-5}$ mol |
| ExS-6 | $8.0 \times 10^{-5}$ mol |
| ExM-4 | $5.8 \times 10^{-2}$ |
| ExM-6 | $5.0 \times 10^{-3}$ |
| ExC-2 | $4.5 \times 10^{-3}$ |
| Cpd-5 | $1.0 \times 10^{-2}$ |
| Solv-1 | 0.25 |

-continued

| | |
|---|---|
| Layer 11 (Yellow Filter Layer) | |
| Gelatin | 0.50 |
| Cpd-6 | $5.2 \times 10^{-2}$ |
| Solv-1 | 0.12 |
| Layer 12 (Interlayer) | |
| Gelatin | 0.45 |
| Cpd-3 | 0.10 |
| Layer 13 (1st Blue-Sensitive Emulsion Layer) | |
| Silver Iodobromide Emulsion (AgI: 2 mol %, Uniform AgI type, sphere-corresponding diameter: 0.55 μm, variation coeff. of sphere-corresponding diameters: 25%, tabular grains, aspect ratio: 7.0) | 0.20 as Ag |
| Gelatin | 1.00 |
| ExS-7 | $3.0 \times 10^{-4}$ mol |
| ExY-1 | 0.60 |
| ExY-2 | $2.3 \times 10^{-2}$ |
| Solv-1 | 0.15 |
| Layer 14 (2nd Blue-Sensitive Emulsion Layer) | |
| Silver Iodobromide Emulsion (AgI: 19.0 mol %, inside high AgI type, sphere-corresponding diameter: 1.0 μm, variation coeff. of sphere-corresponding diameters: 16%, octahedral grains) | 0.19 as Ag |
| Gelatin | 0.35 |
| ExS-7 | $2.0 \times 10^{-4}$ mol |
| ExY-1 | 0.22 |
| Solv-1 | $7.0 \times 10^{-2}$ |
| Layer 15 (Interlayer) | |
| Fine-Grain Silver Iodobromide (AgI: 2 mol %, uniform AgI type, sphere-corresponding diameter: 0.13 μm) | 0.20 as Ag |
| Gelatin | 0.36 |
| Layer 16 (3rd Blue-Sensitive Emulsion Layer) | |
| Silver Iodobromide Emulsion (AgI: 14.0 mol %, inside high AgI type, sphere-corresponding diameter: 1.7 μm, variation coeff. of shere-corresponding diameters: 28%, tabular grains, aspect ratio: 5.0) | 1.55 as Ag |
| Gelatin | 1.00 |
| ExS-8 | $1.5 \times 10^{-4}$ mol |
| ExY-1 | 0.21 |
| Solv-1 | $7.0 \times 10^{-2}$ |
| Layer 17 (1st Protective Layer) | |
| Gelatin | 1.80 |
| UV-1 | 0.13 |
| UV-2 | 0.21 |
| Solv-1 | $1.0 \times 10^{-2}$ |
| Solv-2 | $1.0 \times 10^{-2}$ |
| Layer 18 (2nd Protective Layer) | |
| Fine Grain Silver Chloride (sphere-corresponding diameter: 0.07 μm) | 0.36 as Ag |
| Gelatin | 0.70 |
| B-1 (diameter: 1.5 μm) | $2.0 \times 10^{-2}$ |
| B-2 (diameter: 1.5 μm) | 0.15 |
| B-3 | $3.0 \times 10^{-2}$ |
| W-1 | $2.0 \times 10^{-2}$ |
| Cpd-7 | 1.00 |

The sample thus prepared further contained 1,2-benzisothiazolin-3-one in an average amount of 200 ppm based on gelatin, n-butyl-p-hydroxy benzoate in an average amount of about 1,000 ppm based on gelatin, and 2-phenoxy ethanol in an average amount of about 10,000 ppm based on gelatin in addition to the above components. Furthermore, the sample contained B-4, B-5, W-2, W-3, F-1, F-2, F-3, F-4, F-5, F-6, F-7, F-8, F-9, F-10, F-11, F-12, F-13, an iron salt, a lead salt, a gold salt, a platinum salt, an iridium salt, and a rhodium salt.

Preparation of Sample 103

A multilayer color photographic material (sample 103) having each layer of the following composition on a cellulose triacetate film support having a subbing layer was prepared.

| | |
|---|---|
| Layer 1 (Antihalation Layer) | |
| Black Colloidal Silver | 0.15 as Ag |
| Gelatin | 1.90 |
| ExM-6 | $5.0 \times 10^{-3}$ |
| Layer 2 (Interlayer) | |
| Gelatin | 2.10 |
| UV-3 | $3.0 \times 10^{-2}$ |
| UV-4 | $6.0 \times 10^{-2}$ |
| UV-5 | $7.0 \times 10^{-2}$ |
| ExF-1 | $4.0 \times 10^{-3}$ |
| Solv-2 | $7.0 \times 10^{-2}$ |
| Layer 3 (Low-Speed Red-Sensitive Emulsion Layer) | |
| Silver Iodobromide Emulsion (AgI: 2 mol %, inside high AgI type, sphere-corresponding diameter: 0.3 μm, variation coeff. of sphere-corresponding diameters: 29%, normal crystal-twin crystal mixed grains, aspect ratio: 2.5) | 0.50 as Ag |
| Gelatin | 1.50 |
| ExS-2 | $1.0 \times 10^{-4}$ |
| ExS-1 | $3.0 \times 10^{-4}$ |
| ExS-3 | $1.0 \times 10^{-5}$ |
| ExC-8 | 0.11 |
| ExC-1 | 0.11 |
| ExC-9 | $3.0 \times 10^{-2}$ |
| ExC-6 | $1.0 \times 10^{-2}$ |
| Solv-1 | $7.0 \times 10^{-3}$ |
| Layer 4 (Medium-Speed Red-Sensitive Emulsion Layer) | |
| Silver Iodobromide Emulsion (AgI: 4 mol %, inside high AgI type, sphere-corresponding diameter: 0.55 μm, variation coeff. of sphere-corresponding diameters: 20%, normal crystal-twin crystal mixed grains, aspect ratio: 1.0) | 0.85 as Ag |
| Gelatin | 2.00 |
| ExS-2 | $1.0 \times 10^{-4}$ |
| ExS-1 | $3.0 \times 10^{-4}$ |
| ExS-3 | $1.0 \times 10^{-5}$ |
| ExC-8 | 0.16 |
| ExC-4 | $8.0 \times 10^{-2}$ |
| ExC-1 | 0.17 |
| ExC-6 | $1.5 \times 10^{-2}$ |
| ExY-3 | $2.0 \times 10^{-2}$ |
| ExY-4 | $1.0 \times 10^{-2}$ |
| F-3 | $1.0 \times 10^{-4}$ |
| Solv-1 | 0.10 |
| Layer 5 (High-Speed Red-Sensitive Emulsion Layer) | |
| Silver Iodobromide Emulsion (AgI: 10 mol %, inside high AgI type, sphere-corresponding diameter: 0.7 μm, variation coeff. of sphere-corresponding diameters: 30%, normal crystal-twin crystal mixed grains, aspect ratio: 2.0) | 0.70 as Ag |
| Gelatin | 1.60 |
| ExS-2 | $1.0 \times 10^{-4}$ |
| ExS-1 | $3.0 \times 10^{-4}$ |
| ExS-3 | $1.0 \times 10^{-5}$ |
| ExC-10 | $7.0 \times 10^{-2}$ |
| ExC-11 | $8.0 \times 10^{-2}$ |
| ExC-6 | $1.5 \times 10^{-2}$ |
| Solv-1 | 0.15 |
| Solv-2 | $8.0 \times 10^{-2}$ |
| Layer 6 (Interlayer) | |
| Gelatin | 1.10 |
| P-2 | 0.17 |
| Cpd-4 | 0.10 |
| Cpd-9 | 0.17 |
| Solv-1 | $5.0 \times 10^{-2}$ |
| Layer 7 (Low Speed Green-Sensitive Emulsion Layer) | |
| Silver Iodobromide Emulsion (AgI: 2 mol %, inside high AgI type, sphere-corresponding diameter: 0.3 μm, variation coeff. of sphere-corresponding diameters: 28%, normal crystal-twin crystal mixed grains, aspect ratio: 2.5) | 0.30 as Ag |
| Gelatin | 0.50 |
| ExS-9 | $5.0 \times 10^{-4}$ |
| ExS-5 | $2.0 \times 10^{-4}$ |

-continued

| | |
|---|---|
| ExS-6 | $0.3 \times 10^{-4}$ |
| ExM-6 | $3.0 \times 10^{-2}$ |
| ExM-1 | 0.20 |
| ExY-3 | $3.0 \times 10^{-2}$ |
| Cpd-16 | $7.0 \times 10^{-3}$ |
| Solv-1 | 0.20 |
| Layer 8 (Medium-Speed Green-Sensitive Emulsion Layer) | |
| Silver Iodobromide Emulsion (AgI: 4 mol %, inside high AgI type, sphere-corresponding diameter: 0.55 μm, variation coeff. of sphere-corresponding diameters: 20%, normal crystal-twin crystal mixed grains, aspect ratio: 4.0) | 0.70 as Ag |
| Gelatin | 1.00 |
| ExS-9 | $5.0 \times 10^{-4}$ |
| ExS-5 | $2.0 \times 10^{-4}$ |
| ExS-6 | $3.0 \times 10^{-5}$ |
| ExM-6 | $3.0 \times 10^{-2}$ |
| ExM-1 | 0.25 |
| ExM-3 | $1.5 \times 10^{-2}$ |
| ExY-3 | $4.0 \times 10^{-2}$ |
| Cpd-16 | $9.0 \times 10^{-3}$ |
| Solv-1 | 0.20 |
| Layer 9 (High-Speed Green Sensitive Emulsion Layer) | |
| Silver Iodobromide Emulsion (AgI: 10 mol %, inside high AgI type, sphere-corresponding diameter: 0.7 μm, variation coeff. of sphere-corresponding diameters: 30%, normal crystal-twin crystal mixed grains, aspect ratio: 2.0) | 0.50 as Ag |
| Gelatin | 0.90 |
| ExS-9 | $2.0 \times 10^{-4}$ |
| ExS-5 | $2.0 \times 10^{-4}$ |
| ExS-6 | $2.0 \times 10^{-5}$ |
| ExS-10 | $3.0 \times 10^{-4}$ |
| ExM-6 | $1.0 \times 10^{-2}$ |
| ExM-7 | $3.9 \times 10^{-2}$ |
| ExM-4 | $2.6 \times 10^{-2}$ |
| Cpd-5 | $1.0 \times 10^{-2}$ |
| Cpd-14 | $2.0 \times 10^{-4}$ |
| F-3 | $2.0 \times 10^{-4}$ |
| Solv-1 | 0.20 |
| Solv-2 | $5.0 \times 10^{-2}$ |
| Layer 10 (Yellow Filter Layer) | |
| Gelatin | 0.90 |
| Yellow Colloidal Silver | $5.0 \times 10^{-2}$ as Ag |
| Cpd-4 | 0.20 |
| Solv-1 | 0.15 |
| Layer 11 (Low-Speed Blue-Sensitive Emulsion Layer) | |
| Silver Iodobromide Emulsion (AgI: 4 mol %, inside high AgI type, sphere-corresponding diameter: 0.5 μm, variation coeff. of sphere-corresponding diameters: 15%, octahedral grains) | 0.40 as Ag |
| Gelatin | 1.00 |
| ExS-11 | $2.0 \times 10^{-4}$ |
| ExY-3 | $9.0 \times 10^{-2}$ |
| ExY-1 | 0.90 |
| Cpd-5 | $1.0 \times 10^{-2}$ |
| Solv-1 | 0.30 |
| Layer 12 (High-Speed Blue-Sensitive Emulsion Layer) | |
| Silver Iodobromide Emulsion (AgI: 10 mol %, inside high AgI type, sphere-corresponding diameter: 1.3 μm, variation coeff. of sphere-corresponding diameters: 25%, normal crystal-twin crystal mixed grains, aspect ratio: 4.5) | 0.50 as Ag |
| Gelatin | 0.60 |
| ExS-11 | $1.0 \times 10^{-4}$ |
| ExY-1 | 0.12 |
| Cpd-5 | $1.0 \times 10^{-3}$ |
| Solv-1 | $4.0 \times 10^{-2}$ |
| Layer 13 (1st Protective Layer) | |
| Fine-Grain Silver Iodobromide (mean grain size: 0.07 μm, AgI: 1 mol %) | 0.20 as Ag |
| Gelatin | 0.80 |
| UV-4 | 0.10 |
| UV-5 | 0.10 |
| UV-2 | 0.20 |

-continued

| | |
|---|---|
| Solv-3 | $4.0 \times 10^{-2}$ |
| P-2 | $9.0 \times 10^{-2}$ |
| Layer 14 (2nd Protective Layer) | |
| Gelatin | 0.90 |
| B-1 (diameter: 1.5 μm) | 0.10 |
| B-2 (diameter: 1.5 μm) | 0.10 |
| B-3 | $2.0 \times 10^{-2}$ |
| H-1 | 0.40 |

Furthermore, the above sample contained Cpd-8, Cpd-10, Cpd-11, Cpd-12, Cpd-13, P-1, W-2, W-4, and W-5 for improving the storage stability, processing property, pressure resistance, antibacterial and antifungal property, antistatic property and coating property.

Also, the sample contained n-butyl-p-hydroxy benzoate, B-4, F-1, F-4, F-5, F-6, F-7, F-9, F-10, F-11, F-13, an iron salt, a lead salt, a gold salt, a platinum salt, an iridium salt, and a rhodium salt.

Preparation of Sample 104

A multilayer color photographic material (sample 104) having each layer of the following composition on a cellulose triacetate film support having a subbing layer was prepared.

| | |
|---|---|
| Layer 1 (Antihalation Layer) | |
| Black Colloidal Silver | 0.15 |
| Gelatin | 2.33 |
| ExM-4 | 0.11 |
| UV-3 | $3.0 \times 10^{-2}$ |
| UV-4 | $6.0 \times 10^{-2}$ |
| UV-5 | $7.0 \times 10^{-2}$ |
| Solv-1 | 0.16 |
| Solv-2 | 0.10 |
| ExF-2 | $1.0 \times 10^{-2}$ |
| ExF-3 | $4.0 \times 10^{-2}$ |
| ExF-1 | $5.0 \times 10^{-3}$ |
| Cpd-12 | $1.0 \times 10^{-3}$ |
| Layer 2 (Low-Speed Red-Sensitive Emulsion Layer) | |
| Silver Iodobromide Emulsion (AgI: 4.0 mol %, uniform AgI type, sphere-corresponding diameter: 0.4 μm, variation coeff. of sphere-corresponding diameter: 30%, tabular grains, aspect ratio: 3.0) | 0.35 as Ag |
| Silver Iodobromide Emulsion (AgI: 6.0 mol %, inside high AgI type, core/shell ratio: 1:2, sphere-corresponding diameter: 0.45 μm, variation coeff. of sphere-corresponding diameters: 23%, tabular grains, aspect ratio: 2.0) | 0.35 as Ag |
| Gelatin | 0.77 |
| ExS-2 | $2.4 \times 10^{-4}$ |
| ExS-1 | $1.4 \times 10^{-4}$ |
| ExS-6 | $2.3 \times 10^{-4}$ |
| ExS-3 | $4.1 \times 10^{-6}$ |
| ExC-1 | 0.09 |
| ExC-9 | $4.0 \times 10^{-2}$ |
| ExC-12 | $8.0 \times 10^{-2}$ |
| ExC-8 | 0.08 |
| Layer 3 (Medium-Speed Red-Sensitive Emulsion Layer) | |
| Silver Iodobromide Emulsion (AgI: 6.0 mol %, inside high AgI type, core/shell ratio: 1:2, sphere-corresponding diameter: 0.65 μm, variation coeff. of sphere-corresponding diameters: 23%, tabular grains, aspect ratio: 2.0) | 0.80 as Ag |
| Gelatin | 1.46 |
| ExS-2 | $2.4 \times 10^{-4}$ |
| ExS-1 | $1.4 \times 10^{-4}$ |
| ExS-6 | $2.4 \times 10^{-4}$ |

-continued

| | |
|---|---|
| ExS-3 | $4.3 \times 10^{-6}$ |
| ExC-1 | 0.19 |
| ExC-9 | $2.0 \times 10^{-2}$ |
| ExC-12 | 0.10 |
| ExC-8 | 0.19 |
| ExC-6 | $2.0 \times 10^{-2}$ |
| ExM-5 | $2.0 \times 10^{-2}$ |
| UV-4 | $5.7 \times 10^{-2}$ |
| UV-5 | $5.7 \times 10^{-2}$ |
| Layer 4 (High-Speed Red-Sensitive Emulsion Layer) | |
| Silver Iodobromide Emulsion (AgI: 9.3 mol %, multilayer structure grains, core/shell ratio of 3:4:2, AgI contents: 24, 0 and 6 mol %, from inside, sphere-corresponding diameter: 0.75 μm, variation coeff. of sphere-corresponding diameters: 23%, tabular grains, aspect ratio: 2.5) | 1.49 as Ag |
| Gelatin | 1.38 |
| ExS-2 | $2.0 \times 10^{-4}$ |
| ExS-1 | $1.1 \times 10^{-4}$ |
| ExS-6 | $1.9 \times 10^{-4}$ |
| ExS-3 | $1.4 \times 10^{-5}$ |
| ExC-1 | $8.0 \times 10^{-2}$ |
| ExC-11 | $9.0 \times 10^{-2}$ |
| ExC-6 | $2.0 \times 10^{-2}$ |
| Solv-1 | 0.20 |
| Solv-2 | 0.53 |
| Layer 5 (Interlayer) | |
| Gelatin | 0.62 |
| Cpd-4 | 0.13 |
| Polyethyl Acrylate Latex | $8.0 \times 10^{-2}$ |
| Solv-1 | $8.0 \times 10^{-2}$ |
| Layer 6 (Low-Speed Green-Sensitive Emulsion Layer) | |
| Silver Iodobromide Emulsion (AgI: 4.0 mol %, uniform AgI type, sphere-corresponding diameter: 0.33 μm, variation coeff. of sphere-corresponding diameters: 37%, tabular grains, aspect ratio: 2.0) | 0.19 as Ag |
| Gelatin | 0.44 |
| ExS-16 | $1.5 \times 10^{-4}$ |
| ExS-4 | $4.4 \times 10^{-4}$ |
| ExS-6 | $9.2 \times 10^{-5}$ |
| ExM-1 | 0.17 |
| ExM-5 | $3.0 \times 10^{-2}$ |
| Solv-1 | 0.13 |
| Cpd-16 | $1.0 \times 10^{-2}$ |
| Layer 7 (Medium-Speed Green-Sensitive Emulsion Layer) | |
| Silver Iodobromide Emulsion (AgI: 4.0 mol %, uniform AgI type, sphere-corresponding diameter: 0.55 μm, variation coeff. of sphere-corresponding diameters: 15%, tabular grains, aspect ratio: 4.0) | 0.24 as Ag |
| Gelatin | 0.54 |
| ExS-16 | $2.1 \times 10^{-4}$ |
| ExS-4 | $6.3 \times 10^{-4}$ |
| ExS-6 | $1.3 \times 10^{-4}$ |
| ExM-1 | 0.15 |
| ExM-5 | $4.0 \times 10^{-2}$ |
| ExY-4 | $3.0 \times 10^{-2}$ |
| Solv-1 | 0.13 |
| Cpd-16 | $1.0 \times 10^{-2}$ |
| Layer 8 (High-Speed Green-Sensitive Emulsion Layer) | |
| Silver Iodobromide Emulsion (AgI: 8.8 mol %, multilayer structure grains, silver amount ratio of 3:4:2, AgI contents: 24, 0 and 3 mol % from inside, sphere-corresponding diameter: 0.75 μm, variation coeff. of sphere-corresponding diameters: 23%, tabular grains, aspect ratio: 1.6) | 0.49 as Ag |
| Gelatin | 0.61 |
| ExS-4 | $4.3 \times 10^{-4}$ |
| ExS-6 | $8.6 \times 10^{-5}$ |

-continued

| | |
|---|---|
| ExS-5 | $2.8 \times 10^{-5}$ |
| ExM-1 | $8.0 \times 10^{-2}$ |
| ExM-6 | $3.0 \times 10^{-2}$ |
| ExY-4 | $3.0 \times 10^{-2}$ |
| ExC-1 | $1.0 \times 10^{-2}$ |
| ExC-11 | $1.0 \times 10^{-2}$ |
| Solv-1 | 0.23 |
| Solv-2 | $5.0 \times 10^{-2}$ |
| Cpd-16 | $1.0 \times 10^{-2}$ |
| Cpd-5 | $1.0 \times 10^{-2}$ |
| Layer 9 (Interlayer) | |
| Gelatin | 0.56 |
| Cpd-4 | $4.0 \times 10^{-2}$ |
| Polyethyl Acrylate Latex | $5.0 \times 10^{-2}$ |
| Solv-1 | $3.0 \times 10^{-2}$ |
| UV-1 | $3.0 \times 10^{-2}$ |
| UV-2 | $4.0 \times 10^{-2}$ |
| Layer 10 (Donor Layer of Inter Layer Effect for Red-Sensitive Emulsion Layer) | |
| Silver Iodobromide Emulsion (AgI: 8.0 mol %, inside high AgI type, core/shell ratio: 1:2, sphere-corresponding diameter: 0.65 μm, variation coeff. of sphere-corresponding diameters: 25%, tabular grains, aspect ratio: 2.0) | 0.67 as Ag |
| Silver Iodobromide Emulsion (AgI: 4.0 mol %, uniform AgI type, sphere-corresponding diameter: 0.4 μm, variation coeff. of sphere-corresponding diameters: 30%, tabular grains, aspect ratio: 3.0) | 0.20 as Ag |
| Gelatin | 0.87 |
| ExS-16 | $6.7 \times 10^{-4}$ |
| ExM-2 | 0.16 |
| Solv-1 | 0.30 |
| Solv-5 | $3.0 \times 10^{-2}$ |
| Layer 11 (Yellow Filter Layer) | |
| Yellow Colloidal Silver | $9.0 \times 10^{2}$ as Ag |
| Gelatin | 0.84 |
| Cpd-15 | 0.13 |
| Solv-1 | 0.13 |
| Cpd-4 | $8.0 \times 10^{-2}$ |
| Cpd-12 | $2.0 \times 10^{-3}$ |
| H-1 | 0.25 |
| Layer 12 (Low-Speed Blue-Sensitive Emulsion Layer) | |
| Silver Iodobromide Emulsion (AgI: 4.5 mol %, uniform AgI type, sphere-corresponding diameter: 0.7 μm, variation coeff. of sphere-corresponding diameters: 15%, tabular grains, aspect ratio: 7.0) | 0.50 as Ag |
| Silver Iodobromide Emulsion (AgI: 3.0 mol %, uniform AgI type, sphere-corresponding diameter: 0.3 μm, variation coeff. of sphere-corresponding diameters: 30%, tabular grains, aspect ratio: 7.0) | 0.30 as Ag |
| Gelatin | 2.18 |
| ExS-7 | $9.0 \times 10^{-4}$ |
| ExC-1 | 0.14 |
| ExY-3 | 0.17 |
| ExY-1 | 1.09 |
| Solv-1 | 0.54 |
| Layer 13 (Interlayer) | |
| Gelatin | 0.40 |
| ExY-2 | 0.19 |
| Solv-1 | 0.19 |
| Layer 14 (High-Speed Blue-Sensitive Emulsion Layer) | |
| Silver Iodobromide Emulsion (AgI: 10.0 mol %, inside high AgI type, sphere-corresponding diameter: 1.0 μm, variation coeff. of sphere-corresponding diameters: 25%, multilayer twin tabular grains, aspect ratio: 2.0) | 0.40 as Ag |
| Gelatin | 0.49 |
| ExS-7 | $2.6 \times 10^{-4}$ |
| ExY-3 | $1.0 \times 10^{-2}$ |

-continued

| | |
|---|---|
| ExY-1 | 0.20 |
| ExC-1 | $1.0 \times 10^{-2}$ |
| Solv-1 | $9.0 \times 10^{-2}$ |
| Layer 15 (1st Protective Layer) | |
| Fine-Grain Silver Iodobromide (AgI: 2.0 mol %, uniform AgI type, sphere-corresponding diameter: 0.07 μm) | 0.12 as Ag |
| Gelatin | 0.63 |
| UV-1 | 0.11 |
| UV-2 | 0.18 |
| Solv-4 | $2.0 \times 10^{-2}$ |
| Cpd-7 | 0.10 |
| Polyethyl Acrylate Latex | $9.0 \times 10^{-2}$ |
| Layer 16 (2nd Protective Layer) | |
| Fine-Grain Silver Iodobromide (AgI: 2.0 mol %, uniform AgI type, sphere-corresponding diameter: 0.07 μm) | 0.36 as Ag |
| Gelatin | 0.85 |
| B-1 (diameter: 1.5 μm) | $8.0 \times 10^{-2}$ |
| B-2 (diameter: 1.5 μm) | $8.0 \times 10^{-2}$ |
| B-3 | $2.0 \times 10^{-2}$ |
| W-5 | $2.0 \times 10^{-2}$ |
| H-1 | 0.18 |

The sample thus-prepared further contained 1,2-benzisothiazolin-3-one in an average amount of 200 ppm based on gelatin, n-butyl-p-hydroxy benzoate in an average amount of about 1,000 ppm based on gelatin, and 2-phenoxy ethanol in an average amount of about 10,000 ppm based on gelatin in addition to the above components.

The sample further contained B-4, B-5, F-1, F-2, F-3, F-4, F-5, F-6, F-7, F-9, F-10, F-11, F-12, F-13, an iron salt, a lead salt, a gold salt, a platinum salt, an iridium salt, and a rhodium salt.

Each layer further contained surface active agents W-2, W-6, and W-4 as a coating aid and an emulsification dispersing agent.

Preparation of Sample 105

A multilayer color photographic material (sample was prepared by multilayer-coating the layers each having the following composition on a cellulose triacetate film support having a subbing layer.

| | |
|---|---|
| Layer 1 (Antihalation Layer) | |
| Black Colloidal Silver | 0.18 as Ag |
| Gelatin | 1.40 |
| Layer 2 (Interlayer) | |
| 2,5-Di-t-pentadecylhydroquinone | 0.18 |
| ExM-6 | 0.18 |
| ExC-4 | 0.020 |
| ExF-1 | $2.0 \times 10^{-3}$ |
| UV-3 | 0.060 |
| UV-4 | 0.080 |
| UV-5 | 0.10 |
| Solv-1 | 0.10 |
| Solv-2 | 0.020 |
| Gelatin | 1.04 |
| Layer 3 (1st Red-Sensitive Emulsion Layer) | |
| Emulsion A | 0.25 as Ag |
| Emulsion B | 0.25 as Ag |
| ExS-2 | $6.9 \times 10^{-5}$ |
| ExS-3 | $1.8 \times 10^{-5}$ |
| ExS-1 | $3.1 \times 10^{-4}$ |
| ExC-1 | 0.17 |
| ExC-9 | 0.020 |
| ExC-8 | 0.17 |
| UV-3 | 0.070 |
| UV-4 | 0.050 |
| UV-5 | 0.070 |
| Solv-1 | 0.060 |

-continued

| | |
|---|---|
| Gelatin | 0.87 |
| Layer 4 (2nd Red-Sensitive Emulsion Layer) | |
| Emulsion G | 1.00 as Ag |
| ExS-2 | $5.1 \times 10^{-5}$ |
| ExS-3 | $1.4 \times 10^{-5}$ |
| ExS-1 | $2.3 \times 10^{-4}$ |
| ExC-1 | 0.20 |
| ExC-4 | 0.050 |
| ExC-9 | 0.015 |
| ExC-8 | 0.20 |
| UV-3 | 0.070 |
| UV-4 | 0.050 |
| UV-5 | 0.070 |
| Gelatin | 1.30 |
| Layer 5 (3rd Red-Sensitive Emulsion Layer | |
| Emulsion D | 1.60 as Ag |
| ExS-2 | $5.4 \times 10^{-5}$ |
| ExS-3 | $1.4 \times 10^{-4}$ |
| ExS-1 | $2.4 \times 10^{-4}$ |
| ExC-1 | 0.097 |
| ExC-4 | 0.010 |
| ExC-11 | 0.080 |
| Solv-1 | 0.22 |
| Solv-2 | 0.10 |
| Gelatin | 1.63 |
| Layer 6 (Interlayer) | |
| Cpd-4 | 0.040 |
| Solv-1 | 0.020 |
| Gelatin | 0.80 |
| Layer 7 (1st Green-Sensitive Emulsion Layer) | |
| Emulsion A | 0.15 as Ag |
| Emulsion B | 0.15 as Ag |
| ExS-6 | $3.0 \times 10^{-5}$ |
| ExS-5 | $1.0 \times 10^{-4}$ |
| ExS-4 | $3.8 \times 10^{-4}$ |
| ExM-6 | 0.021 |
| ExM-1 | 0.26 |
| ExM-3 | 0.030 |
| ExY-3 | 0.025 |
| Solv-1 | 0.10 |
| Cpd-16 | 0.010 |
| Gelatin | 0.63 |
| Layer 8 (2nd Green-Sensitive Emulsion Layer) | |
| Emulsion C | 0.45 as Ag |
| ExS-6 | $2.1 \times 10^{-5}$ |
| ExS-5 | $7.0 \times 10^{-5}$ |
| ExS-4 | $2.6 \times 10^{-4}$ |
| ExM-1 | 0.094 |
| ExM-3 | 0.026 |
| ExY-3 | 0.018 |
| Solv-1 | 0.16 |
| Cpd-16 | $8.0 \times 10^{-3}$ |
| Gelatin | 0.50 |
| Layer 9 (3rd Green-Sensitive Emulsion Layer) | |
| Emulsion E | 1.20 as Ag |
| ExS-6 | $3.5 \times 10^{-5}$ |
| ExS-5 | $8.0 \times 10^{-5}$ |
| ExS-4 | $3.0 \times 10^{-4}$ |
| ExM-6 | 0.013 |
| ExM-7 | 0.065 |
| ExM-4 | 0.019 |
| Solv-1 | 0.25 |
| Solv-2 | 0.10 |
| Gelatin | 1.54 |
| Layer 10 (Yellow Filter Layer) | |
| Yellow Colloidal Silver | 0.050 as Ag |
| Cpd-4 | 0.080 |
| Solv-1 | 0.030 |
| Gelatin | 0.95 |
| Layer 11 (1st Blue-Sensitive Emulsion Layer | |
| Emulsion A | 0.080 as Ag |
| Emulsion B | 0.070 as Ag |
| Emulsion F | 0.070 as Ag |
| ExS-7 | $3.5 \times 10^{-4}$ |
| ExY-3 | 0.042 |
| ExY-1 | 0.72 |
| Solv-1 | 0.28 |
| Gelatin | 1.10 |
| Layer 12 (2nd Blue-Sensitive Emulsion Layer) | |
| Emulsion G | 0.45 as Ag |

-continued

| | |
|---|---|
| ExS-7 | $2.1 \times 10^{-4}$ |
| ExY-1 | 0.15 |
| ExC-9 | $7.0 \times 10^{-3}$ |
| Solv-1 | 0.050 |
| Gelatin | 0.78 |
| Layer 13 (3rd Blue-Sensitive Emulsion Layer) | |
| Emulsion H | 0.77 as Ag |
| ExS-7 | $2.2 \times 10^{-4}$ |
| ExY-1 | 0.20 |
| Solv-1 | 0.070 |
| Gelatin | 0.69 |
| Layer 14 (1st Protective Layer) | |
| Emulsion I | 0.20 as Ag |
| UV-1 | 0.11 |
| UV-2 | 0.17 |
| Solv-1 | $5.0 \times 10^{-2}$ |
| Gelatin | 1.00 |
| Layer 15 (2nd Protective Layer) | |

-continued

| | |
|---|---|
| H-1 | 0.40 |
| B-1 (diameter: 1.7 μm) | $5.0 \times 10^{-2}$ |
| B-2 (diameter: 1.7 μm) | 0.10 |
| B-3 | 0.10 |
| Cpd-7 | 0.20 |
| Gelatin | 1.20 |

Furthermore, the whole layers contained W-1, W-2, W-3, B-4, B-5, F-1, F-2, F-3, F-4, F-5, F-6, F-7, F-8, F-9, F-10, F-11, F-12, F-13, an iron salt, a lead salt, a gold salt, a platinum salt, an iridium salt, and a rhodium salt.

Emulsions A to I (silver iodobromide emulsions) used for the sample are shown in the following table.

TABLE

| Emulsion | Mean AgI Content | Mean Grain Size (μm) | Variation Coefficient of Grain Sizes (%) | Aspect Ratio (diameter/thickness) | Silver Amount ratio (AgI Content %) |
|---|---|---|---|---|---|
| A | 4.0 | 0.45 | 27 | 1 | Core/Shell = ⅓ (13/1), double layer structure grains |
| B | 8.9 | 0.70 | 14 | 1 | Core/Shell = 3/7 (25/2), double layer structure grains |
| C | 10 | 0.75 | 30 | 2 | Core/Shell = ½ (24/3), double layer structure grains |
| D | 16 | 1.05 | 35 | 2 | Core/Shell = 4/6 (40/0), double layer structure grains |
| E | 10 | 1.05 | 35 | 3 | Core/Shell = ½ (24/3), double layer structure grains |
| F | 4.0 | 0.25 | 28 | 1 | Core/Shell = ⅓ (13/1), double layer structure grains |
| G | 14.0 | 0.75 | 25 | 2 | Core/Shell = ½ (42/0), double layer structure grains |
| H | 14.5 | 1.30 | 25 | 3 | Core/Shell = 37/63 (34/3), double layer structure grains |
| I | 1 | 0.07 | 15 | 1 | Uniform grains |

Then, the chemical structural formulae and the chemical names of the compound used for the above samples 101 to 105 are shown below.

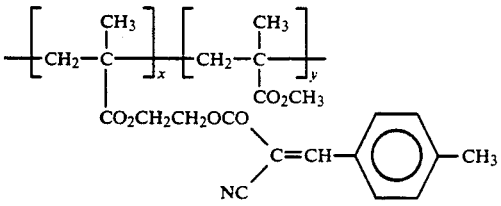

UV-1 x/y = 7/3 (by weight)

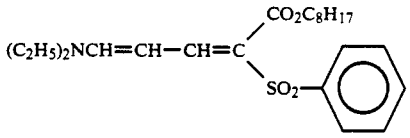

UV-2

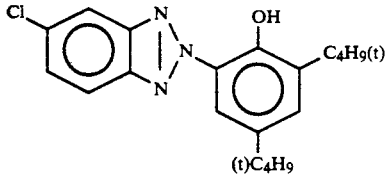

UV-3

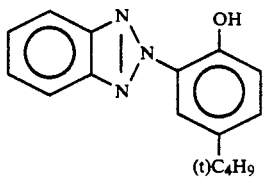

UV-4

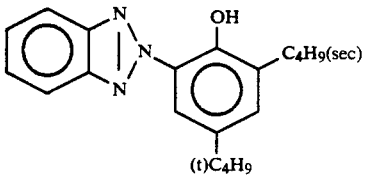

UV-5

Tricresyl Phosphate — Solv-1

Dibutyl Phthalate — Solv-2

Tri(2-ethylhexyl) Phosphate — Solv-3

-continued
Trihexyl Phosphate
Solv-4
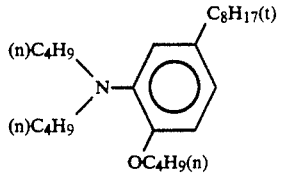
Solv-5
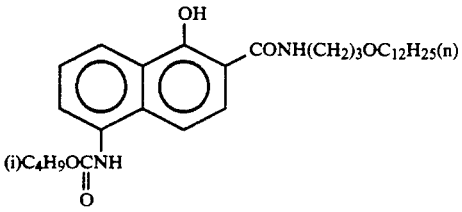
ExC-1
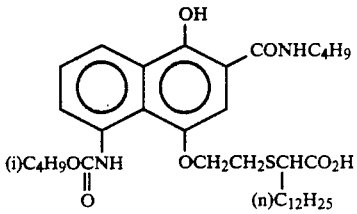
ExC-2
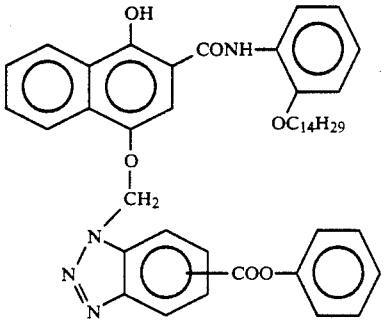
ExC-3
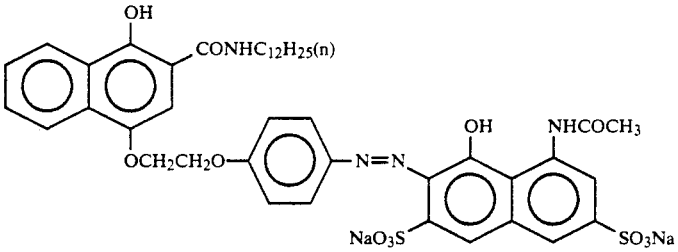
ExC-4
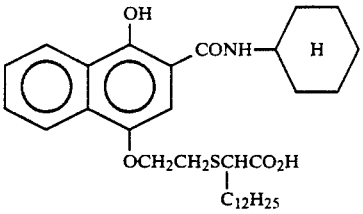
ExC-5
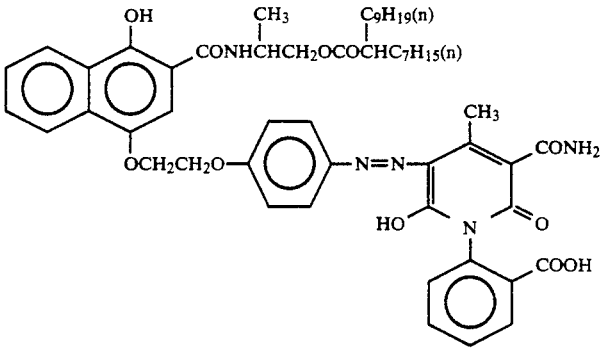
ExC-6

-continued
ExC-8
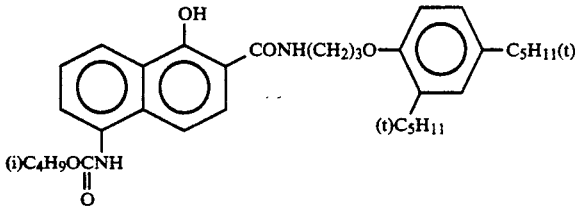
ExC-9
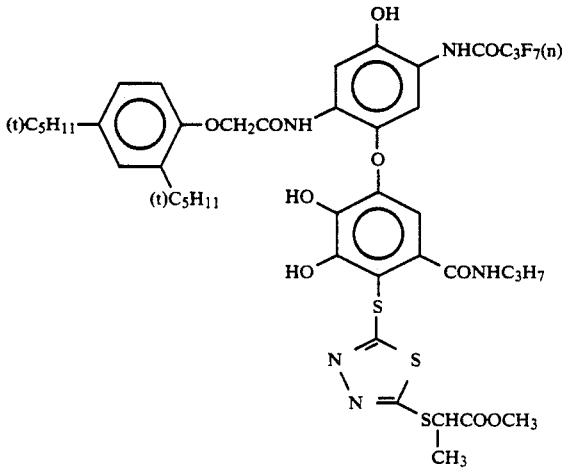
ExC-10
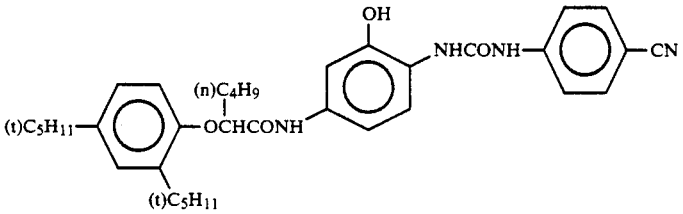
ExC-11
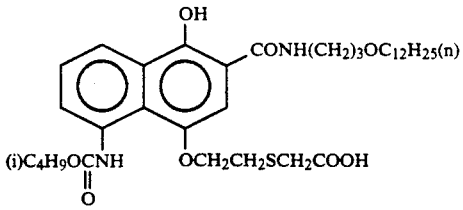
ExC-12
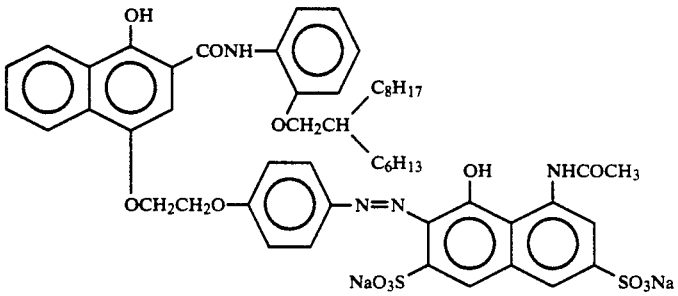

-continued
ExM-1
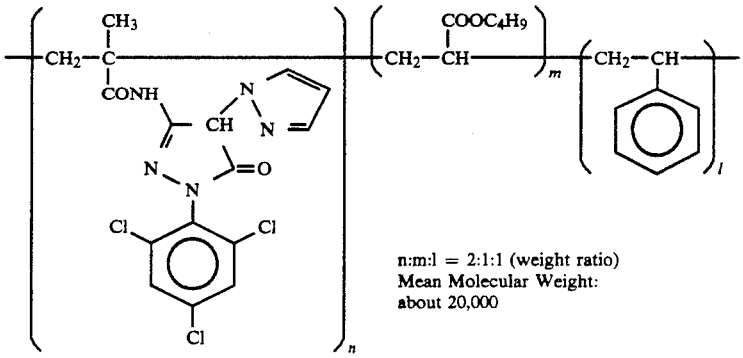
ExM-2
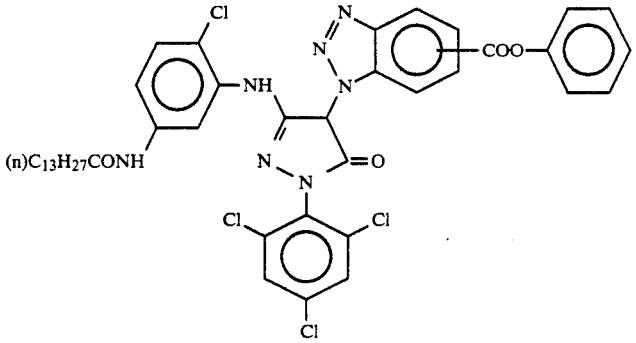
ExM-3
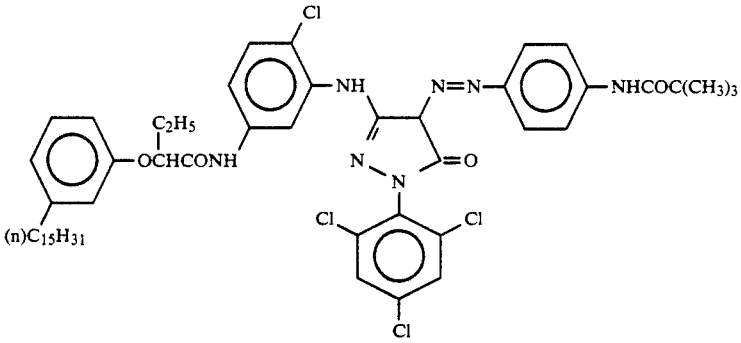
ExM-4
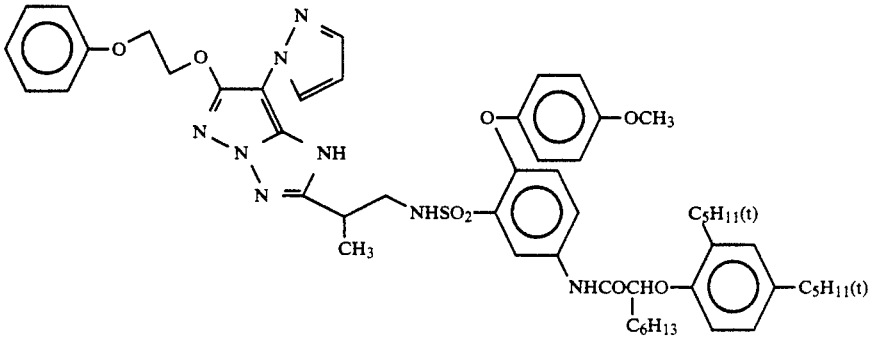

-continued
ExM-5
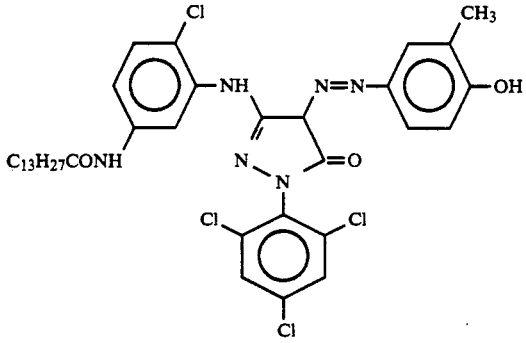
ExM-6
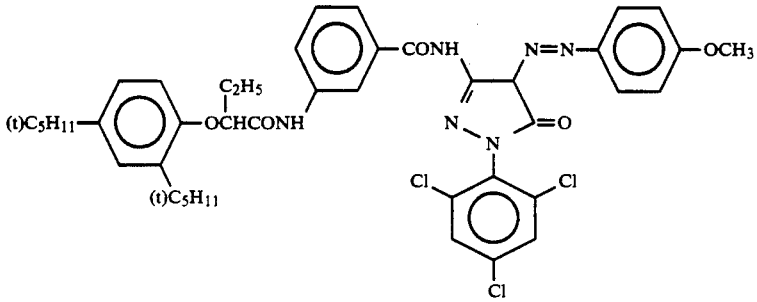
ExM-7
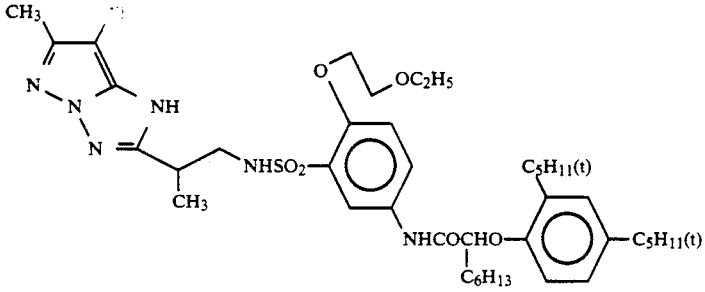
ExM-8
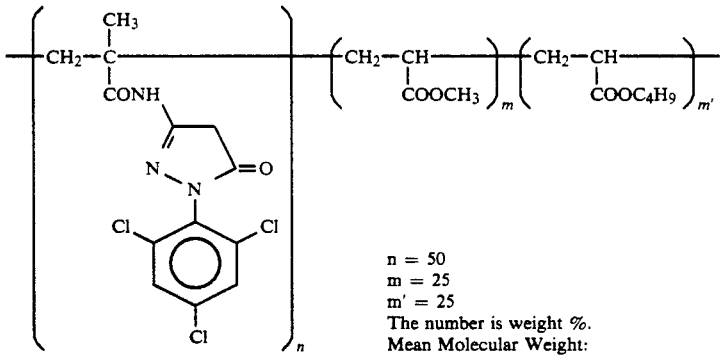
n = 50
m = 25
m' = 25
The number is weight %.
Mean Molecular Weight:
about 40,000
ExM-9
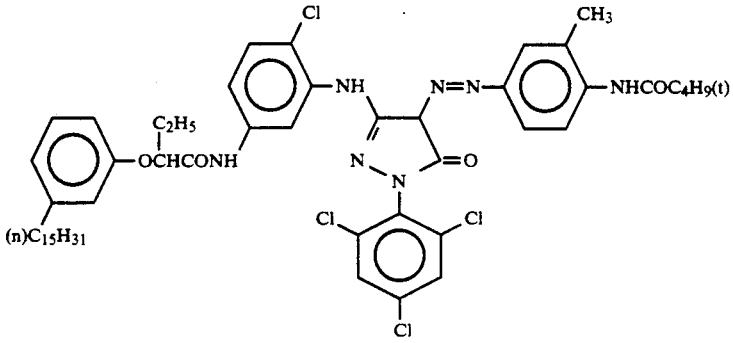

-continued
ExM-10
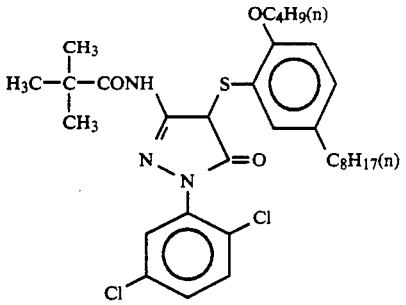
ExM-11
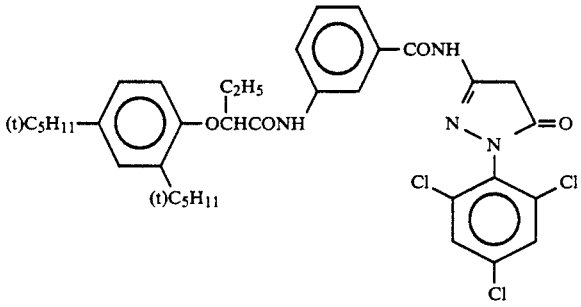
ExM-12
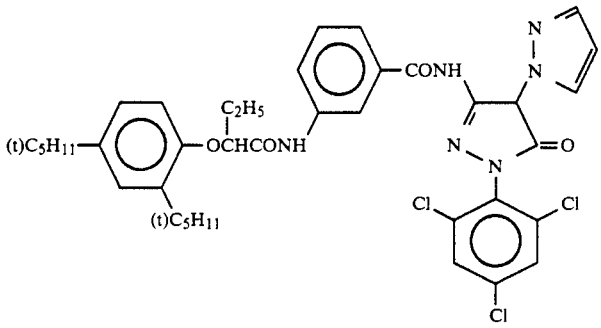
ExY-1
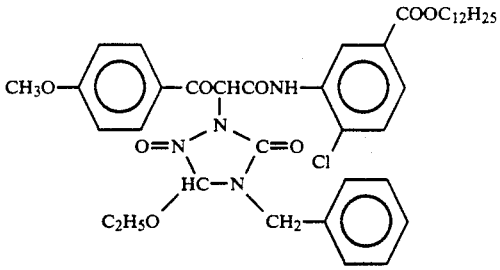
ExY-2
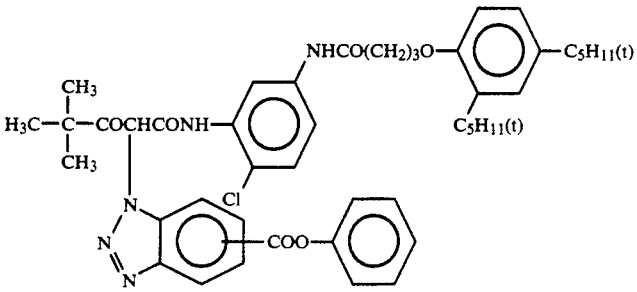

-continued
ExY-3
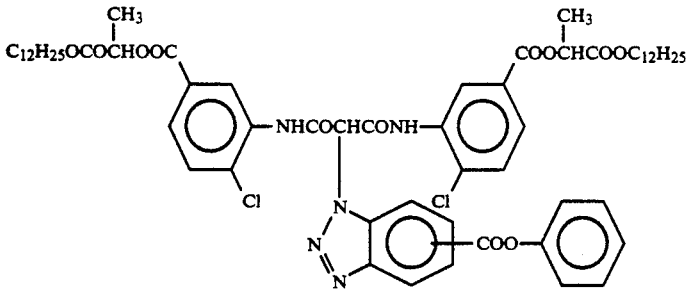
ExY-4
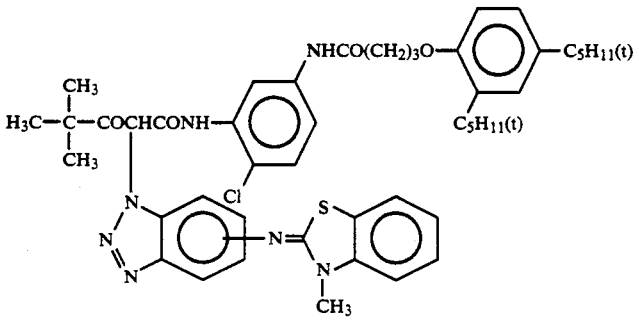
Cpd-1
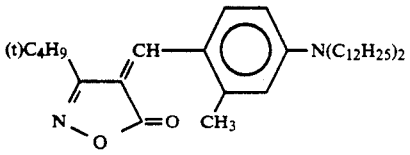
Cpd-2
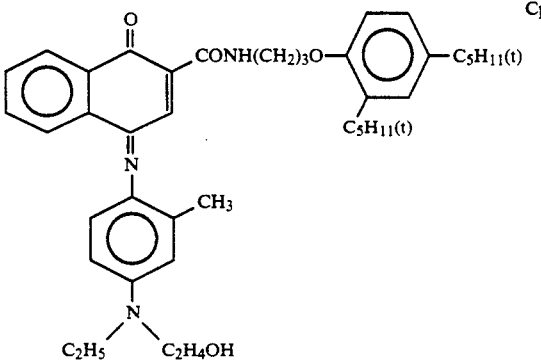
Cpd-3
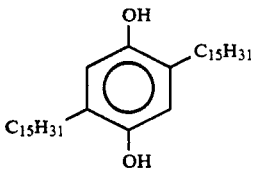
Cpd-4
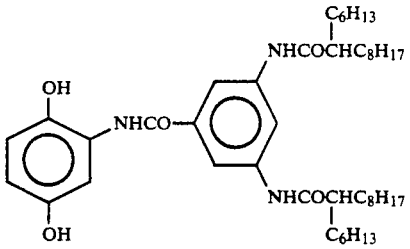
Cpd-5
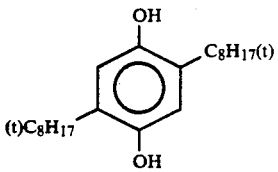
Cpd-6
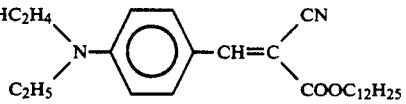
Cpd-7
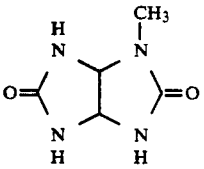
Cpd-8
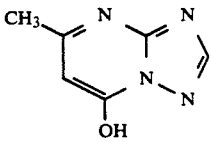

-continued
Cpd-9
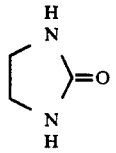
Cpd-10
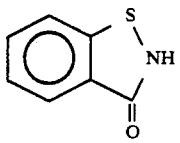
Cpd-11
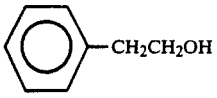
Cpd-12
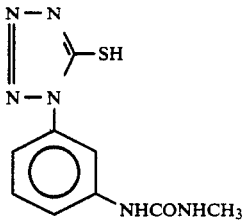
Cpd-13
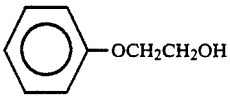
Cpd-14
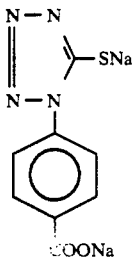
Cpd-15
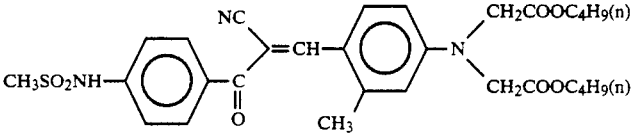
Cpd-16
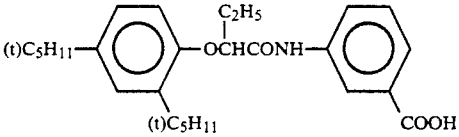
ExS-1
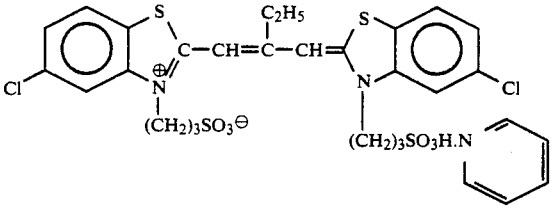
ExS-2
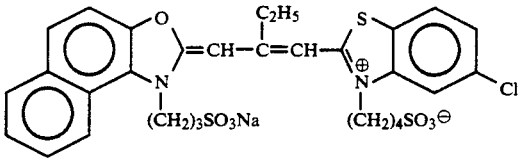
ExS-3
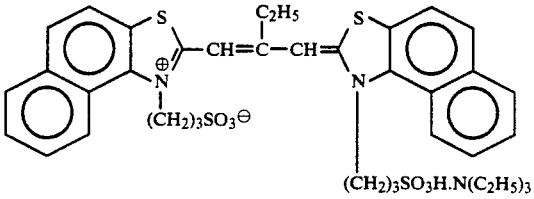

-continued
ExS-4
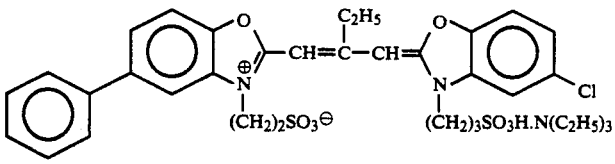
ExS-5
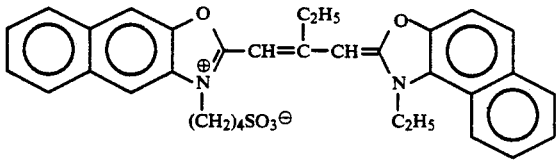
ExS-6
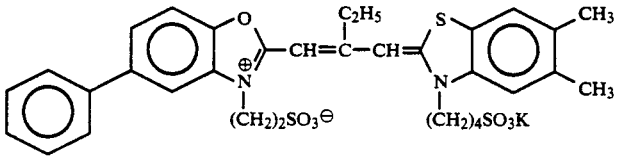
ExS-7
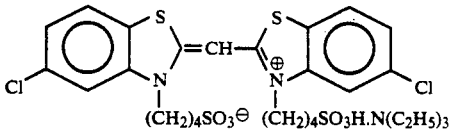
ExS-8
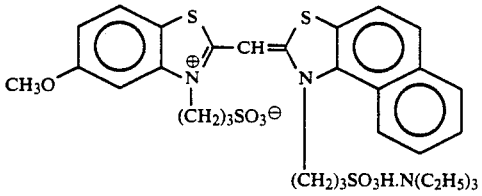
ExS-9
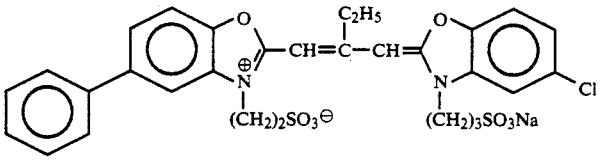
ExS-10
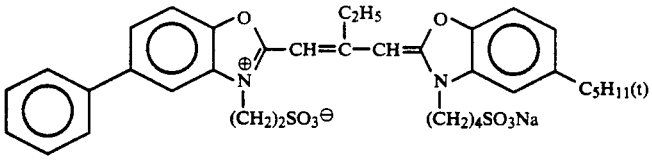
ExS-11
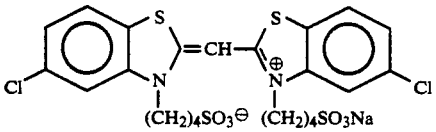
ExS-12
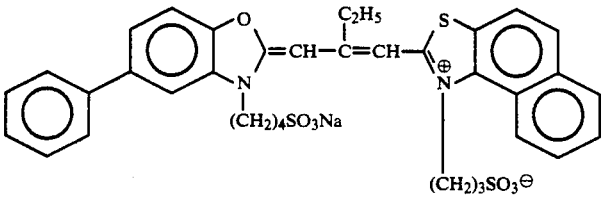

-continued
ExS-13
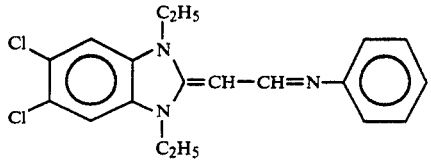
ExS-14
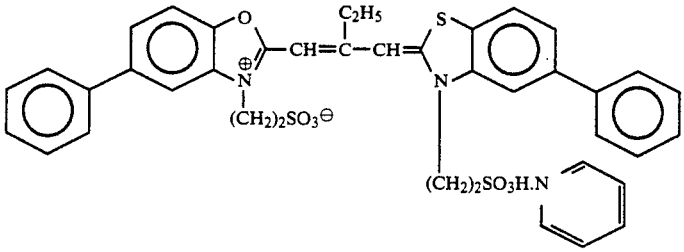
ExS-15
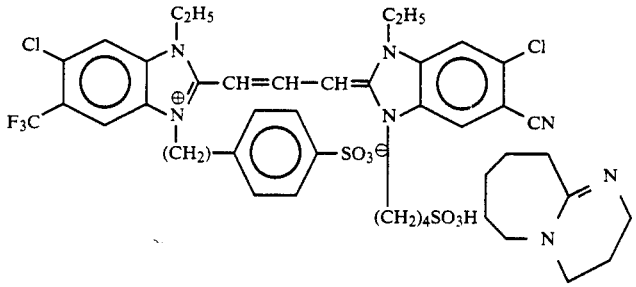
ExS-16
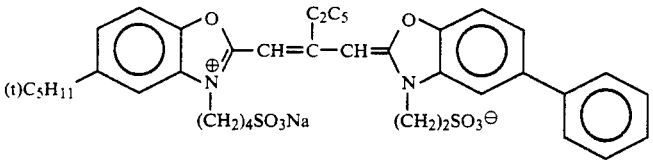
B-1
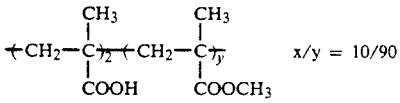
x/y = 10/90
B-2
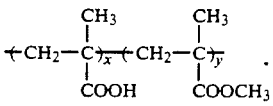
x/y = 40/60
B-3
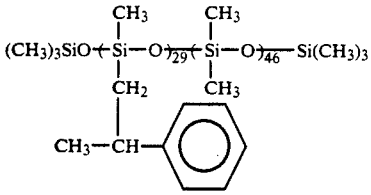
B-4
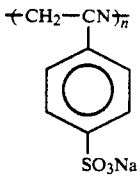
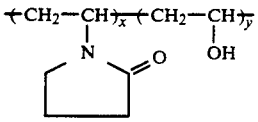
x/y = 70/30
B-5
ExF-1
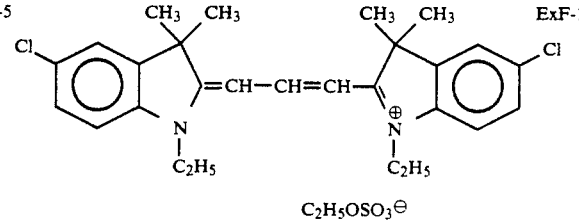

-continued
ExF-2
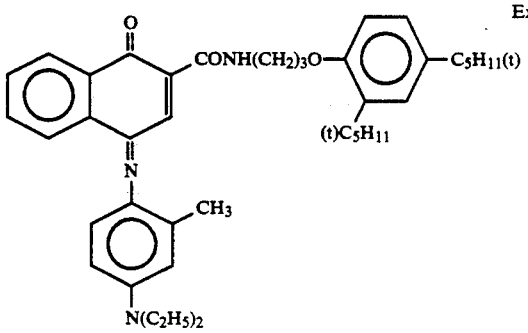
ExF-3
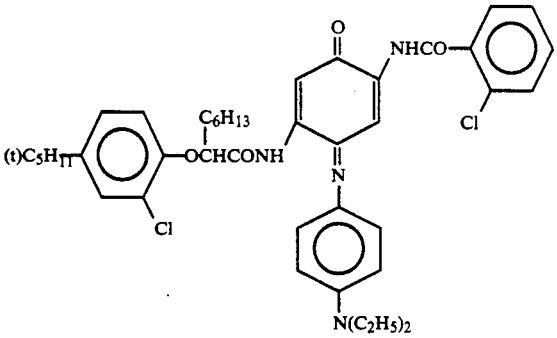
H-1
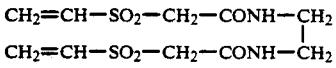
W-1
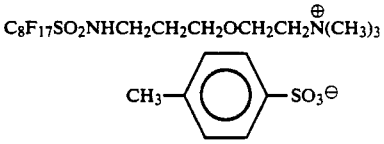
W-2
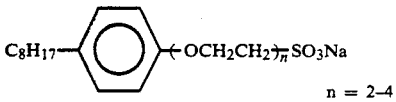
n = 2–4
W-3
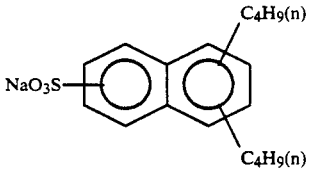
W-4
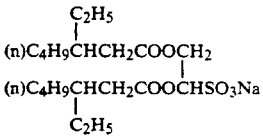
W-5
$C_8F_{17}SO_2N(C_3H_7)CH_2COOK$
W-6
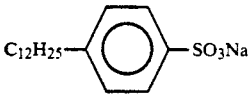
P-1
Copolymer (70/30 by weight) of Vinylpyrrolidone and Vinylalcohol
Polyethylacrylate
P-2
F-1
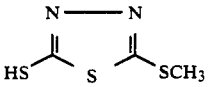
F-2
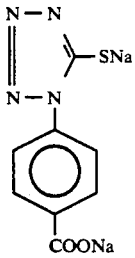
F-3
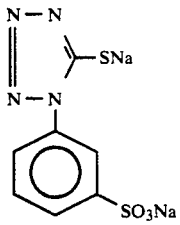
F-4
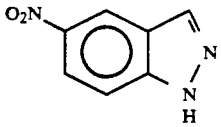
F-5
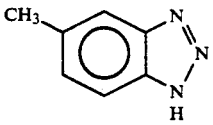
F-6
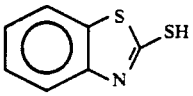
F-7
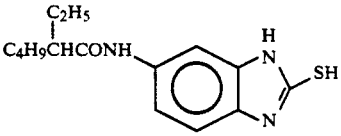

-continued

F-8

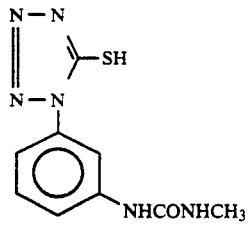

F-9

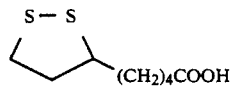

F-10

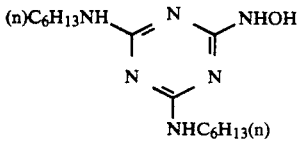

F-11

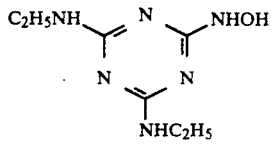

F-12

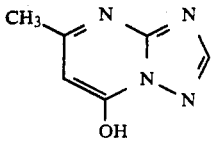

F-13

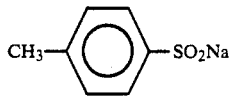

EXAMPLE 2

The following processing steps were carried out using the following processing solutions and a cine type automatic processor. Sample 101 was processed in the processing steps with each stabilizing solution shown in Example 1 and the test for the image storage stability was carried out, as in the same manner as in Example 1.

| Step | Processing step Time | Temperature (°C.) | Replenishment Amount* (ml) | Tank Volume (l) |
|---|---|---|---|---|
| Color Development | 3 min. 15 sec. | 38 | 20 | 20 |
| Bleaching | 3 min. 30 sec. | 38 | 25 | 40 |
| Washing | 70 min. | 24 | 1200 | 20 |
| Fixing | 3 min. 20 sec. | 38 | 25 | 30 |
| Washing (1) | 65 sec. | 24 | — | 10 |
| Washing (2) | 1 min. | 24 | 1200 | 10 |
| Stabilization | 65 sec. | 38 | 25 | 10 |
| Drying | 3 min. 20 sec. | 55 | — | — |

*Amount per 35 mm in width and 1 meter in length
Washing step was by a counter-current system from washing (2) to washing (1).

Then, the composition of each processing solution was shown below.

| | Starting Solution | Replenisher |
|---|---|---|
| Color Developer | | |
| Diethylenetriaminepentaacetic Acid | 1.0 g | 1.1 g |
| 1-Hydroxyethylidene-1,1-diphosphonic Acid | 3.0 g | 3.2 g |
| Sodium Sulfite | 4.0 g | 4.4 g |
| Potassium Carbonate | 30.0 g | 37.0 g |
| Potassium Bromide | 1.4 g | 0.3 g |
| Potassium Iodide | 1.5 mg | — |
| Hydroxylamine Sulfate | 2.4 g | 2.8 g |
| 4-[N-Ethyl-N-β-hydroxyethylamino]-2-methylaniline Sulfate | 4.5 g | 6.0 g |
| Water to make | 1 liter | 1 liter |
| pH | 10.05 | 10.15 |
| Bleaching Solution | | |

-continued

| | Starting Solution | Replenisher |
|---|---|---|
| Ethylenediaminetetraacetic Acid Ferric Sodium Tri-Hydrate | 100.0 g | 120.0 g |
| Ethylenediaminetetraacetic Acid Di-Sodium Salt | 10.0 g | 10.0 g |
| Ammonium Bromide | 140.0 g | 160.0 g |
| Ammonium Nitrate | 30.0 g | 35.0 g |
| 3 Mercapto-1,2,4-triazole | 0.05 g | 0.15 g |
| Aqueous Ammonia (27%) | 6.5 ml | 4.0 ml |
| Water to make | 1 liter | 1 liter |
| pH | 6.0 | 5.7 |
| Fixing Solution | | |
| Ethylenediaminetetraacetic Acid Di-Sodium Salt | 0.5 g | 0.7 g |
| Sodium Sulfite | 7.0 g | 8.0 g |
| Sodium Bisulfite | 5.0 g | 5.5 g |
| Aqueous Solution of Ammonium Thiosulfate (700 g/liter) | 240.0 ml | 280.0 ml |
| Water to make | 1 liter | 1 liter |
| pH | 6.7 | 6.6 |
| Stabilizing Solution | | |
| Formalin (as formaldehyde) | 0.3 ml (4.0 mmol) | 0.33 ml (4.4 mmol) |
| Compound shown in Table B | Shown in Table B | |
| Polyoxyethylene-p-monononyl Phenyl Ether (average polymerization degree: 10) | 0.2 g | 0.22 g |
| Ethylenediaminetetraacetic Acid Di-Sodium Salt | 0.05 g | 0.055 g |
| Water to make | 1 liter | 1 liter |
| pH | 7.2 | 7.3 |

After measuring the density of each film thus-processed in the same manner as in Example 1, the film was allowed to stand for 2 weeks at 60° C., 70% RH, the density change at the intermediate portion (1.5 as a magenta density) and the minimum density portion was determined.

According to a sample, fading of the magenta density at the intermediate density portion and the occurrence of yellow stain at the minimum density portion were observed.

The results are shown in Table B.

Also, the concentration of a formaldehyde gas in a working place in the case of preparing each stabilizing solution in a scale of 50 liters was measured in the same manner as in Example 1 and the results are also shown in Table B.

In addition, when formaldehyde was mixed with the compound of formula (I) and the compound of formula (II), they were reacted at an equivalent amount each to form the compound of formula (A).

For example, in No. 13, since 1 mol of Compound II-21 was 1 equivalent of a secondary amine, 4 mmols of Compound A-26 was formed and 12 mmols of Compound I-4 existed excessively. Also, in No. 8, since 1 mol of Compound II-22 was 2-equivalient of a secondary amine, 2 mmols of Compound A-35 was formed and also 12 mmols of Compound I-4 existed excessively.

TABLE B

| Sample No. | Additive and Amount Formula (I) | mmol | Formula (II) | mmol | M-Fading | Yellow Stain | Concentration of HCHO (ppm) | |
|---|---|---|---|---|---|---|---|---|
| 1 | None | — | None | — | 0.15 | 0.00 | 0.5 | Comparison |
| 2 | " | — | II-21 | 4 | 0.04 | 0.09 | 0.2 | " |
| 3 | " | — | II-22 | 2 | 0.03 | 0.08 | 0.15 | " |
| 4 | " | — | " | 4 | 0.02 | 0.16 | 0.10 | " |
| 5 | I-4 | 4 | None | — | 0.16 | 0.00 | 0.15 | " |
| 6 | " | 16 | " | — | 0.17 | 0.01 | 0.09 | " |
| 7 | " | 16 | II-22 | 1 | 0.01 | 0.01 | 0.02 | Invention |
| 8 | " | " | " | 2 | 0.00 | 0.00 | 0.01 | " |
| 9 | " | " | " | 4 | 0.00 | 0.06 | less than 0.01 | " |
| 10 | " | " | " | 8 | 0.00 | 0.12 | less than 0.01 | " |
| 11 | " | 1 | II-21 | 4 | 0.00 | 0.02 | 0.16 | Comparison |
| 12 | " | 4.1 | " | " | 0.01 | 0.01 | 0.04 | Invention |
| 13 | " | 16 | " | " | 0.01 | 0.01 | 0.01 | " |
| 14 | " | 40 | " | " | 0.03 | 0.01 | less than 0.01 | " |

As is apparent from the results in Table B, it can be seen that according to the present invention (Nos. 7–10 and 12–14), the concentration of a formaldehyde gas can be reduced and the occurrences of fading of a magenta dye and yellow stains can be restrained.

EXAMPLE 3

One liter of the concentrated stabilizing replenisher shown below was prepared and filled in a 1.2 liter polyethylene bottle.

| Concentrated Stabilizing Replenisher | |
|---|---|
| Sodium p-Toluenesulfinate | 5.0 g |
| Polyoxyethylene-p-monononyl Phenyl Ether (average polymerization degree: 10) | 22.0 g |
| Ethylenediaminetetraacetic Acid Di-Sodium Salt | 5.0 g |
| Image Stabilizer (shown in Table C) | shown in Table C |
| Water to make | 1.0 liter |
| pH | 7.2 |

After allowing to stand the concentrated solution thus-prepared at 40° C. for 1 month or 6 months, the turbidity of the solution was visually observed. The results obtained are shown in Table C.

TABLE C

| Sample No. | Image Stabilizer | Amount (mol) | Turbidity after Passage of Time 1 Months | 6 Months | |
|---|---|---|---|---|---|
| 1 | Formaldehyde | 2.0 | M | M | Comparison |
| 2 | Dimethylolurea | 0.3 | M | B | " |
| 3 | Dimethylolethyleneurea | 0.3 | M | B | " |
| 4 | Compound A-1 | 0.5 | G | M | " |
| 5 | Compound A-12 | 0.5 | G | M | " |
| 6 | Compound A-22 | 0.5 | G | M | " |
| 7 | Compound A-23 | 0.5 | G | M | " |
| 8 | Compound A-1 | 0.5 | E | E | Invention |
| | Compound I-2 | 4.0 | | | |
| 8 | Compound A-12 | 0.5 | E | E | " |
| | Compound I-4 | 4.0 | | | |
| 9 | Compound A-22 | 0.27 | E | E | " |
| | Compound I-2 | 2.0 | | | |
| 10 | Compound A-23 | 0.27 | E | E | " |
| | Compound I-4 | 2.0 | | | |

In addition, the evaluation standards of the turbidity of the solution with the passage of time in Table C are as follows.

E: Neither turbidity nor precipitation.
G: Turbidity occurred very slightly.
M: Slightly precipitation formed at the bottom of the vessel in addition to turbidity.
B: Precipitation layer of 5 mm or more formed on the bottom of the vessel.

In the case of using formalin, white floatings precipitates accumulated on the bottom of the vessel. In the case of using the known substitute for formalin (Samples 2 and 3), very slight turbidity was formed after one month but when these samples were stored for a longer period of time, white precipitates were also formed. Also, in the case of using the compound shown by formula (A) alone, the turbidity was very slight as compared with the foregoing samples but precipitates were formed little by little after storing for a long period of time.

On the other hand, when the compound of formula (A) was used together with the compound of formula (I), the solution was not changed even when the solution was stored for a long period of time and it can be seen that an excellent stabilization has been attained.

EXAMPLE 4

A multilayer color reversal photographic material (Sample 401) having each layer of the following composition on a cellulose triacetate film support with a thickness of 127 μm having a subbing layer was prepared. In addition, the effect of each compound added is not limited to the described use.

| | |
|---|---|
| Layer 1 (Antihalation Layer) | |
| Black Colloidal Silver | 0.20 g as Ag |
| Gelatin | 1.9 g |
| Ultraviolet Absorber U-1 | 0.04 g |
| Ultraviolet Absorber U-2 | 0.1 g |
| Ultraviolet Absorber U-3 | 0.1 g |
| Ultraviolet Absorber U 4 | 0.1 g |
| Ultraviolet Absorber U-6 | 0.1 g |
| High-Boiling Organic Solvent Oil-1 | 0.1 g |
| Fine-Crystalline Solid Dispersion of Dye E-1 | 0.1 g |
| Layer 2 (Interlayer) | |
| Gelatin | 0.40 g |
| Compound Cpd-D | 5 mg |
| Compound Cpd-L | 5 mg |
| Compound Cpd M | 3 mg |
| High-Boiling Organic Solvent Oil-3 | 0.1 g |
| Dye D-4 | 0.4 mg |
| Layer 3 (Interlayer) | |
| Surface and Internal Fogged Fine-Grain Silver Iodobromide Emulsion (mean grain size: 0.06 μm, variation coeff.: 18%, AgI: 1 mol %) | 0.05 g as Ag |
| Gelatin | 0.4 g |
| Layer 4 (Low-Speed Red-Sensitive Emulsion Layer) | |
| Emulsion A | 0.1 g as Ag |
| Emulsion B | 0.4 g as Ag |
| Gelatin | 0.8 g |
| Coupler C-1 | 0.15 g |
| Coupler C-2 | 0.05 g |
| Coupler C-9 | 0.05 g |
| Compound Cpd-D | 10 mg |
| High-Boiling Organic Solvent Oil-2 | 0.1 g |
| Layer 5 (Medium-Speed Red-Sensitive Emulsion Layer) | |
| Emulsion B | 0.2 g as Ag |
| Emulsion C | 0.3 g as Ag |
| Gelatin | 0.8 g |
| Coupler C-1 | 0.2 g |
| Coupler C-2 | 0.05 g |
| Coupler C-3 | 0.2 g |
| High-Boiling Organic Solvent Oil-2 | 0.1 g |
| Layer 6 (High-Speed Red-Sensitive Emulsion Layer) | |
| Emulsion D | 0.4 g as Ag |
| Gelatin | 1.1 g |
| Coupler C-1 | 0.3 g |
| Coupler C-3 | 0.7 g |
| Additive P-1 | 0.1 g |
| Layer 7 (Interlayer) | |
| Gelatin | 0.6 g |
| Additive M-1 | 0.3 g |
| Color Mixing Inhibitor Cpd-K | 2.6 mg |
| Ultraviolet Absorber U-1 | 0.1 g |
| Ultraviolet Absorber U-6 | 0.1 g |
| Dye D-1 | 0.02 g |
| Compound Cpd-D | 5 mg |
| Compound Cpd-L | 5 mg |
| Compound Cpd-M | 5 mg |
| Layer 8 (Interlayer) | |
| Surface and Internal Fogged Silver Iodobromide Emulsion (mean grain size: 0.06 μm, variation coeff.: | 0.02 g as Ag |

-continued

| | |
|---|---|
| 16%, AgI: 0.3 mol %) | |
| Gelatin | 1.0 g |
| Additive P-1 | 0.2 g |
| Color Mixing Inhibitor Cpd-N | 0.1 g |
| Color Mixing Inhibitor Cpd-A | 0.1 g |
| Layer 9 (Low-Speed Green-Sensitive Emulsion Layer) | |
| Emulsion E | 0.1 g as Ag |
| Emulsion F | 0.2 g as Ag |
| Emulsion G | 0.2 g as Ag |
| Gelatin | 0.5 g |
| Coupler C-7 | 0.05 g |
| Coupler C-8 | 0.20 g |
| Compound Cpd-B | 0.03 g |
| Compound Cpd D | 10 mg |
| Compound Cpd-E | 0.02 g |
| Compound Cpd-F | 0.02 g |
| Compound Cpd-G | 0.02 g |
| Compound Cpd-H | 0.02 g |
| High-Boiling Organic Solvent Oil-1 | 0.1 g |
| High-Boiling Organic Solvent Oil-2 | 0.1 g |
| Layer 10 (Medium Speed Green-Sensitive Emulsion Layer) | |
| Emulsion G | 0.3 g as Ag |
| Emulsion H | 0.1 g as Ag |
| Gelatin | 0.6 g |
| Coupler C-7 | 0.2 g |
| Coupler C-8 | 0.1 g |
| Compound Cpd-B | 0.03 g |
| Compound Cpd-E | 0.02 g |
| Compound Cpd-F | 0.02 g |
| Compound Cpd-G | 0.05 g |
| Compound Cpd-H | 0.05 g |
| High Boiling Organic Solvent Oil-2 | 0.01 g |
| Layer 11 (High-Speed Green-Sensitive Emulsion Layer) | |
| Emulsion I | 0.5 g as Ag |
| Gelatin | 1.0 g |
| Coupler C-4 | 0.3 g |
| Coupler C-8 | 0.1 g |
| Compound Cpd-B | 0.08 g |
| Compound Cpd-E | 0.02 g |
| Compound Cpd-F | 0.02 g |
| Compound Cpd-G | 0.02 g |
| Compound Cpd-H | 0.02 g |
| High-Boiling Organic Solvent Oil-1 | 0.02 g |
| High Boiling Organic Solvent Oil-2 | 0.02 g |
| Layer 12 (Interlayer) | |
| Gelatin | 0.6 g |
| Dye D-1 | 0.1 g |
| Dye D-2 | 0.05 g |
| Dye D-3 | 0.07 g |
| Layer 13 (Yellow Filter Layer) | |
| Yellow Colloidal Silver | 0.07 g as Ag |
| Gelatin | 1.1 g |
| Color Mixing Inhibitor Cpd-A | 0.01 g |
| High Boiling Organic Solvent Oil-1 | 0.01 g |
| Fine Crystal Solid Dispersion of Dye E-2 | 0.05 g |
| Layer 14 (Interlayer) | |
| Gelatin | 0.6 g |
| Layer 15 (Low-Speed Blue-Sensitive Emulsion Layer) | |
| Emulsion J | 0.2 g as Ag |
| Emulsion K | 0.3 g as Ag |
| Emulsion L | 0.1 g as Ag |
| Gelatin | 0.8 g |
| Coupler C-5 | 0.2 g |
| Coupler C-10 | 0.4 g |
| Layer 16 (Medium-Speed Blue-Sensitive Emulsion Layer) | |
| Emulsion L | 0.1 g as Ag |
| Emulsion M | 0.4 g as Ag |
| Gelatin | 0.9 g |
| Coupler C-5 | 0.3 g |
| Coupler C-6 | 0.1 g |
| Coupler C-10 | 0.1 g |
| Layer 17 (High-Speed Blue-Sensitive Emulsion Layer) | |
| Emulsion N | 0.4 g as Ag |
| Gelatin | 1.2 g |
| Coupler C-6 | 0.6 g |
| Coupler C-10 | 0.1 g |
| Layer 18 (1st Protective Layer) | |
| Gelatin | 0.7 g |
| Ultraviolet Absorber U 1 | 0.04 g |

-continued

| | |
|---|---|
| Ultraviolet Absorber U-2 | 0.01 g |
| Ultraviolet Absorber U-3 | 0.03 g |
| Ultraviolet Absorber U-4 | 0.03 g |
| Ultraviolet Absorber U-5 | 0.05 g |
| Ultraviolet Absorber U-6 | 0.05 g |
| High-Boiling Organic Solvent Oil-1 | 0.02 g |
| Formalin Scavenger Cpd-C | 0.2 g |
| Formalin Scavenger Cpd-1 | 0.4 g |
| Dye D-3 | 0.05 g |
| Compound Cpd-N | 0.02 g |
| Layer 19 (2nd Protective Layer) | |
| Colloidal Silver | 0.1 mg as Ag |
| Fine-Grain Silver Iodobromide Emulsion (mean grain size: 0.06 μm, AgI: 1 mol %) | 0.1 g as Ag |
| Gelatin | 0.4 g |
| Layer 20 (3rd Protective Layer) | |
| Gelatin | 0.4 g |
| Polymethyl methacrylate (average particle size: 1.5 μm) | 0.1 g |
| 4:6 Copolymer of Methyl Methacrylate and Acrylic Acid (average particle size: 1.5 μm) | 0.1 g |
| Silicone Oil | 0.03 g |
| Surface Active Agent W-1 | 3.0 mg |
| Surface Active Agent W-2 | 0.03 g |

Also, each of the silver halide emulsion layers further contained F-1 to F-8 in addition to the foregoing components.

Furthermore, each layer further contained gelatin hardener H-1 and surface active agents W-3, W-4, W-5, W-6, and W-7 for coating and for emulsification.

Moreover, the foregoing same contained phenol, 1,2-benzisothiazolin-3-one, 2-phenoxy ethanol, p-hydroxybenzoic acid butyl ester and phenethyl alcohol as antiseptics and antifungal agents.

The silver iodobromide Emulsions A to N used for sample 401 are shown in the following tables.

Also, the compounds used for the sample are shown below.

| Emulsion | Feature of Grains | Sphere-Corresponding Mean Grain Size (μm) | Variation Coefficient (%) | AgI Content (%) |
|---|---|---|---|---|
| A | Monodispersion Tetradecahedral Grains | 0.28 | 16 | 3.7 |
| B | Monodispersion Cubic Internal Latent Image Type Grains | 0.30 | 10 | 3.3 |
| C | Monodispersion Tabular Grains Mean Aspect Ratio: 4.0 | 0.38 | 18 | 5.0 |
| D | Monodispersion Tabular Grains Mean Aspect Ratio: 7.0 | 0.68 | 25 | 2.0 |
| E | Monodispersion Tabular Grains | 0.20 | 17 | 4.0 |
| F | Monodispersion Tabular Grains | 0.23 | 16 | 4.0 |
| G | Monodispersion Cubic Internal Latent Image Type Grains | 0.28 | 11 | 3.5 |
| H | Monodispersion Cubic Internal Latent Image Type Grains | 0.32 | 9 | 3.5 |
| I | Monodispersion Tabular Grains Mean Aspect Ratio: 7.0 | 0.80 | 28 | 1.5 |
| J | Monodispersion Tetradecahedral Grains | 0.30 | 18 | 4.0 |
| K | Monodispersion Tabular Grains Mean Aspect Ratio: 7.0 | 0.45 | 17 | 4.0 |
| L | Monodispersion Cubic Internal Latent Image Type Grains | 0.46 | 14 | 3.5 |
| M | Monodispersion Tabular Grains Mean Aspect Ratio: 7.0 | 0.55 | 13 | 4.0 |
| N | Monodispersion Tabular Grains Mean Aspect Ratio: 7.0 | 1.00 | 33 | 1.3 |

Sectral Sensitization for Emulsions A to N

| Emulsion | Sensitizing Dye | Amount per mol of Silver Halide (g) | Addition time of Sensitizing Dye |
|---|---|---|---|
| A | S-1 | 0.025 | Immediately after chemical sensitization |
| | S-2 | 0.25 | Immediately after chemical sensitization |
| B | S-1 | 0.01 | Immediately after finishing grain formation |
| | S-2 | 0.25 | Immediately after finishing grain formation |
| C | S-1 | 0.02 | Immediately before initiation of chemical sensitization |
| | S-2 | 0.25 | Immediately before initiation of chemical sensitization |
| D | S-1 | 0.01 | Immediately after chemical sensitization |
| | S-2 | 0.10 | Immediately after chemical sensitization |
| | S-7 | 0.01 | Immediately after chemical sensitization |
| E | S-3 | 0.5 | Immediately after chemical sensitization |
| | S-4 | 0.1 | Immediately after chemical sensitization |
| F | S-3 | 0.3 | Immediately after chemical sensitization |
| | S-4 | 0.1 | Immediately after chemical sensitization |
| G | S-3 | 0.25 | Immediately after finishing grain formation |
| | S-4 | 0.08 | Immediately after finishing grain formation |
| H | S-3 | 0.2 | During grain formation |
| | S-4 | 0.06 | During grain formation |
| I | S-3 | 0.3 | Immediately before initiation of chemical sensitization |
| | S-4 | 0.07 | Immediately before initiation of chemical sensitization |
| | S-8 | 0.1 | Immediately before initiation of chemical sensitization |
| J | S-6 | 0.2 | During grain formation |
| | S-5 | 0.05 | During grain formation |
| K | S-6 | 0.2 | Immediately before initiation of chemical sensitization |

-continued

| | | | |
|---|---|---|---|
| | S-5 | 0.05 | Immediately before initiation of chemical sensitization |
| L | S-6 | 0.22 | Immediately after finishing grain formation |
| | S-5 | 0.06 | Immediately after finishing grain formation |
| M | S-6 | 0.15 | Immediately before initiation of chemical sensitization |
| | S-5 | 0.04 | Immediately before initiation of chemical sensitization |
| N | S-6 | 0.22 | Immediately after finishing grain formation |

C-1

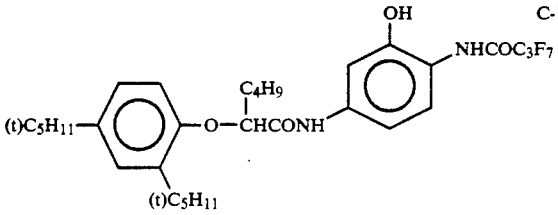

C-2

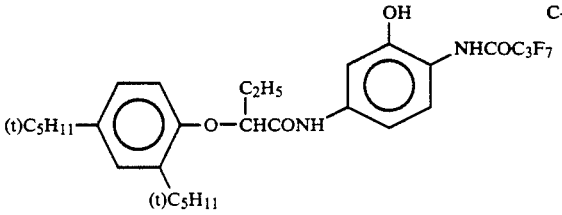

C-3

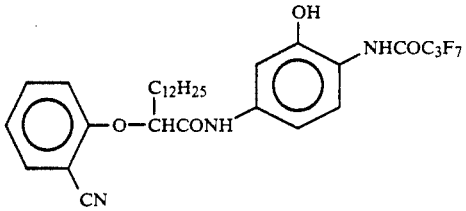

C-4

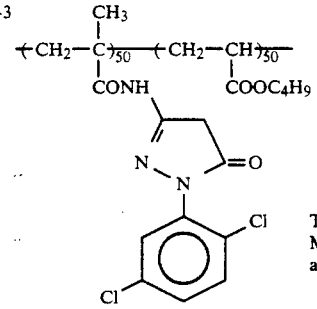

The number is weight %.
Mean Molecular Weight: about 25,000

C-5

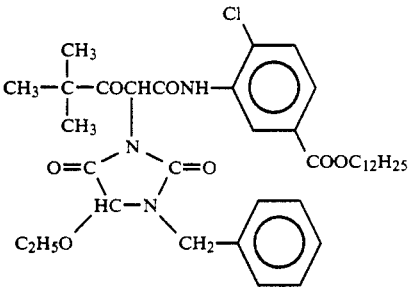

C-6

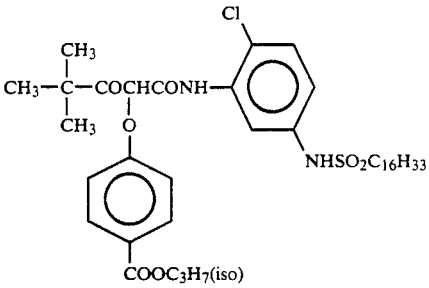

C-7

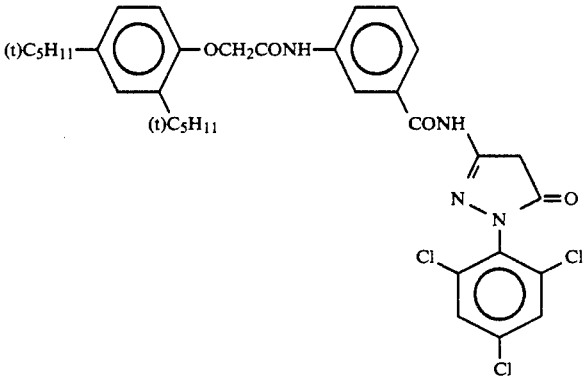

-continued
C-8
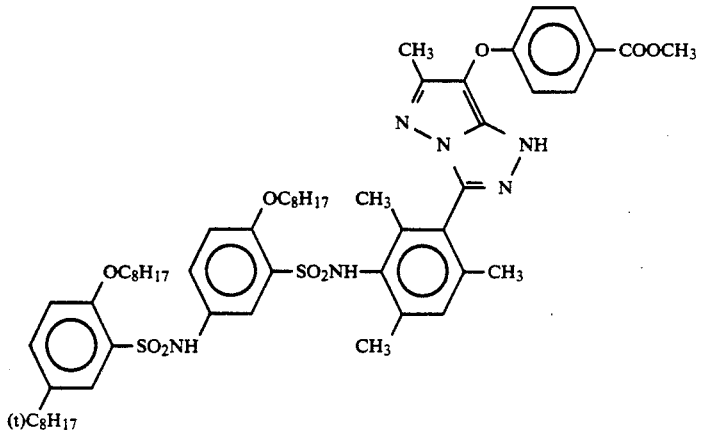
C-9
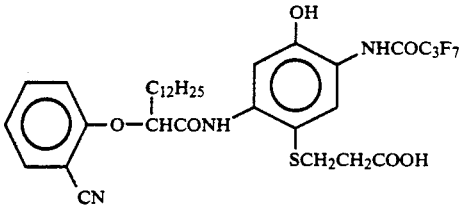
C-10
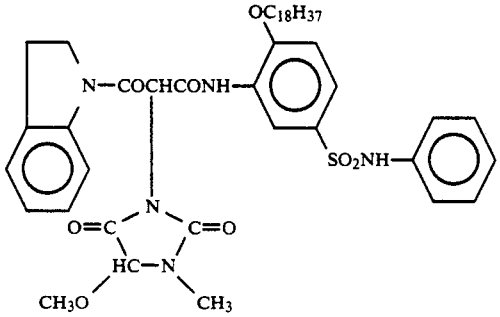
Dibutyl Phthalate Oil-1
Tricresyl Phosphate Oil-2
Oil-3
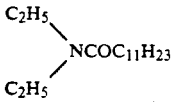
Cpd-A
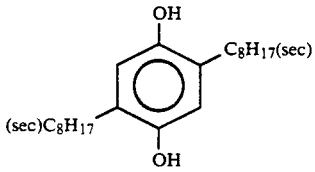
Mixture (Ratio: 4/1 (by weight)) of
Cpd-B
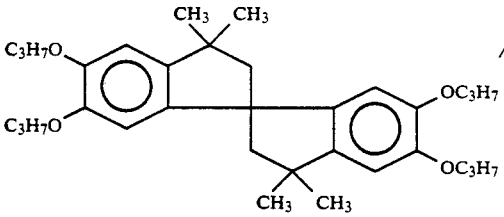
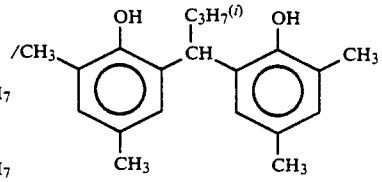
Cpd-C
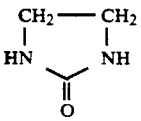
Cpd-D
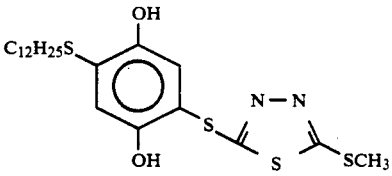
Cpd-E
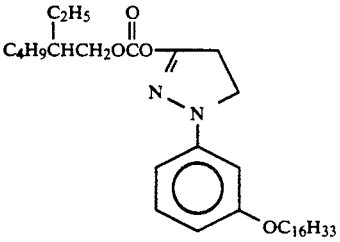

-continued
Mixture (Ratio: 1/1 (by weight)) of
Cpd-F
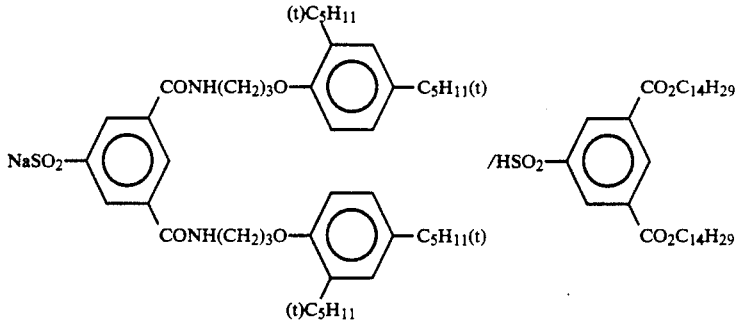
Cpd-G
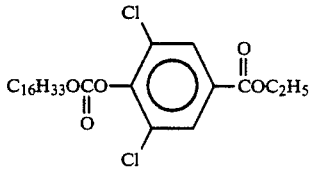
Mixture (Ratio: 1/1 (by weight)) of
Cpd-H
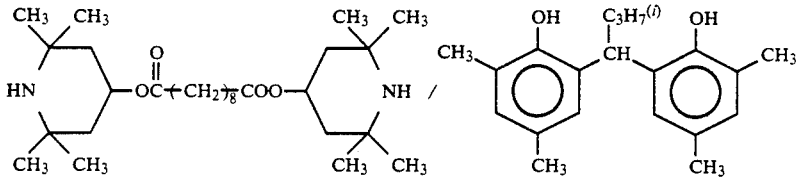
Cpd-I
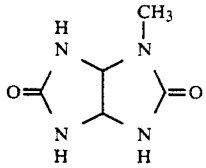
Cpd-K
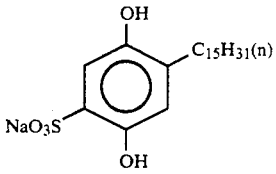
Cpd-L
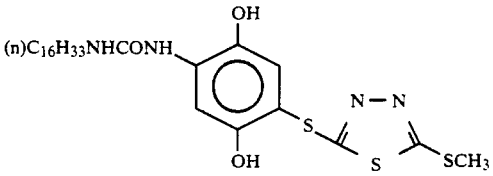
Cpd-M
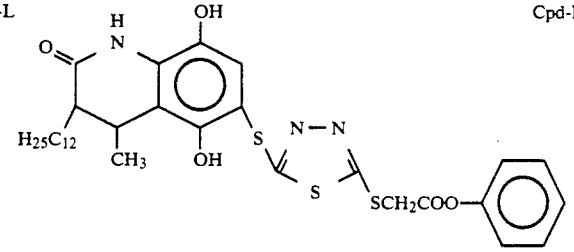
Cpd-N
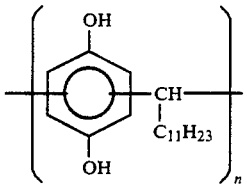
mean molecular Weight: 9000
U-1
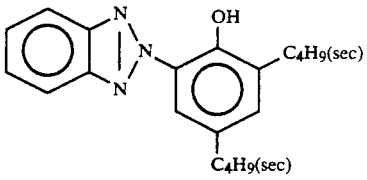
U-2
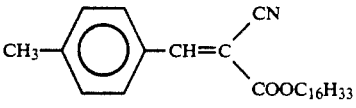
U-3
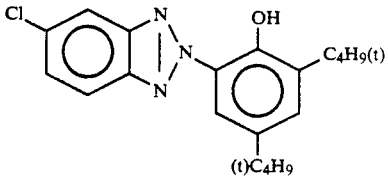

-continued
U-4
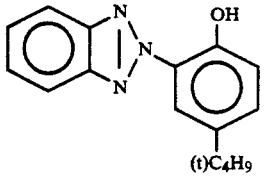
U-5
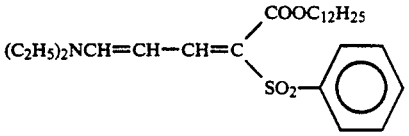
U-6
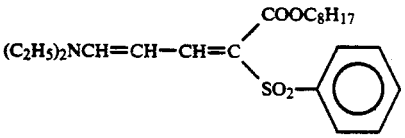
S-1
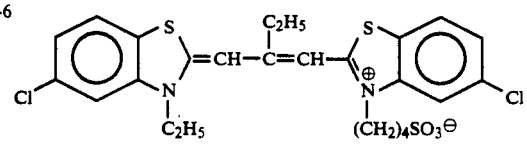
S-2
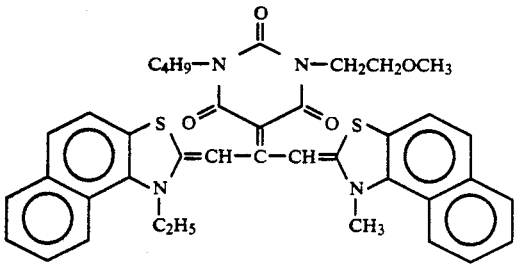
S-3
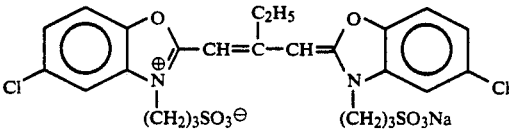
S-4
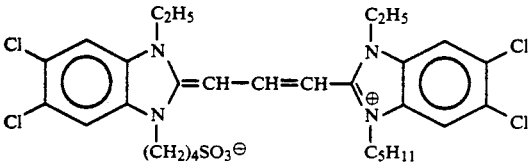
S-5
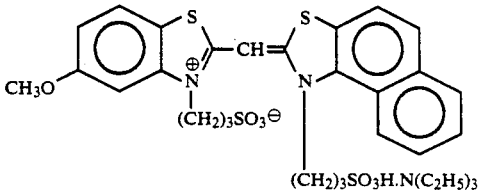
S-6
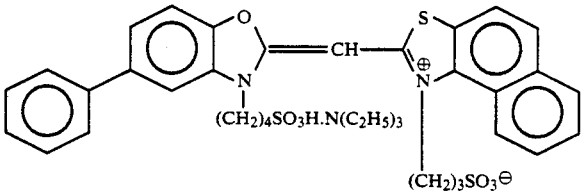
S-7
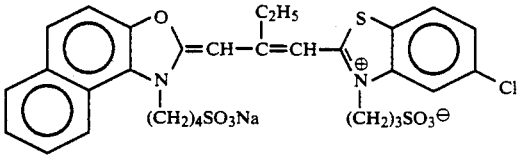
S-8
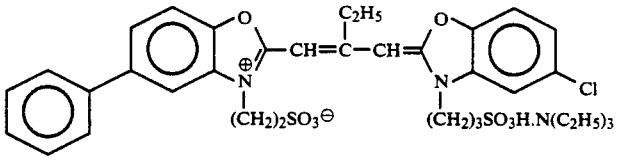
D-1
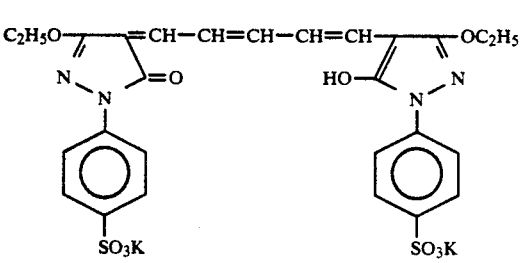
D-2
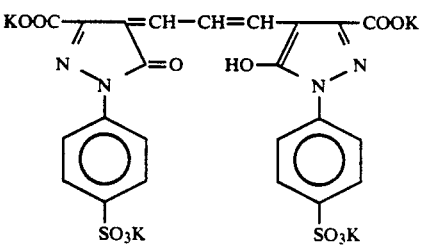

-continued
D-3
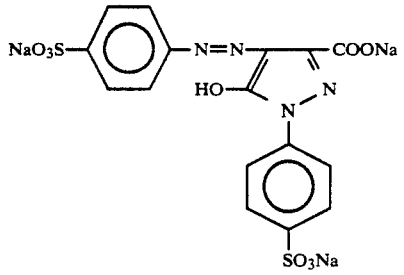
D-4
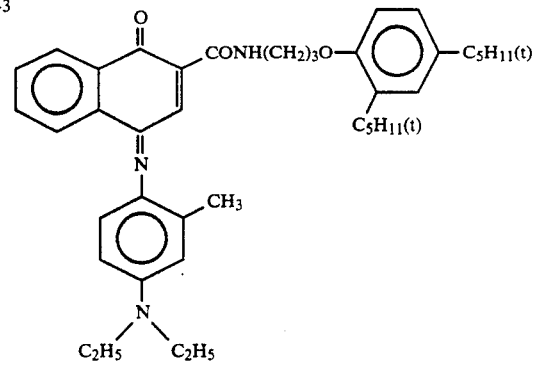
E-1
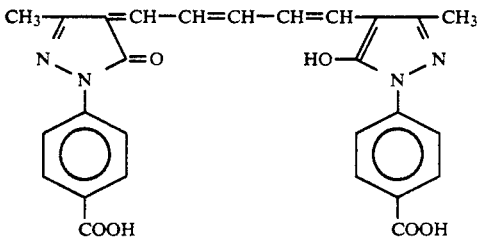
E-2
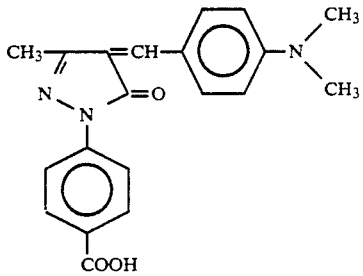
H-1
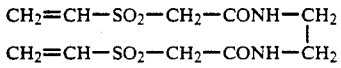
W-1
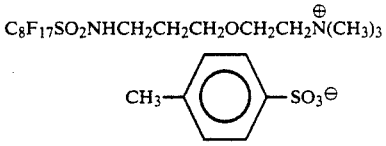
W-2
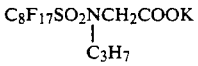
W-3
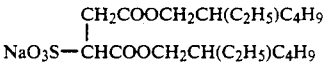
W-4
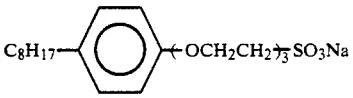
W-5
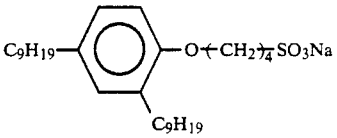
W-6
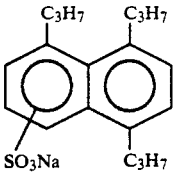
W-7
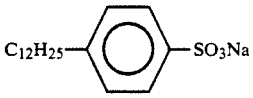
P-1
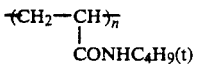
M-1
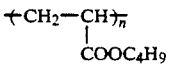
F-1
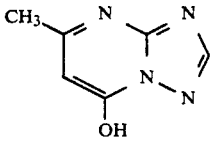
F-2
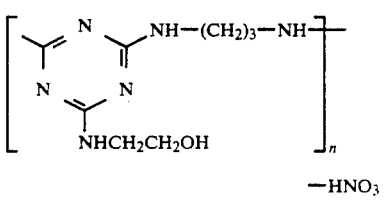

-continued

F-3

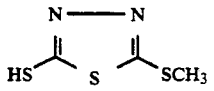

F-4

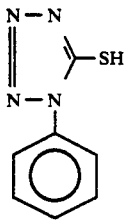

F-5

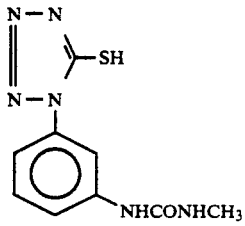

F-6

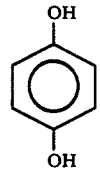

F-7

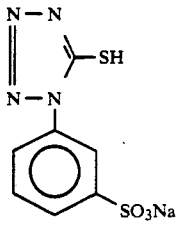

F-8

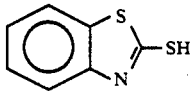

Sample 401 prepared was slit in 35 mm width, and after perforated in the same format as films on the market and applying thereto a uniform light exposure, the sample was processed according to the following processing steps using an hanging type automatic processor.

| Processing step | | | | |
|---|---|---|---|---|
| Step | Time (min.) | Temp. (°C.) | Replenishment Amount* (liter) | Tank Volume (liter) |
| Black and white Development | 9 | 38 | 0.7 | 12 |
| 1st Washing | 1 | 38 | 7.5 | 4 |
| Reversal | 1 | 38 | 1.0 | 4 |
| Color Development | 4 | 38 | 1.0 | 12 |
| Conditioning | 2 | 38 | 1.0 | 4 |
| Bleaching | 4 | 38 | 0.5 | 12 |
| Fixing | 3 | 38 | 1.0 | 12 |
| 2nd Washing (2) | 1 | 38 | — | 4 |
| 2nd Washing (2) | 1 | 38 | 7.5 | 4 |
| Stabilization | 0.3 | 38 | 0.7 | 4 |
| Drying | 2 | 50 | — | — |

(*)Amount per square meter of the color photographic material processed.

The overflow solution for 2nd washing (2) was introduced into the 2nd washing (1).

The composition of each processing solution was as follows.

| Black and White Developer | Starting Solution | Replenisher |
|---|---|---|
| Nitrilo-N,N,N-trimethylenephosphonic Acid.Penta-Sodium Salt | 2.0 g | 2.0 g |
| Diethylenetriaminepentaacetic Acid.Penta-Sodium | 3.0 g | 3.0 g |
| Potassium Sulfite | 30 g | 30 g |

-continued

| Black and White Developer | Starting Solution | Replenisher |
|---|---|---|
| Potassium Hydroquinone. monosulfonate | 20 g | 25 g |
| Potassium Carbonate | 33 g | 36 g |
| 1-Phenyl-4-methyl-4-hydroxymethyl-3-pyrazolidone | 2.0 g | 2.2 g |
| Potassium Bromide | 2.5 g | — |
| Potassium Thiocyanate | 1.2 g | 1.2 g |
| Potassium Iodide | 2.0 g | 2.0 mg |
| Water to make | 1 liter | 1 liter |
| pH (25° C.) | 9.60 | 9.80 |

The pH was adjusted by hydrochloric acid or potassium hydroxide.

| Reversal Solution | Starting Solution = Replenisher |
|---|---|
| Nitrilo-N,N,N trimethylenephosphonic Acid.Penta-Sodium Salt | 2.0 g |
| Stannous Chloride.Di-Hydrate | 1.0 g |
| p-Aminophenol | 0.1 g |
| Sodium Hydroxide | 8.0 g |
| Glacial Acetic Acid | 15 ml |
| Ammonium Sulfite | 20 g |
| Water to make | 1 liter |
| pH (25° C.) | 6.60 |

The pH was adjusted by acetic acid or aqueous ammonia.

| Color developer | Starting Solution | Replenisher |
|---|---|---|
| Nitrilo-N,N,N-trimethylenephosphonic Acid-Penta-Sodium | 2.0 g | 2.0 g |

-continued

| Color developer | Starting Solution | Replenisher |
|---|---|---|
| Salt | | |
| Diethylenetriaminepentaacetic Acid.Penta-Sodium Salt | 2.0 g | 2.0 g |
| Sodium Sulfite | 7.0 g | 8.0 g |
| Potassium Tertiary Phosphate.12-Hydrate | 36 g | 36 g |
| Potassium Bromide | 1.0 g | — |
| Potassium Iodide | 90 mg | — |
| Sodium Hydroxide | 3.0 g | 3.5 g |
| Citrazinic Acid | 1.5 g | 1.5 g |
| N-Ethyl-(β-methanesulfonamidoethyl)-3-methyl-4-aminoaniline Sulfate | 10.5 g | 10.5 g |
| 3,6-Dithiaoctane-1,8-diol | 3.5 g | 3.5 g |
| Water to make | 1 liter | 1 liter |
| pH (25° C.) | 11.90 | 12.15 |

The pH was adjusted by hydrochloric acid or potassium hydroxide.

| Conditioning Solution | Starting Solution = Replenisher |
|---|---|
| Ethylenediaminetetraacetic Acid Di-Sodium Salt.Di-Hydrate | 8.0 g |
| Sodium Sulfite | 12 g |
| 2 Mercapto-1,3,4-triazole | 0.5 g |
| Water to make | 1 liter |
| pH (25° C.) | 6.00 |

The pH was adjusted by hydrochloric acid or sodium hydroxide.

| Blixing Solution 1 | Starting Solution = Replenisher |
|---|---|
| Ethylenediaminetetraacetic Acid | 3 g |
| Ethylenediaminetetraacetic Acid Ferric Ammonium.Di-Hydrate | 150 g |
| 2-Mercapto-1,3,4-triazole | 0.5 g |
| Ammonium Bromide | 120 g |
| Ammonium Nitrate | 25 g |
| Water to make | 1 liter |

-continued

| Blixing Solution 1 | Starting Solution = Replenisher |
|---|---|
| pH (25° C.) | 5.00 |

The pH was adjusted by acetic acid or aqueous ammonia.

| Fixing Solution | Starting Solution = Replenisher |
|---|---|
| Ethylenediaminetetraacetic Acid. Di-Sodium.Di-Hydrate | 1.7 g |
| Sodium Benzaldehyde-o-sulfonate | 20 g |
| Sodium Bisulfite | 15 g |
| Ammonium Thiosulfate (700 g/liter) | 250 ml |
| Water to make | 1 liter |
| pH (25° C.) | 6.00 |

The pH was adjusted by acetic acid or aqueous ammonia.

| Stabilizing Solution | Starting Solution = Replenisher |
|---|---|
| Polyoxyethylene-p-monononyl Phenyl Ether (average polymerization degree: 10) | 0.2 g |
| Ethylenediaminetetraacetic Acid. Di-Sodium Salt | 0.05 g |
| Image Stabilizer (shown in Table D) | shown in Table D |
| Water to make | 1 liter |
| pH | 7.8 |

The test of image storage stability for sample thus-processed was carried out in the same manner as in Example 1. The image storage stability test was carried out under the condition of 80° C. for 3 days. Also, in a bright place, the presence of unevenness of the sample was visually observed.

The results are shown in Table D below.

TABLE D

| Sample No. | Image Stabilizer | Amount (mmol/l) | M Fading | Drying Mark | |
|---|---|---|---|---|---|
| 1 | None | — | 0.30 | None | Comparison |
| 2 | Hexamethylene-tetramine | 6 | 0.29 | None | " |
| 3 | " | 100 | 0.10 | Severely occurred | " |
| 4 | Compound A-1 | 6 | 0.04 | Slightly occurred | " |
| 5 | Compound A-16 | 6 | 0.05 | Slightly occurred | " |
| 6 | Compound A-22 | 6 | 0.00 | Severely occurred | " |
| 7 | Compound A-23 | 6 | 0.00 | Moderately occurred | " |
| 8 | Compound A-26 | 6 | 0.00 | Moderately occurred | " |
| 7 | Compound A-32 | 6 | 0.00 | Moderately occurred | " |
| 8 | Compound A-1 | 6 | 0.00 | None | Invention |
| | Compound I-2 | 18 | | | |
| 9 | Compound A-16 | 6 | 0.00 | None | " |
| | Compound I-2 | 12 | | | |
| 10 | Compound A-22 | 6 | 0.00 | None | " |
| | Compound I-2 | 3 | | | |
| 11 | Compound A-23 | 6 | 0.00 | None | " |
| | Compound I-4 | 18 | | | |
| 12 | Compound A-26 | 6 | 0.00 | None | " |
| | Compound I-4 | 18 | | | |
| 13 | Compound A-32 | 6 | 0.00 | None | " |
| | Compound I-2 | 12 | | | |

As is apparent from the results of Table D, in the stabilizing solution containing the known substituting stabilizer of formalin, when a large amount of the compound was used for obtaining the image stabilizing effect, a problem that drying mark is generated at the center of the perforation portions of the film after drying occurred. On the other hand, as in apparent from results of Table D, the stabilizing solution in this invention has a sufficient fading inhibiting effect with a very small amount of formalin. Also, it can be seen that in the case of using the stabilizing solution in this invention, even in processing with a hanging type automatic processor which is liable to cause drying mark by introducing the film attached with a processing solution after processing into a drying step, unevenness does not occur, which showed an excellent processing property.

Also, when the same test was carried out using following Bleaching Solution 2 in place of Bleaching Solution 1 in the above processing, the same results as in the above processing were obtained.

| Stabilizing Solution | Starting Solution = Replenisher |
|---|---|
| 1,3-Diaminopropanetetraacetic Acid | 3 g |
| 1,3-Diaminopropanetetraacetic Acid Ferric Ammonium.Di-Hydrate | 120 g |
| Glycolic Acid | 40 g |
| Acetic Acid | 30 g |
| Ammonium Bromide | 120 g |
| Ammonium Nitrate | 25 g |
| Water to make | 1 liter |
| pH (25° C.) | 4.00 |

The pH was adjusted by acetic acid or aqueous ammonia.

EXAMPLE 5

The same test as in Example 1 was carried out while changing the processing steps only as follows.

| Step | Time | Temp. (°C.) | Replenishment Amount* (ml) | Tank Volume (l) |
|---|---|---|---|---|
| Color Development | 3 min. 5 sec. | 38.0 | 600 | 17 |
| Bleaching | 50 sec. | 38.0 | 140 | 5 |
| Blixing | 50 sec. | 38.0 | — | 5 |
| Fixing | 50 sec. | 38.0 | 420 | 5 |
| Washing | 30 sec. | 38.0 | 980 | 3 |
| Stabilization | shown in | 38.0 | — | 3 |

-continued

| Step | Time | Temp. (°C.) | Replenishment Amount* (ml) | Tank Volume (l) |
|---|---|---|---|---|
| (1) Stabilization | Table A Same as | 38.0 | 560 | 3 |
| (2) Drying | Stab. (1) 90 sec. | 50 | — | — |

The stabilizing step was a counter-current system of from (2) to (1). Also, the overflow solution from the washing water was all introduced into the fixing bath. In this case, city water was used as washing water as it was. Other processing solutions were the same as those in Example 1.

When the image storage stability and the concentration of a formaldehyde vapor were measured, the same results as in Example 1 were obtained.

EXAMPLE 6

The same processing steps as in Example 4 were carried out except for changing the conditioning solution and the stabilizing solution as follows.

In this case, the time for the final stabilizing step was one minute and the time for the conditioning step was changed as shown in Table E in the processing.

| | Starting Solution = Replenisher |
|---|---|
| Conditioning Solution | |
| Ethylenediaminetetraacetic Acid. Di-Sodium Salt.Di-Hydrate | 8.0 g |
| 2-Mercapto-1,3,4 triazole | 0.5 g |
| Image Stabilizer (shown in Table E) | shown in Table E |
| Water to make | 1 liter |
| pH (25° C.) | 7.5 |
| Stabilizing Solution | |
| Polyoxyethylene-p-monononyl Phenyl Ether (average polymerization degree: 10) | 0.2 g |
| Ethylenediaminetetraacetic Acid Di-Sodium Salt | 0.05 g |
| Water to make | 1 liter |
| pH (25° C. | 7.2 |

By using the same method as in Example 1, the image storage stability of the processed film obtained and the vapor pressure of formaldehyde were evaluated.

The results are shown in Table E below.

TABLE E

| Sample No. | Image Stabilizer | Amount (mmol/l) | Concentration of HCHO (ppm) | M Fading Time of Conditioning Bath 40 sec. | 90 sec. | 120 sec. | |
|---|---|---|---|---|---|---|---|
| 1 | Formaldehyde | 13 | 0.89 | 0.03 | 0.00 | 0.00 | Comparison |
| 2 | " | 3 | 0.35 | 0.11 | 0.00 | 0.00 | " |
| 3 | Hexamethylenetetramine | 13 | 0.07 | 0.09 | 0.05 | 0.02 | " |
| 4 | " | 3 | less than 0.03 | 0.25 | 0.22 | 0.10 | " |
| 5 | Compound A-11 | 3 | 0.12 | 0.01 | 0.00 | 0.00 | " |
| 6 | Compound A-22 | 3 | 0.07 | 0.01 | 0.00 | 0.00 | " |
| 7 | Compound A-23 | 3 | 0.09 | 0.00 | 0.00 | 0.00 | " |
| 8 | Compound A-32 | 3 | 0.08 | 0.01 | 0.01 | 0.01 | " |
| 9 | Compound A-45 | 3 | 0.09 | 0.01 | 0.01 | 0.01 | " |
| 10 | Compound A-11 Compound I-17 | 3 6 | less than 0.00 | 0.00 | 0.00 | 0.00 | Invention |
| 11 | Compound A-22 Compound I-2 | 3 9 | less than 0.01 | 0.00 | 0.00 | 0.00 | " |
| 12 | Compound A-23 Compound I-4 | 5 10 | less than 0.01 | 0.00 | 0.00 | 0.00 | " |
| 13 | Compound A-32 Compound I-2 | 5 10 | less than 0.01 | 0.00 | 0.00 | 0.00 | " |
| 14 | Compound A-45 | 5 | less than 0.01 | 0.00 | 0.00 | 0.00 | " |

TABLE E-continued

| Sample No. | Image Stabilizer | Amount (mmol/l) | Concentration of HCHO (ppm) | M Fading Time of Conditioning Bath 40 sec. | 90 sec. | 120 sec. |
|---|---|---|---|---|---|---|
| | Compound I-4 | 10 | | | | |

As in apparent from the results in Table E above, by incorporating the compounds of the present invention into the conditioning bath, the high image stabilizing effect and a safe working environment of substantially generating no formaldehyde gas can be attained. In particular, in the case of using the compound represented by formula (A) alone, the concentration of a formaldehyde gas is reduced but the reduction of the concentration is not sufficient and by using the compound of formula (A) together with the compound of formula (I), the complete inhibition of the generation of a formaldehyde gas is attained.

EXAMPLE 7

The same procedure as in the stabilizing solution No. 18 of Example 1 was repeated except that

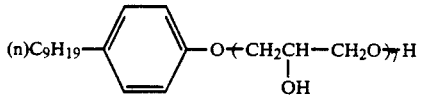

was used in place of polyoxyethylene-p-monononylphenylether, and further a polyhexamethylenebiguanidine hydrochloric acid salt was added in an amount of 0.055 g/l.

As a result, the excellent results in which stain on the silver halide color photographic material after processing is less could be obtained.

Further, when 0.5 ml of methanol was added to the stabilizing solution, formation of foam in preparation of the stabilizing solution was prevented and stain on the photographic material after processing was less. That is, the excellent results were obtained.

EXAMPLE 8

When the same test as in Example 1 was carried out on samples 201 and 202 prepared by using the equimolar amount of magenta coupler M-1 or M-17, respectively in place of magenta coupler ExM-8 in sample 101 in Example 1 and further by providing back layer described in Example 2-1 of JP-A-4-73736 on the back surface of the support, the same results were obtained.

EXAMPLE 9

When the same processing steps No. 14 to No. 20 were carried out using sample 201 in Example 2 of JP-A-2-90151 and Light-sensitive Material 1 in Example 1 and Light-sensitive Material 9 in Example 3 of JP-A-2-93641, the vapor pressure of formaldehyde was less, the fastness of the dye images was excellent, and no stains formed on the light-sensitive materials.

As described above in detail, according to the process of the present invention, the vapor pressure of formaldehyde generated is less, the fading inhibition effect of the dye images formed is excellent, and no stain forms on color photographic materials processed.

While the invention has been described in detail and with reference to specific embodiments thereof, it will be apparent to one skilled in the art that various changes and modifications can be made therein without departing from the spirit and scope thereof.

What is claimed is:

1. A method for processing an imagewise exposed silver halide color photographic material, which comprises developing in a color developing solution and after color development processing with a processing solution containing at least one kind of a compound represented by formula (I) and at least one kind of a compound represented by formula (A);

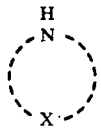

(I)

wherein X represents a non-metallic atomic group necessary for forming a nitrogen-containing heteroaromatic ring;

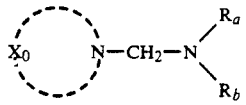

(A)

wherein $X_0$ represents a non-metallic atomic group necessary for forming a nitrogen-containing heteroaromatic ring; and $R_a$ and $R_b$, which may be the same or different, each represents an alkyl group or an alkenyl group and $R_a$ and $R_b$ may be bonded each other to form a 4- to 8-membered ring.

2. The method as in claim 1, wherein said nitrogen-containing heteroaromatic rings in formula (I) and formula (A) which may be the same or different, each is a ring selected from the group consisting of a pyrrole ring, a pyrazole ring, an imidazole ring, a triazole ring, a tetrazole ring, rings formed by condensing benzene to the foregoing rings, rings formed by condensing a heterocyclic ring to the foregoing rings and rings formed by condensing an alicyclic ring to the foregoing rings.

3. The method as in claim 2, wherein said nitrogen-containing heteroaromatic rings in formula (I) and formula (A) which may be the same or different, each is an unsubstituted ring or a ring substituted by a substituent selected from the group consisting of an alkyl group, an alkenyl group, an aryl group, a halogen atom, a heterocyclic group, a nitro group, a cyano group, a sulfo group, a carboxy group, a phospho group, an acyl group, a sulfonyl group, a sulfinyl group, an acyloxy group, an alkoxycarbonyl group, a carbamoyl group, a sulfamoyl group, an amino group, an alkylamino group, an acylamino group, a sulfonamido group, an imido group, a ureido group, a sulfamoylamino group, a urethane group, an alkoxy group, an alkylthio group, an aryloxy group, an arylthio group, a heterocyclic thio group and a heterocyclic oxy group.

4. The method as in claim 1, wherein said compound represented by formula (I) has a sum total of carbon atoms of 20 or less.

5. The method as in claim 2, wherein said nitrogen-containing heteroaromatic rings in formula (I) and formula (A) which may be the same or different, each is a pyrazole ring or a triazole ring.

6. The method as in claim 5, wherein said nitrogen-containing heteroaromatic rings in formula (I) and formula (A) which may be the same or different, each is a triazole ring.

7. The method as in claim 6, wherein said triazole ring is a 1,2,4-triazole ring.

8. The method as in claim 3, wherein said nitrogen-containing heteroaromatic rings in formula (I) and formula (A) which may be the same or different, each is an unsubstituted ring or a ring substituted by a substituent selected from the group consisting of an alkyl group, an alkenyl group, an alkoxy group, an alkylthio group, a halogen atom, and an amido group.

9. The method as in claim 8, wherein said nitrogen-containing heteroaromatic rings in formula (I) and formula (A) which may be the same or different, each is an unsubstituted ring.

10. The method as in claim 1, wherein $R_a$ and $R_b$ are $R_a$ and $R_b$ of the secondary amine having an acid dissociation constant pKa of 8 or more the secondary amines represented by formula (II)

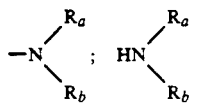

(II)

wherein $R_a$ and $R_b$ have the same meaning as in formula (A).

11. The method as in claim 10, wherein said $R_a$ and $R_b$ is bonded each other to form a 4- to 8-membered ring, provided that an alkyl group and/or an alkenyl group of $R_a$ and $R_b$ is directly bonded or is bonded through an oxygen atom, a nitrogen atom or a sulfur atom.

12. The method as in claim 11, wherein said 4- to 8-membered ring is at least one ring selected from the group consisting of a pyrrolidine ring, a piperidine ring, a morpholine ring, a piperazine ring, a pyrroline ring, a pyrrole ring, an imidazole ring, an imidazoline ring, an imidazolidine ring, a 1,4-oxazine ring, a 1,4-thiazine ring, and an azetidine ring.

13. The method as in claim 11, wherein $R_a$ and $R_b$ are bonded each other to form a 5- or 6-membered ring.

14. The method as in claim 13, wherein $R_a$ and $R_b$ are bonded each other to form a 5- or 6-membered saturated ring.

15. The method as in claim 14, wherein said 5- or 6-membered saturated ring is pyrrolidone, piperidine, morpholine or piperazine.

16. The method as in claim 15, wherein said 5- or 6-membered saturated ring is piperazine.

17. The method as in claim 16, wherein a compound which 5 or 6-membered saturated ring is said piperazine is a compound represented by formula (A-I):

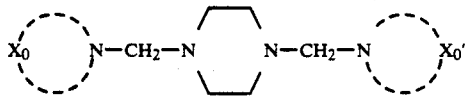

(A-I)

wherein $X_0$ and $X_0'$ have the same meaning as $X_0$ in formula (A), provided that $X_0$ and $X_0'$ may be the same or different.

18. The method as in claim 1, wherein said compound represented by formula (A) has a sum total of carbon atoms of 30 or less.

19. The method as in claim 1, wherein said compound represented by formula (A) is contained in said processing solution in an amount of from $1.0\times10^{-4}$ to 0.5 mol per liter of the processing solution.

20. The method as in claim 1, wherein said compound represented by formula (I) is used in an amount of from 0.01 to 100 mols per mol of the compound represented by formula (A).

21. The method as in claim 1, wherein said compound represented by formula (A) and said compound represented by formula (I) are incorporated in said processing solution by adding a formaldehyde derivative, the compound represented by formula (I) and the compound represented by formula (II) to the processing solution to form the compound represented by formula (A) in the processing solution and adding an excessive amount of a compound represented by formula (I) to the processing solution:

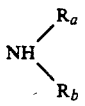

(II)

wherein $R_a$ and $R_b$ have the same meaning as in formula (A).

22. The method as in claim 1, wherein said processing solution is a stabilizing solution, a conditioning solution or a bleaching solution.

23. The method as in claim 22, wherein said processing solution is a stabilizing solution.

24. The method as in claim 23, wherein said stabilizing solution has a pH of from 6 to 9.

25. The method as in claim 1, wherein said silver halide color photographic material contains at least one kind of a four-equivalent magenta coupler.

26. The method as in claim 1, wherein said imagewise exposed silver halide color photographic material is processed in a stabilizing solution containing a compound represented by formula (I) and a compound represented by formula (A) for a processing time of from 10 seconds to 2 minutes.

27. The method as in claim 1, wherein said silver halide color photographic material contains a 4-equivalent magenta coupler comprising a 4-equivalent 5-pyrazolone series magenta coupler represented by formula (M) or a 4-equivalent pyrazoloazole series magenta coupler represented by formula (m):

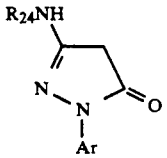

(M)

wherein $R_{24}$ represents an alkyl group, an aryl group, an acyl group, or a carbamoyl group; Ar represents a substituted or unsubstituted phenyl group; either $R_{24}$ or Ar may be a divalent or higher valent group forming a polymer which links the coupling mother nucleus to the main chain of a polymer.

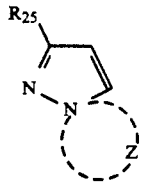

(m)

wherein $R_{25}$ represents a hydrogen atom or a substituent and Z represents a non-matellic atomic group necessary for forming a 5-membered azole ring containing 2 to 4 nitrogen atoms; the 5-membered azole ring may have a substituent or a condensed ring; either $R_{25}$ or the group substituting the azole ring may become a divalent or higher valent group to form a polymer or form a polymer coupler by bonding a high molecular chain with a coupling mother nucleus.

28. The method as in claim 1, wherein the compound represented by formula (A) is contained in said processing solution in an amount of from 0.001 to 0.1 mol per liter of the processing solution.

29. The method as in claim 1, wherein the compound represented by formula (I) is contained in the processing solution in an amount of from 0.1 to 20 mols per mol of the compound represented by formula (A).

* * * * *